US008779258B2

(12) United States Patent
Lyles et al.

(10) Patent No.: US 8,779,258 B2
(45) Date of Patent: Jul. 15, 2014

(54) STRINGED MUSICAL INSTRUMENT USING SPRING TENSION

(71) Applicant: InTune Technologies, Inc., Los Angeles, CA (US)

(72) Inventors: Cosmos Lyles, New York, NY (US); Paul Dowd, Bronxville, NY (US)

(73) Assignee: Intune Technologies, LLC, Los Angeles, CA (US)

( * ) Notice: Subject to any disclaimer, the term of this patent is extended or adjusted under 35 U.S.C. 154(b) by 0 days.

(21) Appl. No.: 13/745,582

(22) Filed: Jan. 18, 2013

(65) Prior Publication Data

US 2013/0220099 A1 Aug. 29, 2013

Related U.S. Application Data

(60) Provisional application No. 61/588,494, filed on Jan. 19, 2012.

(51) Int. Cl.
*G10D 3/12* (2006.01)
*G10D 3/14* (2006.01)

(52) U.S. Cl.
CPC . *G10D 3/143* (2013.01); *G10D 3/12* (2013.01)
USPC ..... 84/297 R

(58) Field of Classification Search
CPC ..... G10D 3/143; G10D 3/12
USPC ..... 84/297 R
See application file for complete search history.

(56) References Cited

U.S. PATENT DOCUMENTS

| | | | | | |
|---|---|---|---|---|---|
| 16,995 | A | * | 4/1857 | Randle | 84/297 R |
| 644,987 | A | * | 3/1900 | Lyon | 84/264 |
| 936,624 | A | * | 10/1909 | Hale | 84/297 R |
| 1,113,390 | A | * | 10/1914 | Wenzel-Schmidt | 84/455 |
| 1,253,550 | A | * | 1/1918 | Wilkins | 84/285 |
| 1,416,568 | A | * | 5/1922 | Mazzocco | 84/297 R |
| 1,626,753 | A | * | 5/1927 | Carlson et al. | 84/297 R |
| 1,684,057 | A | * | 9/1928 | Fisher | 84/297 R |
| 2,070,916 | A | * | 2/1937 | Peate | 84/297 R |

(Continued)

FOREIGN PATENT DOCUMENTS

| | | |
|---|---|---|
| JP | S48-022203 | 7/1973 |
| JP | 2005173515 | 6/2005 |

(Continued)

OTHER PUBLICATIONS

Peters, Randall D., "Physics of the Zero-length Spring of Geoscience," http://physics.mercer.edu/earthwaves/zero.html, downloaded Sep. 10, 2008.

(Continued)

*Primary Examiner* — Robert W Horn
(74) *Attorney, Agent, or Firm* — Klein, O'Neill & Singh. LLP

(57) ABSTRACT

A tensioner for a string on a stringed musical instrument is provided. The tensioner can include an elongated body, at least two spring modulation members, a spring modulation support, and at least one spring. Each of the spring modulation members have a first portion pivotably attached to a portion of the elongated body. The spring modulation support is pivotably attached to a second portion of each of the spring modulation members. The spring is interposed between the elongated body and the spring modulation support.

20 Claims, 35 Drawing Sheets

(56) References Cited

U.S. PATENT DOCUMENTS

| | | | | | |
|---|---|---|---|---|---|
| 2,130,248 | A | * | 9/1938 | Peate | 84/297 R |
| 2,254,012 | A | | 8/1941 | Kudo | |
| 2,262,179 | A | | 11/1941 | Hammond | |
| 2,453,572 | A | | 11/1948 | Ferrier | |
| 2,514,835 | A | * | 7/1950 | Bredice | 84/297 R |
| 2,736,226 | A | | 2/1956 | McBride | |
| 2,741,146 | A | | 4/1956 | Fender | |
| 2,844,985 | A | | 7/1958 | Ferriera | |
| 2,873,640 | A | | 2/1959 | Kunz | |
| 2,973,682 | A | | 3/1961 | Fender | |
| 3,136,198 | A | | 6/1964 | Smith et al. | |
| 3,403,588 | A | * | 10/1968 | Downing | 84/306 |
| 3,437,001 | A | | 4/1969 | Kraft | |
| 3,575,078 | A | * | 4/1971 | Currier | 84/173 |
| 3,580,525 | A | | 5/1971 | Dopner | |
| 3,583,272 | A | * | 6/1971 | Eurich | 84/267 |
| 3,584,807 | A | | 6/1971 | Smith | |
| 3,667,336 | A | | 6/1972 | Itzler et al. | |
| 3,688,631 | A | | 9/1972 | Jackson | |
| 3,695,137 | A | | 10/1972 | Eurich | |
| 3,780,612 | A | | 12/1973 | Robinson | |
| 3,924,820 | A | | 12/1975 | Kovar et al. | |
| 4,120,462 | A | | 10/1978 | Raasch et al. | |
| 4,129,154 | A | | 12/1978 | Bennelli | |
| 4,130,045 | A | | 12/1978 | Walker | |
| 4,137,812 | A | | 2/1979 | Franzmann | |
| 4,138,919 | A | | 2/1979 | Miller | |
| 4,161,903 | A | | 7/1979 | Sokol | |
| 4,170,161 | A | | 10/1979 | Kaftan | |
| 4,234,133 | A | * | 11/1980 | Enneking | 242/413.5 |
| 4,348,934 | A | | 9/1982 | Ogata | |
| 4,375,180 | A | | 3/1983 | Scholz | |
| 4,426,907 | A | | 1/1984 | Scholz | |
| 4,623,101 | A | | 11/1986 | Cacak | |
| 4,656,915 | A | | 4/1987 | Osuga | |
| 4,704,935 | A | | 11/1987 | Franklin | |
| 4,760,622 | A | * | 8/1988 | Rohrman | 16/196 |
| 4,762,046 | A | * | 8/1988 | Aspri et al. | 84/294 |
| 4,856,404 | A | | 8/1989 | Hughes, Sr. | |
| 4,876,794 | A | | 10/1989 | Myers | |
| 4,882,967 | A | | 11/1989 | Rose | |
| 4,909,126 | A | | 3/1990 | Skinn et al. | |
| 4,955,275 | A | | 9/1990 | Gunn | |
| 5,040,741 | A | | 8/1991 | Brown | |
| 5,080,295 | A | | 1/1992 | Hongo et al. | |
| 5,095,797 | A | * | 3/1992 | Zacaroli | 84/455 |
| 5,097,737 | A | | 3/1992 | Uhrig | |
| 5,173,565 | A | | 12/1992 | Gunn | |
| 5,277,373 | A | | 1/1994 | Morton | |
| 5,284,396 | A | | 2/1994 | Masumura et al. | |
| 5,293,804 | A | | 3/1994 | Myers | |
| 5,323,680 | A | | 6/1994 | Miller et al. | |
| 5,343,793 | A | | 9/1994 | Pattie | |
| 5,359,144 | A | | 10/1994 | Benson | |
| 5,377,926 | A | | 1/1995 | Min | |
| 5,390,579 | A | * | 2/1995 | Burgon | 84/454 |
| 5,413,019 | A | | 5/1995 | Blanda, Jr. | |
| 5,477,765 | A | | 12/1995 | Dietzman | |
| 5,567,895 | A | * | 10/1996 | Aspri et al. | 84/294 |
| 5,637,820 | A | | 6/1997 | Wittman | |
| 5,734,117 | A | | 3/1998 | Tanzella | |
| 5,756,913 | A | | 5/1998 | Gilmore | |
| 5,824,929 | A | | 10/1998 | Freeland et al. | |
| 5,859,378 | A | | 1/1999 | Freeland et al. | |
| 5,880,383 | A | | 3/1999 | Huff | |
| 5,886,270 | A | | 3/1999 | Wynn | |
| RE36,484 | E | | 1/2000 | Turner | |
| 6,034,311 | A | | 3/2000 | Fisher, IV | |
| 6,069,306 | A | | 5/2000 | Isvan et al. | |
| 6,084,166 | A | | 7/2000 | Lee | |
| 6,283,397 | B1 | | 9/2001 | Chen | |
| 6,384,311 | B1 | | 5/2002 | Cota | |
| 6,420,639 | B1 | | 7/2002 | Sherlock | |
| 6,437,226 | B2 | | 8/2002 | Oudshoorn et al. | |
| 6,723,904 | B1 | | 4/2004 | Dolan et al. | |
| 6,825,406 | B2 | | 11/2004 | Thidell | |
| 7,235,729 | B2 | | 6/2007 | Minakuchi | |
| 7,479,592 | B1 | * | 1/2009 | Slavik | 84/313 |
| 7,534,950 | B2 | * | 5/2009 | Lyles | 84/453 |
| 7,541,528 | B2 | * | 6/2009 | Lyles | 84/312 R |
| 7,554,023 | B2 | * | 6/2009 | Tyler | 84/313 |
| 7,579,536 | B2 | * | 8/2009 | Bonebrake | 84/312 R |
| 7,592,528 | B2 | * | 9/2009 | Lyles et al. | 84/297 R |
| 7,632,997 | B2 | * | 12/2009 | Small et al. | 84/306 |
| 7,692,079 | B2 | * | 4/2010 | Lyles | 84/312 R |
| 7,718,873 | B1 | | 5/2010 | Slavik | |
| 7,855,330 | B2 | | 12/2010 | Lyles et al. | |
| 7,888,570 | B2 | * | 2/2011 | Lyles et al. | 84/297 R |
| 2003/0094087 | A1 | | 5/2003 | Gregory | |
| 2003/0226441 | A1 | | 12/2003 | Barney | |
| 2006/0117930 | A1 | | 6/2006 | Folmar et al. | |
| 2007/0006712 | A1 | | 1/2007 | Lyles | |
| 2007/0012161 | A1 | | 1/2007 | Lyles | |
| 2007/0214931 | A1 | | 9/2007 | Lyles | |
| 2007/0214935 | A1 | | 9/2007 | Lyles | |
| 2007/0289429 | A1 | | 12/2007 | Tyler | |
| 2008/0196571 | A1 | | 8/2008 | Lyles | |
| 2009/0183619 | A1 | | 7/2009 | Lyles et al. | |
| 2009/0301283 | A1 | | 12/2009 | Lyles et al. | |
| 2012/0285312 | A1 | | 11/2012 | Lyles et al. | |
| 2013/0167705 | A1 | * | 7/2013 | Lyles et al. | 84/297 R |
| 2013/0220099 | A1 | * | 8/2013 | Lyles et al. | 84/297 R |
| 2014/0020544 | A1 | * | 1/2014 | Lyles et al. | 84/305 |

FOREIGN PATENT DOCUMENTS

| | | |
|---|---|---|
| WO | WO 00/38172 | 6/2000 |
| WO | WO 2007/008785 | 1/2007 |
| WO | WO 2007/106600 | 9/2007 |

OTHER PUBLICATIONS

Schmidt-Jones, Catherine, "Tuning Systems", Version 1.14: Dec. 8, 2006, http://cnx.org/content/m11639/latest.

* cited by examiner

STRINGED MUSICAL INSTRUMENT USING SPRING TENSION

CROSS-REFERENCE TO RELATED APPLICATIONS

This application is based upon and claims the priority of U.S. Provisional Application No. 61/588,494, filed on Jan. 19, 2012.

This application is also related to the subject matter disclosed in U.S. application Ser. No. 13/449,224, filed on Apr. 17, 2012, which is a continuation of U.S. application Ser. No. 13/025,868, filed on Feb. 11, 2011, which is a continuation of U.S. application Ser. No. 12/543,429, filed on Aug. 18, 2009, now U.S. Pat. No. 7,888,570, which is a continuation of U.S. application Ser. No. 11/724,724, filed on Mar. 15, 2007, now U.S. Pat. No. 7,592,528, issued Sep. 22, 2009, which is based on and claims the benefit of U.S. Provisional Application Nos. 60/782,602, filed on Mar. 15, 2006, 60/830,323, filed on Jul. 12, 2006, 60/858,555, filed on Nov. 10, 2006, and 60/880,230, filed on Jan. 11, 2007. The entirety of the priority application and each of these related applications is hereby incorporated by reference.

BACKGROUND OF THE INVENTION

1. Field of the Invention

The present invention relates to stringed musical instruments.

2. Description of the Related Art

Stringed musical instruments create music when strings of the instrument vibrate at wave frequencies corresponding to desired musical notes. Such strings typically are held at a specified tension, and the musical tone emitted by the string is a function of the vibration frequency, length, tension, material and density of the string. In order to maintain the instrument in appropriate tune, these parameters must be maintained. Typically, musical strings go out of tune because of variation in string tension. Such tension changes commonly occur when, for example, the string slackens over time. Tension can also change due to atmospheric conditions such as temperature, humidity, and the like.

Tuning a stringed instrument is a process that can range from inconvenient to laborious. For example, tuning a piano typically is a very involved process that may take an hour or more. Tuning a guitar is not as complex; however, it is inconvenient and can interfere with play and/or performance.

SUMMARY

Accordingly, there is a need in the art for a method and apparatus for mounting strings of a stringed musical instrument so that the instrument is more likely to maintain its correct tune, slower to go out of tune, easier and faster to place in tune, and so that retuning or adjusting the tune of the strings is easily and simply accomplished. There is also a need for a string instrument that will automatically adjust for string length changes without going out of tune.

In accordance with one embodiment, a tensioner for a string on a stringed musical instrument is provided. The tensioner comprises an elongated body, a first and a second modulation member, and a spring modulation support, and at least one spring. Each of the first and second spring modulation members comprise a first portion pivotably attached to a portion of the elongated body. The spring modulation support is pivotably attached to a second portion of each of the first and second spring modulation members. The at least one spring is interposed between the elongated body and the spring modulation support.

In some embodiments, the attachment of the at least one spring is movable with respect to at least one of the elongated body and the spring modulation support to vary the spring tension between the elongated body and the spring modulation support.

In some embodiments, the tensioner further comprises a stop configured to limit the travel of pivotability between the elongated body and the spring modulation support.

In some embodiments, at least one of the first and second spring modulation members comprises a pair of tips configured to pivotably attach the first portion of the respective spring modulation member to the elongated body and the second portion of the respective spring modulation member to the spring modulation support.

In some embodiments, the pair of tips of the first spring modulation member comprises a pair of outwardly facing tips configured to engage a pair of inwardly facing recesses in each of the elongated body and the spring modulation support.

In some embodiments, the first spring modulation member comprises an approximately square cross-sectional shape, the pair of tips comprising opposed corners of the square.

In some embodiments, the pair of tips of the second spring modulation member comprises a pair of inwardly facing tips configured to engage a pair of outwardly facing recesses in each of the elongated body and the spring modulation support.

In some embodiments, the second spring modulation member comprises an approximately C-shape, the pair of tips comprising inwardly-facing tips of the C-like shape.

In some embodiments, the second spring modulation member provides an inward bias between the elongated body and the spring modulation support.

In some embodiments, the second spring modulation member is elastically expandable so that a distance between the inwardly facing tips can expand or contract as the spring modulation support moves relative to the elongated body.

In accordance with another embodiment, a tensioner for a string on a stringed musical instrument is provided. The tensioner comprises an elongated body, a spring modulation support, a first spring modulation member and a second spring modulation member. The elongated body is configured to support a string of the musical instrument. The spring modulation support is configured to be mounted on a musical instrument. The tensioner further comprises a first pivotable means for pivotably attaching the first spring modulation member to each of the elongated body and the spring modulation support. The tensioner further comprises a second pivotable means for pivotably attaching the second spring modulation support member to each of the elongated body and the spring modulation support. The tensioner further comprises a means for providing a bias between the elongated body and the spring modulation support.

DETAILED DESCRIPTION

The following description presents embodiments illustrating inventive principles. It is to be understood that various types of musical instruments can be constructed using the principles as described herein, and embodiments are not to be limited to the illustrated and/or specifically-discussed examples, but may selectively employ various aspects and/or principles disclosed in this application. For example, for ease of reference, most embodiments are disclosed and depicted herein in the context of a six-string guitar. However, principles as discussed herein can be applied to other stringed musical instruments such as, for example, 12-string guitars, bass guitars, violins, harps, and pianos.

Figure 1:
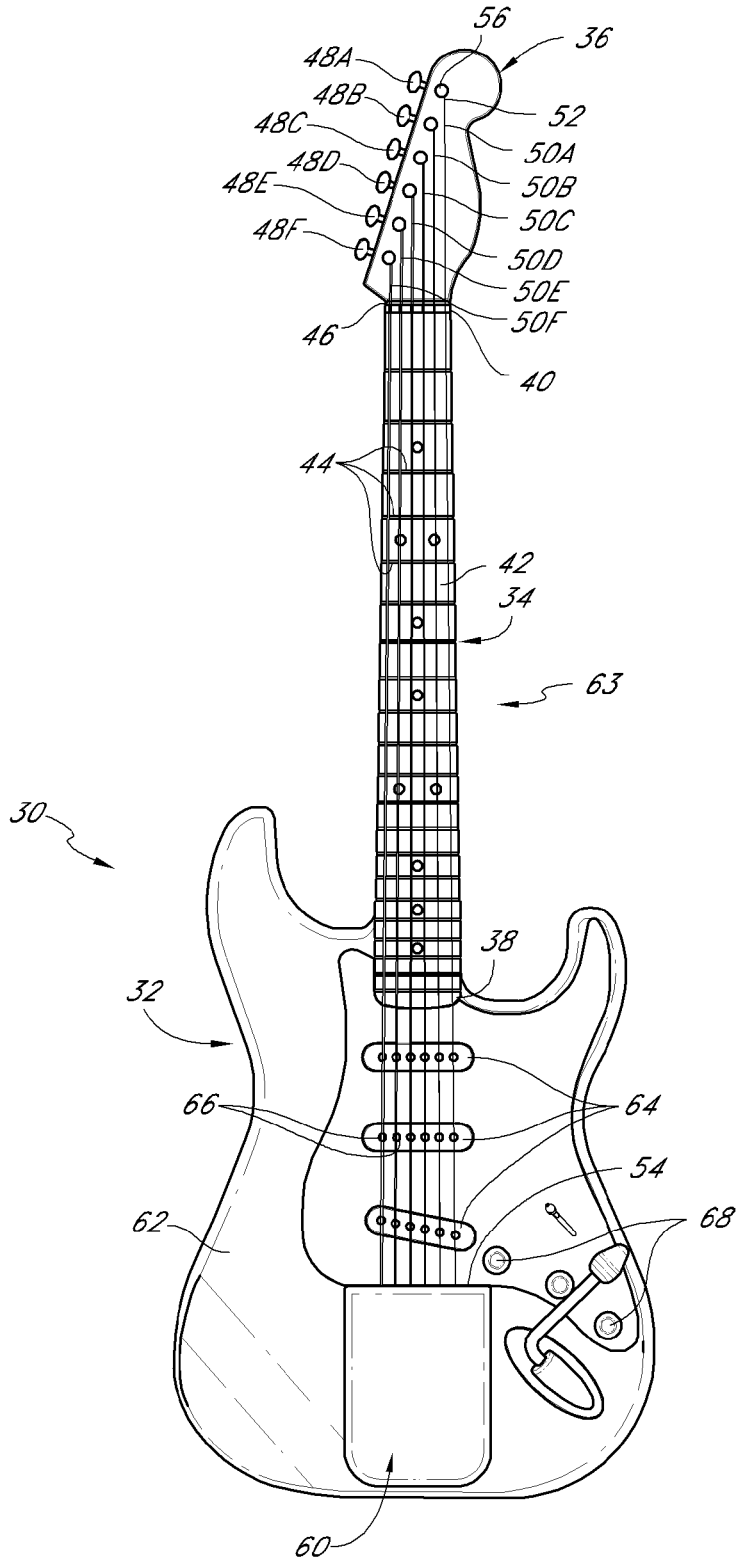
FIG. 1 shows an embodiment of a guitar employing a string mounting system depicted schematically and having aspects described herein.

With initial reference to FIG. 1, a guitar 30 is illustrated. The guitar 30 comprises a body 32, an elongate neck 34, and a head 36. A first end 38 of the neck 34 is attached to the body 32 and a second end 40 of the neck 34 is attached to the head 36. A fretboard 42 having a plurality of frets 44 is disposed on the neck 34, and a nut 46 is arranged generally at the point when the neck 34 joins with the head 36. Six tuning knobs 48A-F are disposed on the head 36. Six musical strings 50A-F are also provided, each having first and second ends 52, 54. The first end 52 of each string 50 is attached to an axle 56 of a corresponding tuning knob 48, and at least part of the string 50 is wrapped about the tuning knob axle 56. Each string 50 is drawn from the tuning knob 48 over the nut 46, and is suspended between the nut 46 and a string mounting system 60 disposed on a front face 62 of the body 32. The second end 54 of each musical string 50 is attached to the string mounting system 60.

In a conventional guitar, the string mounting system 60 comprises a stop having a plurality of slots generally corresponding to the strings. Preferably, the second end of each string includes a ball or the like that is configured to fit behind the slot so that the string ball is prevented from moving forwardly past the slot. A bridge usually is provided in front of the stop. By turning the tuning knobs a user tightens the strings so that they are suspended between the bridge and the nut. This suspended portion of the string 50, when vibrated, generates a musical note and can be defined as a playing zone 63 of the strings. The tuning knobs 48 are used to adjust string tension until the desired string tune is attained.

The illustrated embodiment is an electric guitar, and additionally provides a plurality of pickups 64, which include sensors 66 adapted to sense the vibration of the strings 50 and to generate a signal that can be communicated to an amplifier. Controllers 68 such as for volume control and the like are also depicted on the illustrated guitar 30.

In the embodiment illustrated in FIG. 1, the string mounting system 60 is depicted schematically. Applicants anticipate that string mounting systems having various structures can be employed with such a guitar 30.

Figure 2:
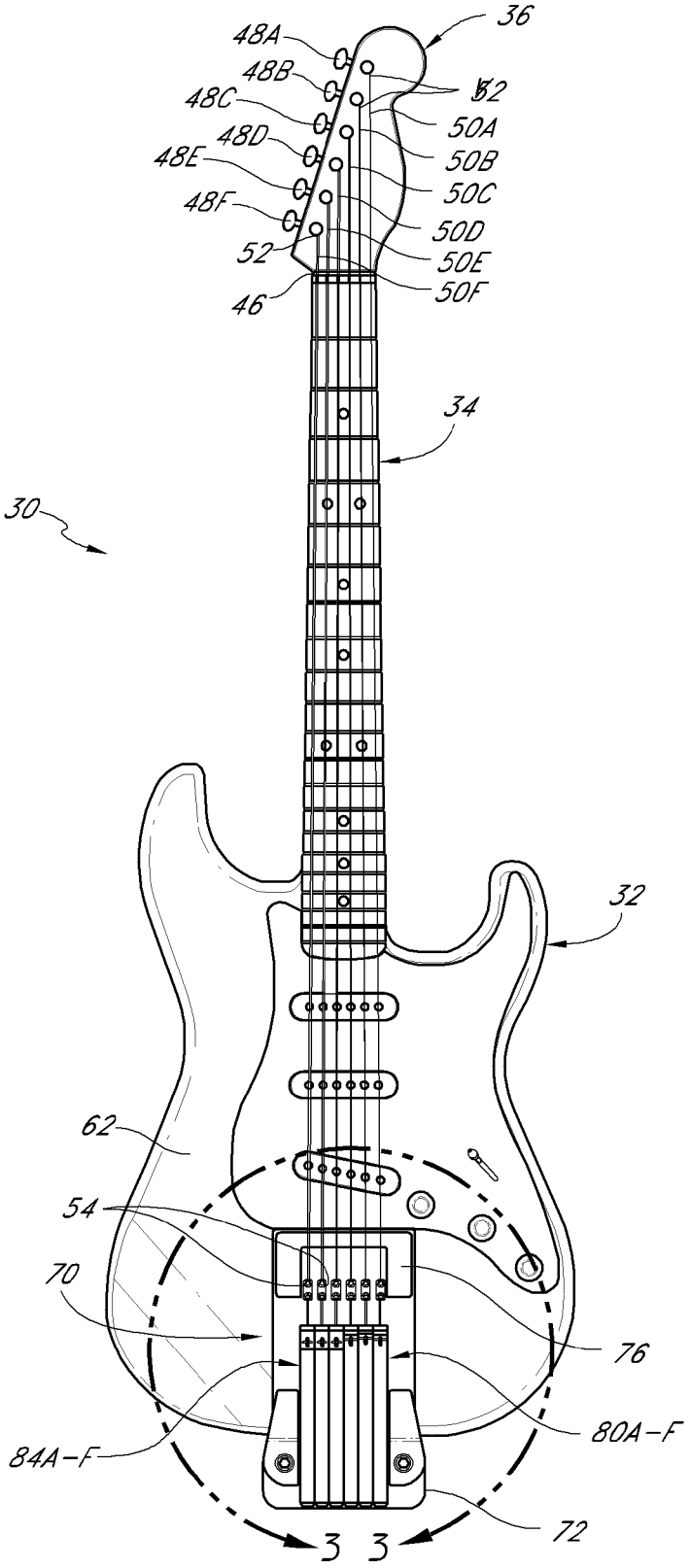
FIG. 2 shows an embodiment of a guitar employing an embodiment of a string mounting system having aspects of the present invention.

With reference next to FIG. 2, an embodiment of a guitar 30 having features substantially similar to the guitar depicted in FIG. 1 is illustrated. However, the illustrated guitar additionally includes an embodiment of a string mounting system 70 that includes springs 71 to tension the musical strings 50.

Figure 3:
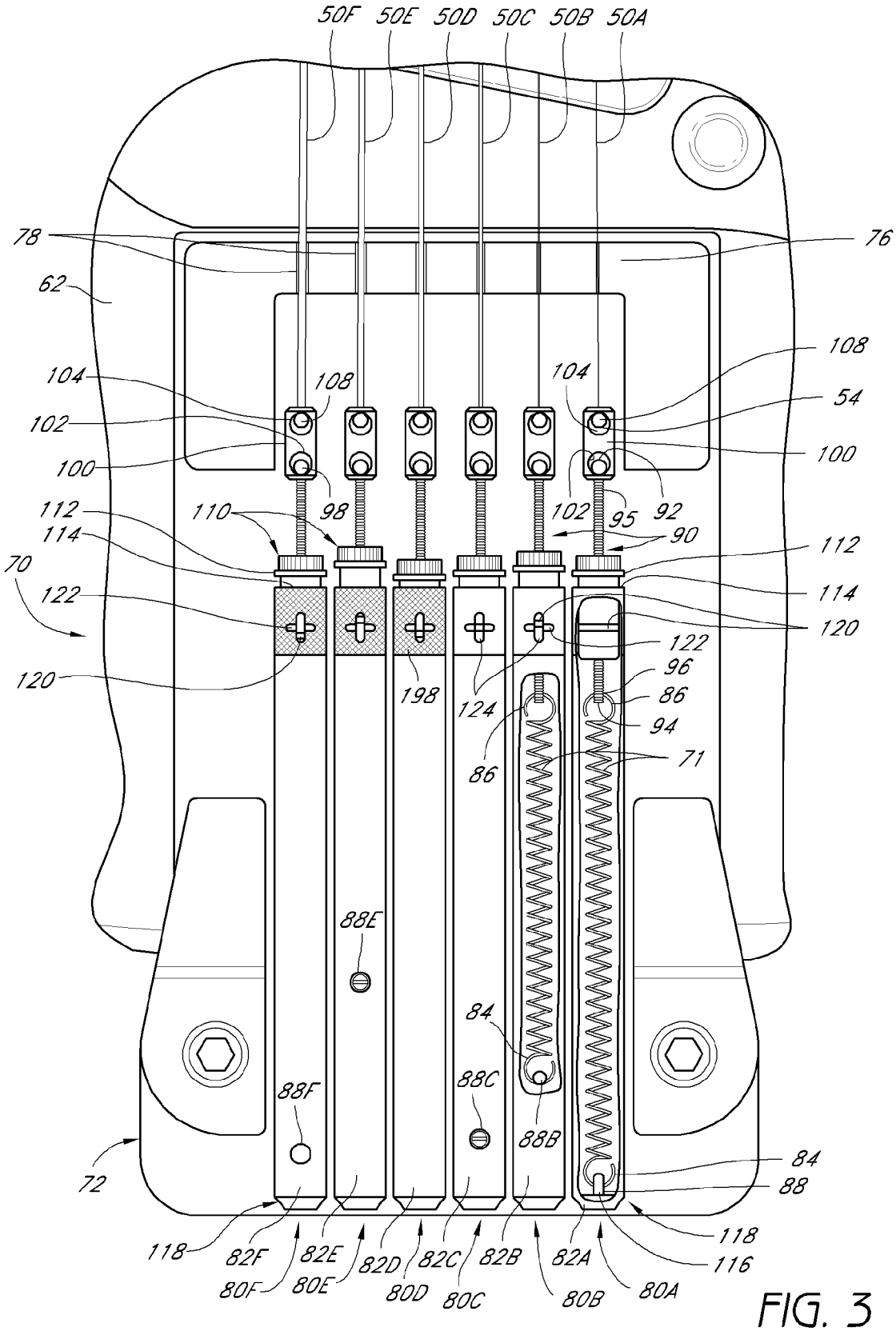
FIG. 3 is a close up view of the guitar of FIG. 2 taken along lines 3-3, and showing portions of the string mounting system partially cutaway.
Figure 4:
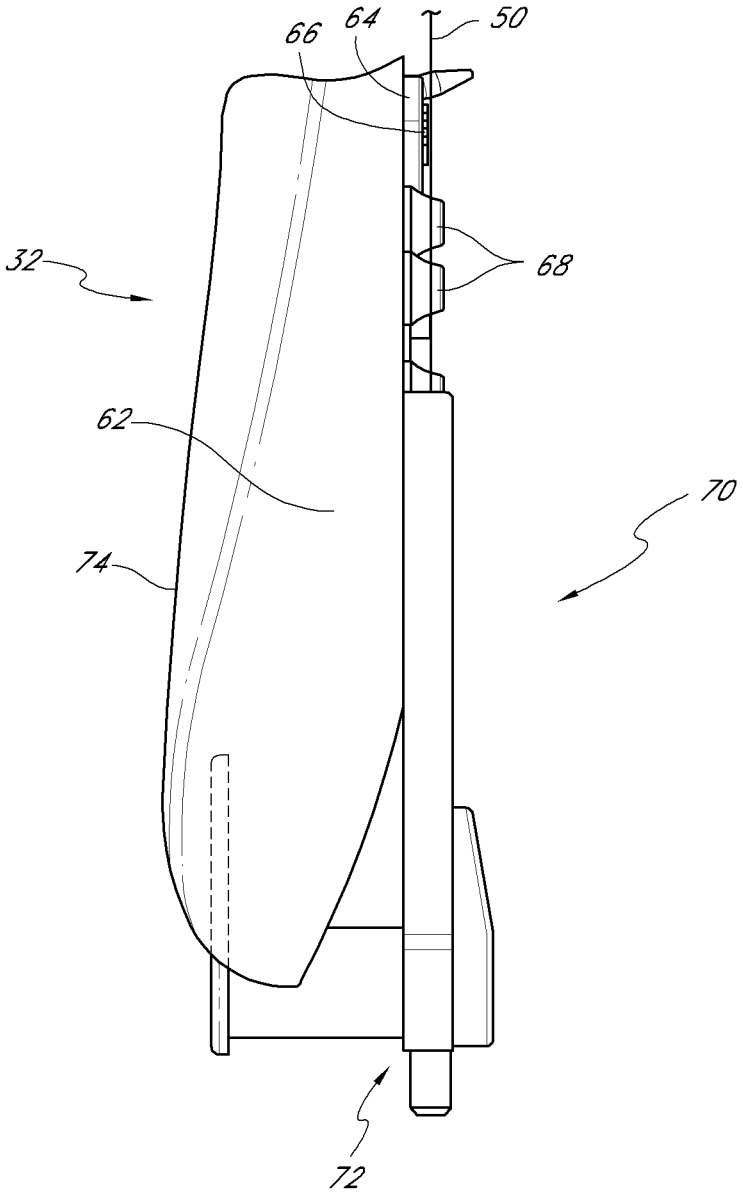
FIG. 4 is a side view of the portion of the guitar shown in FIG. 3.

With more particular reference to FIGS. 3-4, the illustrated string mounting system 70 includes a frame 72 that is mounted onto the guitar body 32. The frame 72 grasps both the front face 62 and a back 74 of the guitar body 32. The illustrated system 70 comprises a bridge 76 having string tracks or saddles 78 adapted to accommodate corresponding strings 50.

With specific reference to FIG. 3, the illustrated string mounting system 70 includes a plurality of spring assemblies 80A-F, each assembly dedicated to secure a corresponding musical string 50A-F. Each spring assembly 80 includes a spring holder or tube 82 that generally encloses a spring 71. Each elongate spring 71 has a first end 82 and a second end 86. A base connector 88 is provided along the length of the spring tube 82, and the first end 84 of the spring 71 is attached to the base connector 88. An elongate spring connector 90 also has a first end 92, a second end 94, and an elongate body 95 therebetween. The second end 94 of the spring connector 90 preferably comprises an aperture 96 or the like to facilitate connecting to the second end 86 of the spring 71, preferably within the tube 82. The first end 92 of the spring connector 90 preferably comprises a ball, disc or other mechanical interface structure 98 having an expanded width relative to the body 95.

A plurality of string holders 100 are provided, each having two receivers 102, 104. A first receiver 192 is adapted to engage the ball 98 on the first end 94 of the spring connector 90. A second receiver 104 of each string holder 100 is adapted to receive and secure a ball connector 108 on the second end 54 of the respective musical string 50. As such, the string holder 100 connects a musical string 50 to the spring connector 90, and the spring connector 90 connects the string holder 100 to the spring 71. Thus, each spring 71 is mechanically connected to a corresponding musical string 50 so that spring tension is communicated to the string 50. In this embodiment, the connection is achieved by a mechanical interface that includes the spring connector 90 and string holder 100. It is to be understood that, in other embodiments, mechanical interfaces having different structural characteristics may be used to connect the string 50 to the spring 71.

An elongate stop 110 is provided on and attached to each elongate spring connector 90. Preferably, each stop 110 includes a ridge 112 sized and adapted to engage an end 114 of the corresponding spring tube 82 when the corresponding string 50 is slack or unconnected. As such, the spring 71 is kept in a pre-stressed condition, even when the corresponding musical string 50 is slack or not attached. Since the spring is already pre-stressed when the string 50 is connected when stringing the instrument, it is relatively quickly and easily tightened to string tension corresponding to correct tune. Thus, quick initial tuning is facilitated by this structure.

Preferably, each spring 71 is chosen and arranged so that its pre-stressed condition is close to, but not less than, the nominal tension associated with the corresponding string's proper tuning. For instance, if the string 50 is properly tuned at a tension of 17 lb., the pre-stressed condition of the spring 71 preferably is greater than about 15 lbs., and may be almost 17 lbs. Preferably, the pre-stressed condition is within about 25% of the proper tuning tension. More preferably, the pre-stressed condition is within about 10% of the proper tuning tension. Even more preferably, the pre-stressed condition is within about 5% of the proper tuning tension.

Properly pre-stressing the spring 71 may be accomplished in various ways. For example, in the illustrated embodiment, the first end 84 of each spring 71 is attached to its corresponding base connector 88 arranged in the tube 82. The base connector 88 is placed along the length of the tube 82 so that when the first end 84 of the spring 71 is attached to the base connector 88 and the second end 86 of the spring 71 is attached to the spring connector 90, the spring 71 is maintained at its appropriate pre-stressed tension. In a preferred embodiment, the position of each base connector 88 is chosen so that the corresponding spring 71 is placed in a desired pre-stressed tension when connected. It is to be understood, however, that other factors may also be varied. For example, in addition to or instead of varying the position of the base connector 88, varying characteristics of the spring, such as using a spring having a special chosen spring rate, may customize the spring arrangement for specific corresponding strings.

In the illustrated embodiment, the base connectors 88B, 88C, 88E comprise screws driven through the tubes 82 at desired locations. In additional embodiments, the base connectors may have different structures. For example, base connector 88F is a rod extending through the tube 82. In other embodiments, such base connector structures may be attached, welded, clipped or the like at specified locations along the tube. Preferably, connectors 116 are also provided at a distal end 118 of each tube 82 and, as with base connector 88A, may function as the base connector.

With the spring 71 in a pre-stressed state, initial tuning of the guitar 30 is relatively quick and easy. To string the guitar 30 illustrated in FIGS. 2-4, the first end 52 of each string 50A-F is appropriately attached to its corresponding tuning knob 58A-F and the second end 54 is attached to a corresponding string holder 100. The tuning knob 48 is then turned to take up the slack in the string 50 so that the spring 71 is engaged. Further turning of the tuning knob 48 with the spring 71 engaged increases tension applied to the string 50 by the spring 71. Preferably, the spring 71 is chosen to have a rate (increase in lbs. of tension applied per inch of elongation) adapted so that it will take only one to a few turns of the tuning knob 48 to achieve a musical string tension corresponding to proper string tune.

In a preferred embodiment, a spring 71 having a rate of about 20 lb./in is employed. However, it is to be understood that a wide range of spring rates can be employed. For example, a spring 71 having a rate of about 40 lb./in could be used, and would enable use of shorter spring tubes 82. Conversely, a spring having a rate of 1-5 lb./in could also be used. With such a spring, elongation of the corresponding musical string, which happens naturally, will have little effect on tune of the string, and thus the instrument will stay in or close to tune despite string elongation.

In the illustrated embodiment, the spring connector bodies 95 and the attached stops 110 are matingly threaded so that each stop 110 is movable over its corresponding elongate spring connector 90. Further, a tune indicator line 120 preferably is provided circumferentially around a portion of each stop 110; a tune indicator reference line 122 is also provided on each tube 82. A view hole 124 preferably is formed through each tube 82 so that a portion of the stop 110 within the tube 82 is visible through the view hole 124. Preferably, the reference line 122 on the tube is provided adjacent the view hole 124.

Figure 3A:
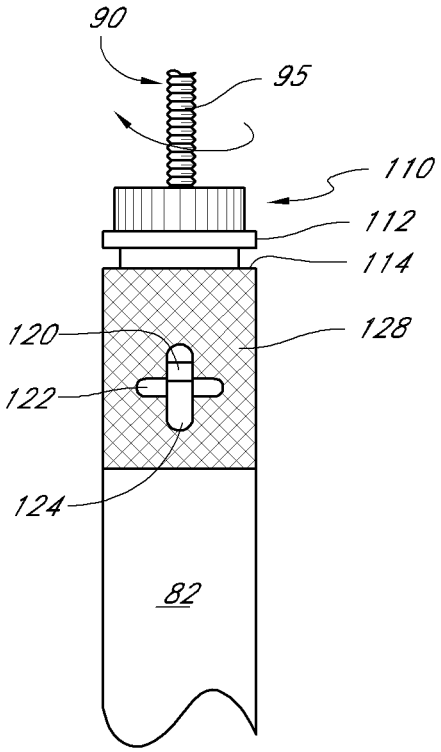
FIG. 3A is a close up view of a stop member in a position relative to a corresponding tube and spring connector when a corresponding string has just been placed in correct tune.
Figure 3B:
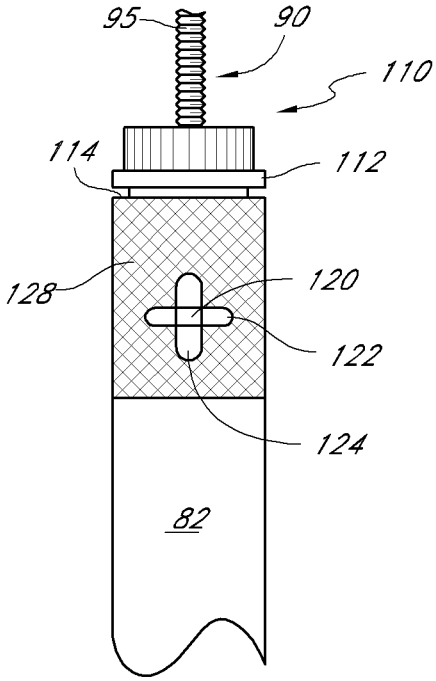
FIG. 3B shows the arrangement of FIG. 3A after the stop member has been moved to align the stop tune indicator with the tube reference indicator.

With specific reference to FIGS. 3A and 3B, to achieve a visually-indicated tune of the illustrated guitar, the strings 50 are first installed and preferably tuned by a conventional method. The stops 110 are not involved in the initial tuning procedure, and the stop reference line 120 and tube reference line 122 likely will not be aligned, as depicted on FIG. 3A. Once the strings 50 are tuned, each stop 110 is moved along its corresponding spring connector 90 so that the stop tune indicator 120 is aligned with the reference indicator 122 on the corresponding tube 82 as depicted in FIG. 3B. Such alignment establishes a mechanical and visual indicator of a perfectly-in-tune condition. The position of the stop 110 on the spring connector 90 does not affect tension applied to the string 50, so moving the stop 110 establishes a reference point without affecting string tension.

Musical strings tend to stretch during play due to environmental changes or other factors. In the past, a musician would have to periodically stop play to check or retune his instrument. Such tuning required plucking or otherwise sounding the string 50, and then using a tuner, ear, or other method to verify and/or adjust the tune. Certain electronics-based products including sensors may also be used to determine tune. Also, electromechanical devices employing motor-driven tuning knobs controlled by electronic controllers based on sensor input can also be employed.

In the illustrated embodiment, change in the elongation of the strings 50 will be mechanically indicated by the stop and tube reference indicators 120, 122 going out of alignment. This can be visually checked by the user, and even visually corrected by adjusting the tuning knob 48 until the indicators 120, 122 are again aligned. With the indicators 120, 122 returned to alignment, the instrument is again in perfect tune since the spring 71 is again stretched to the displacement (and corresponding tension) corresponding to perfect tune, which measurement was established when the instrument was initially tuned. As such, tune can be checked and corrected without ever sounding the string 50. Also, elongation of a string 50 can be identified and corrections made even before there is an audible effect on the string's tune.

With continued reference to FIGS. 3, 3A and 3B, the illustrated embodiment shows alternatives for indicator line configurations. For example, in tubes 82A, B and C, reference indicators 122 are printed directly on the tubes. In tubes 82 D, E, and F, a dark coating 128 is deposited on the tubes around the view hole 124, and the reference indicator lines 122 are printed on the dark coating 128 so as to provide increased contrast.

Other embodiments can use various structures and methods to increase visibility of the indicator lines 120, 122. For example, in one embodiment, the indicator lines are made using a phosphor or other material that will enable the lines to glow and/or more readily reflect light. As such, the alignment of the indicator lines 120, 122 can be easily observed even by a musician performing in a darkened venue. In still another embodiment a light source, such as an LED or laser, is provided on the mounting system, such as in or around the frame 72, in or on the spring tubes 82, or elsewhere, so as to directly or indirectly illuminate the indicator lines 120, 122 and/or provide a back light to aid viewing of the indicator lines. Still further lighting structures and methods, such as fiber optics and the like, can also be employed.

For example, the indicator 122 may include an aperture, and the indicator 120 may comprise a precisely-focused light, such as from a laser or fiber optic. When the indicators 120, 122 are appropriately aligned, the light is visible through the aperture. In another embodiment, the aperture includes a light-diffusing material that will glow when light impinges thereon. In still another embodiment, indicator 120 includes the aperture and indicator 122 includes the light.

In yet another embodiment, rather than providing a view aperture 124 in the spring tubes 82, the reference tune is determined by aligning the stop reference line 120 with the end 114 of the spring tube 82. In still other embodiments, a reference for aligning with the stop 120 can be provided on the body of the guitar, on the frame, or in any other suitable location.

In still another embodiment, a first photodetector is disposed immediately adjacent a first side of the reference line 122 and a second photodetector is disposed immediately adjacent a second side of the reference line 122. A laser or other precisely-focused light source is provided at the stop reference line 120. The photodetectors are adapted so that they do not see the light source when the stop is properly aligned. However, if the string elongates or contracts sufficient to move the stop 100, the light source will be detected by one of the photodetectors.

Preferably, each photodetector is adapted to generate a signal to indicate that the particular string 50 is varying from perfect tune. For example, if the first photodetector detects the light source, a yellow signal lamp is lit, signaling the musician to tighten the string, but if the second photodetector detects the light source, a red signal lamp is lit, signaling the musician to loosen the string. The signal is extinguished when perfect tune is again achieved. Thus, visual tuning can be achieved using media other than the musician's eyes to detect changes in string tension and tune.

In yet another embodiment, the photodetector signals may trigger automatic tuning correction without direct intervention by the musician. U.S. Pat. No. 6,437,226, the entirety of which is incorporated herein by reference, discloses a system in which a transducer detects a string vibration, which is then analyzed to determine if it is in proper tune. If the string is out of tune, motors are actuated to tighten or loosen the string to restore it to proper tune. In the present embodiment, such motors may be actuated by the photodetector signals without the need of detecting and analyzing string vibrations. Strings may be automatically kept in tune without requiring sounding of the string.

In the embodiment illustrated in FIGS. 2-4, the string mounting system 70 is attached to the guitar body 33 by a frame 72 that attaches to the outside of the body 32. In another embodiment, the string mounting system 70 may employ a frame incorporated within and supported by the body 32 of the guitar 30. Components such as the spring tubes 82 may be at least partially hidden from view. In a still further embodiment, rather than a plurality of spring tubes, a spring box is provided, each box containing multiple springs. In yet further embodiments, rather than using boxes or tubes, the first end 84 of each spring 71 may even be attached to a frame portion that may be incorporated into the body of the guitar.

In still further embodiments, the springs can be at least partially embedded in the body of the guitar and may act in a direction transverse and/or opposite to the direction of the string. In such embodiments, the spring may be connected to the string by a pulley, lever, cam, or other mechanical interface to provide a mechanical advantage, disadvantage, and/or redirect the spring tension.

Figure 5:
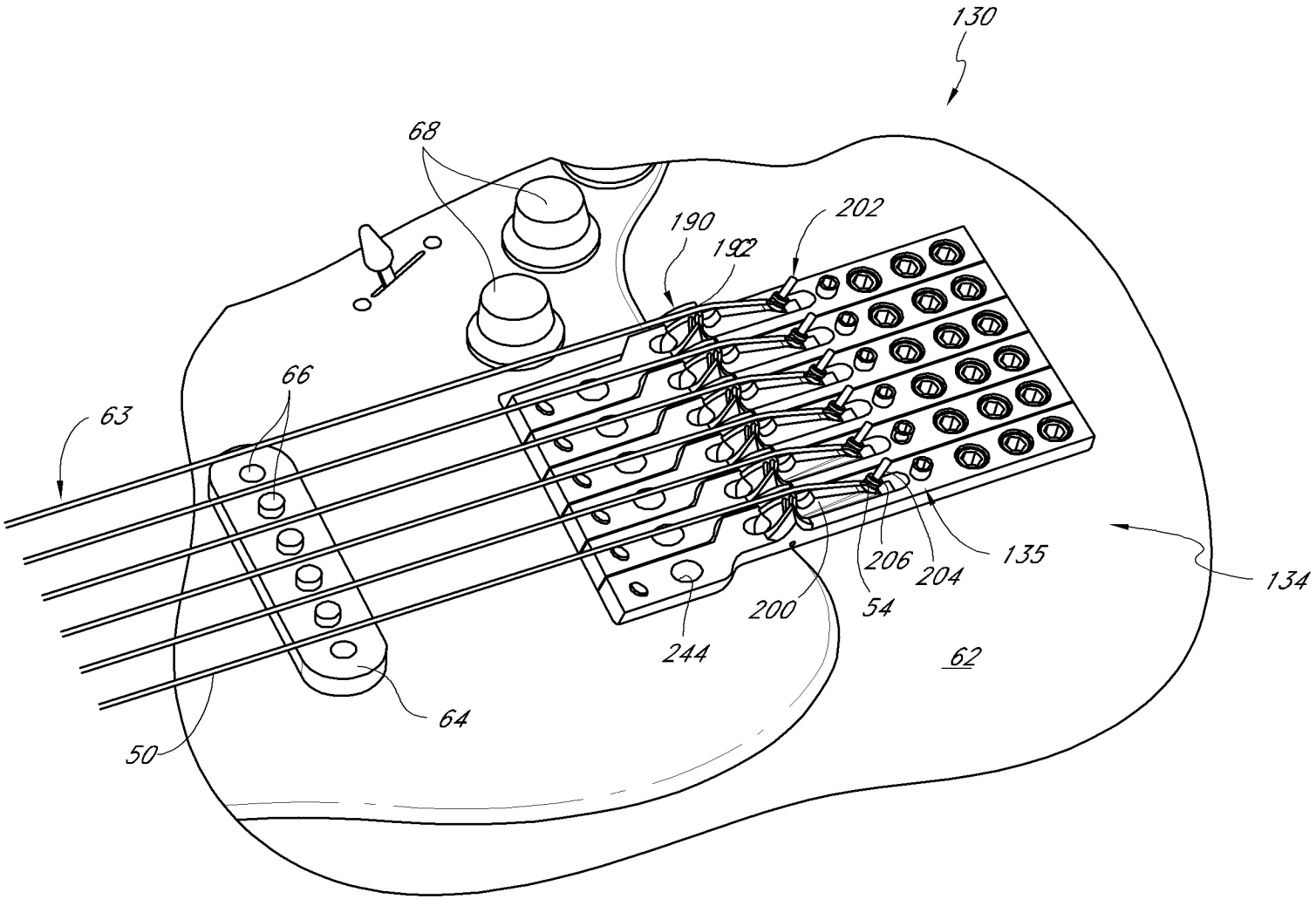
FIG. 5 is a close up perspective view of another embodiment of a guitar with a string mounting system having aspects in accordance with the present invention.

With reference next to FIG. 5, another embodiment of a guitar 130 employing a string mounting system 134 is illustrated. In the illustrated embodiment, the string mounting system 134 uses a set of six string tensioners 135 attached to the face 62 of the guitar body 32 and arranged side by side. One tensioner 135 corresponds to each musical string 50. As will be discussed in more detail below, each tensioner 135 uses a spring 138 to supply tension to the corresponding string 50. However, a spring force modulating member 140, such as a cam, is interposed between the string 50 and the spring 138 so that the actual tension applied to the string 50 by the spring 138 is not necessarily the same as the tension of the spring 138. Most preferably, the modulating member 140 is adapted so that the change in the tension supplied to the string by the spring upon a corresponding change in spring length is not linear. More specifically, the change in force actually applied by the spring 138 to the string 50 as the spring 138 changes length is modulated and preferably tempered by the mechanical member 140 interposed between the spring 138 and the string 50. In the illustrated embodiment, the modulating member 140 functions as a mechanical interface between the string 50 and the spring 138.

With reference next to FIGS. 6-9, several views are provided of a preferred embodiment of a string tensioner 135. The illustrated string tensioner 135 comprises an elongate body 142 having a top surface 144 and having a bottom surface 146 that is adapted to be attached to the front face 62 of the guitar 130. The tensioner body 142 has a first end 148 and a second end 150. Preferably, the elongate body 142 is positioned on the guitar body 62 so as to be generally aligned with a corresponding guitar string 50. The first end 148 is generally closer to the neck 34 than the second end 150, which is closer to a rear of the guitar 130.

Figure 7:
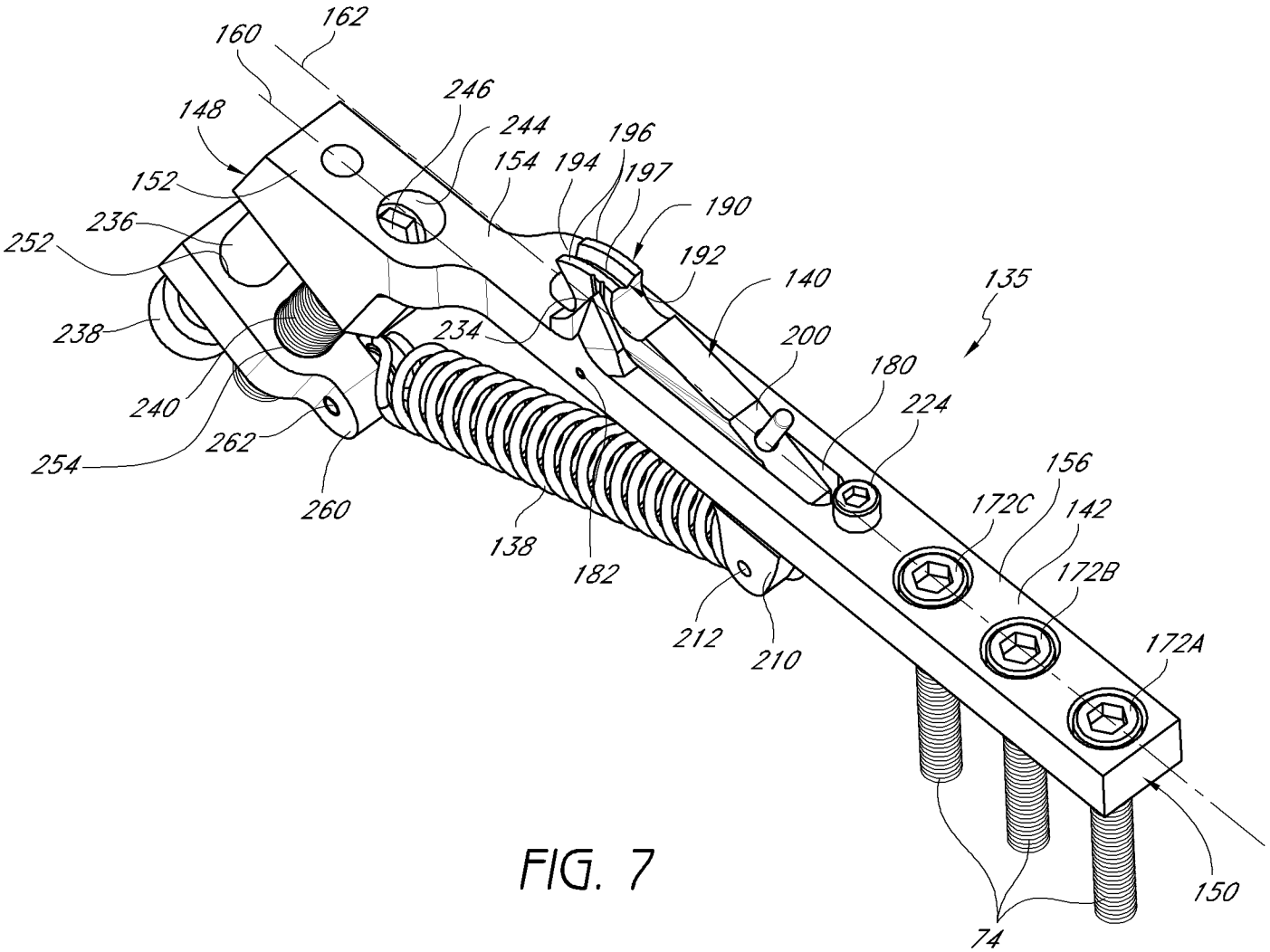
FIG. 7 is a perspective view of the string tensioner of FIG. 6.

A first portion 152 of the tensioner body 142 is defined generally adjacent the first end 148. An offset section 154 is interposed between the first portion 152 and a second portion 156 of the tensioner body 142, which is defined on a side of the offset section 154 opposite the first portion 152. As such, a longitudinal center line 160 of the first portion 152 preferably is generally parallel to but spaced from a longitudinal center line 162 of the second portion 156, as best shown in FIG. 7.

A depending portion 164 extends downwardly and, preferably, forwardly from the first portion 152. Preferably a cavity 166 is formed in the guitar body 32 (see FIG. 12) to accommodate the depending portion 164 and other parts of the string tensioner 135 that are disposed below the bottom surface 146 of the tensioner body 142.

A plurality of mounts 170 preferably are provided for engaging the guitar body 32 and holding the string tensioner 135 in place. In the illustrated embodiment, three apertures 172A-C are formed in the second portion 156 of the tensioner body 142. Each aperture 172A-C is configured to accommodate an elongate fastener 174 adapted to extend into the guitar body 32. In one embodiment, the fasteners 174 comprise screws. In another embodiment, the fasteners 174 comprise bolts. In still another embodiment, bolt receivers (not shown) are embedded into the guitar body 32 and the fasteners comprise bolts adapted to engage the bolt receivers so as to hold the string tensioner body 142 firmly in place on the guitar body 32.

With continued reference to FIGS. 6-9, an elongate aperture 180 is formed through the second portion 156 of the tensioner body 142. A spring force modulation member 140 is adapted to fit generally within and through the elongate aperture 180. The modulation member 140 is connected to the body 142 by a pivot 182. In the illustrated embodiment, the pivot 182 comprises an axle extending transversely across the elongate aperture 180. The modulation member 140 rotates about the pivot 182. In the illustrated embodiment, the pivot 182 comprises an axle. It is to be understood that other structures may be employed. For example, in another embodiment, a wedge-shaped member having a relatively narrow upper edge, also sometimes referred to as a "knife pivot", is adapted to support the modulation member 140. The modulation member 140 may thus rock about the upper edge, enabling pivoting with very little friction.

Figure 6:
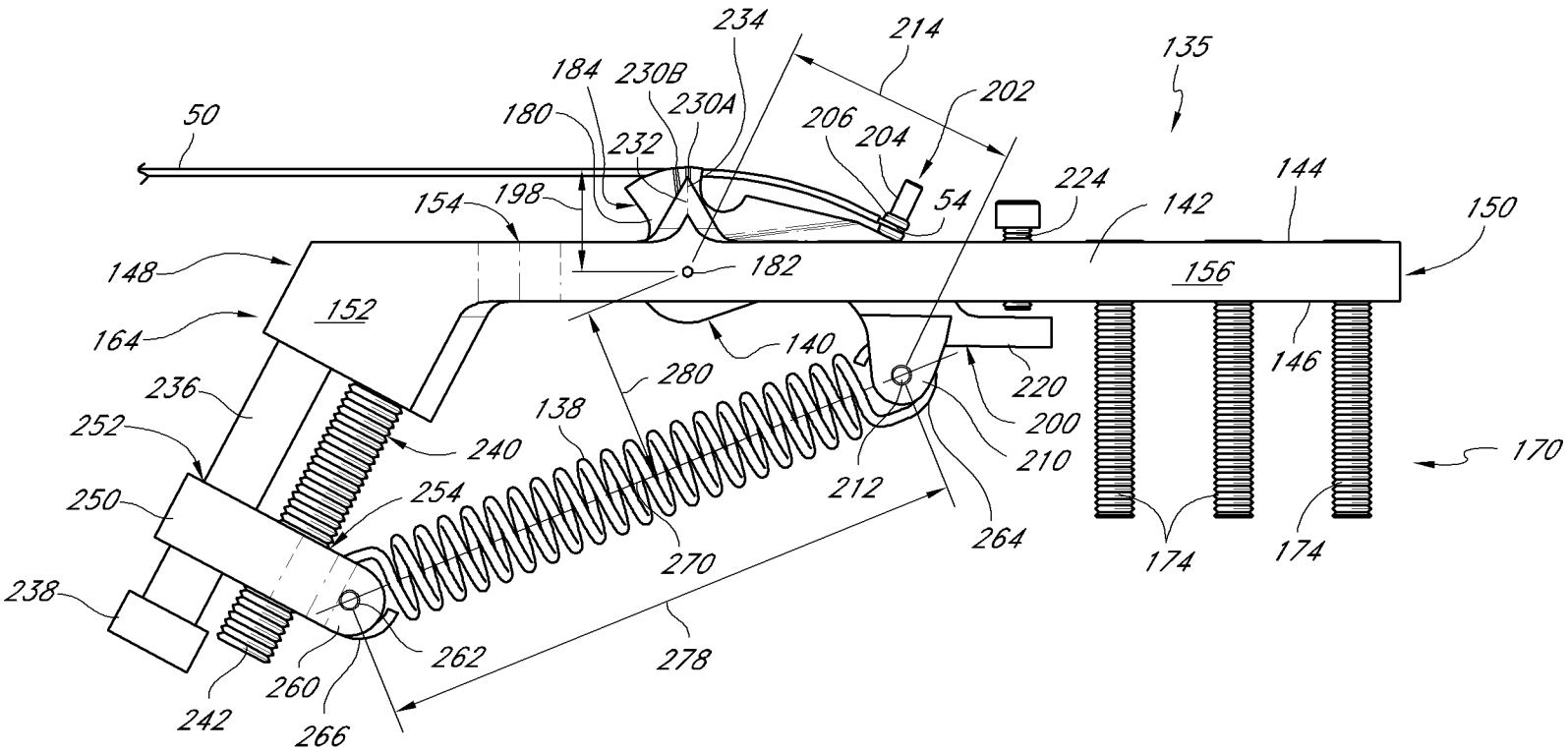
FIG. 6 is a schematic side view of a string tensioner used in accordance with the embodiment illustrated in FIG. 5.

A cam portion 184 of the modulation member 140 extends generally upwardly from the pivot 182 and comprises a string receiver 190. As illustrated, the string receiver 190 preferably comprises a saddle 192 or string track 192 adapted to accommodate and hold the guitar string 50 therein as shown in FIGS. 5 and 6. The saddle 192 preferably is defined by an elongate cavity 194 between a pair of projecting portions 196. (See FIG. 7.) A base or floor 197 of the saddle 192 preferably is arcuate, preferably generally matching the arc of a radius 198 measured from the pivot 182 to the base 197 of the saddle 192. Preferably, the distance 198 from the pivot 182 to the base 197 of the saddle 192 is generally constant along the length of the saddle 192. However, in other embodiments, the radius may vary along the length of the saddle 192.

An arm 200 of the force modulating member 140 extends generally rearwardly and through the body 142 to a point below the tensioner body bottom surface 146. A string connector 202 preferably extends upwardly from the arm 200 and is spaced from the string receiver 190. In the illustrated embodiment, the string connector 202 comprises a generally cylindrical rod 204 adapted to engage a corresponding connector 206 disposed on the end 54 of the musical string 50. Preferably, the connector 206 on the string 50 comprises an eyelet that slips over the rod 204. It is anticipated that other string connecting structures may be used in other embodiments.

A spring mount 210 is provided on the modulating member arm 200 generally below the bottom surface 146 of the body 142. Preferably, the spring mount 210 comprises a pin 212 adapted to accommodate an end of a tension spring 138. The pin 212 can be a rod, axle, bolt, screw, or other suitable structure. In the illustrated embodiment, spring tension is communicated to the arm 200 via the pin 212. Further, a distance 214 between the modulating member pivot 180 and the spring mount pin 212 is fixed, and helps define the proportion of spring tension communicated through the arm 200 to the associated string 50.

A stop engagement portion 220 of the arm 200 extends rearwardly relative to the spring mount 210 and, preferably, below the bottom surface 146 of the tensioner body 142. A stop aperture is formed through the tensioner body 142. Preferably, a stop bolt 224 is threadingly advanced through the aperture. The stop bolt 224 is configured to engage the stop engagement portion 220 of the arm 200 to define a limit to rotation of the arm 200 in a counter-clockwise direction.

Continuing with reference to FIGS. 6-9, preferably, a plurality of marks 230A-B are provided on the force modulation member 140 for reference purposes. Additionally, preferably an indicator member 232 extends upwardly from the tensioner body 142 and is generally aligned with the pivot 180. The indicator member 232 preferably includes a tip 234. In use, the rotational position of the modulating member 140 relative to the tensioner body 142 can be gauged by the position of the reference marks 230A-B relative to the indicator member tip 234.

Preferably, an elongate guide member 236 depends from the first portion 152 adjacent to the first end 148 of the body 142. Preferably, the guide 236 terminates in a stop 238 attached thereto. In the illustrated embodiment, an elongate adjustment bolt 240 also depends from the depending portion 164 of the body 142 in a direction generally parallel to the elongate guide 236. In the illustrated embodiment, the guide 236 and bolt 240 extend in a direction generally downwardly and forwardly from the tensioner body 142. Preferably, the adjustment bolt 240 is threaded. An elongate shank 242 of the adjustment bolt 240 fits through an aperture 244 defined through the tensioner body 142, and a bolt head 246 is accessible through the top surface 144 of the body 142 so that the adjustment bolt 240 can be rotated through the use of a tool or the like. Since the adjustment bolt head 246 is disposed in the first portion 152, which is offset relative the second portion 156, the bolt head 246 is not aligned with the musical string 50 corresponding to the tensioner 135 (see, for example, FIG. 17). As such, a tool can access the bolt head 246 without interfering with the string 50.

Figure 8:
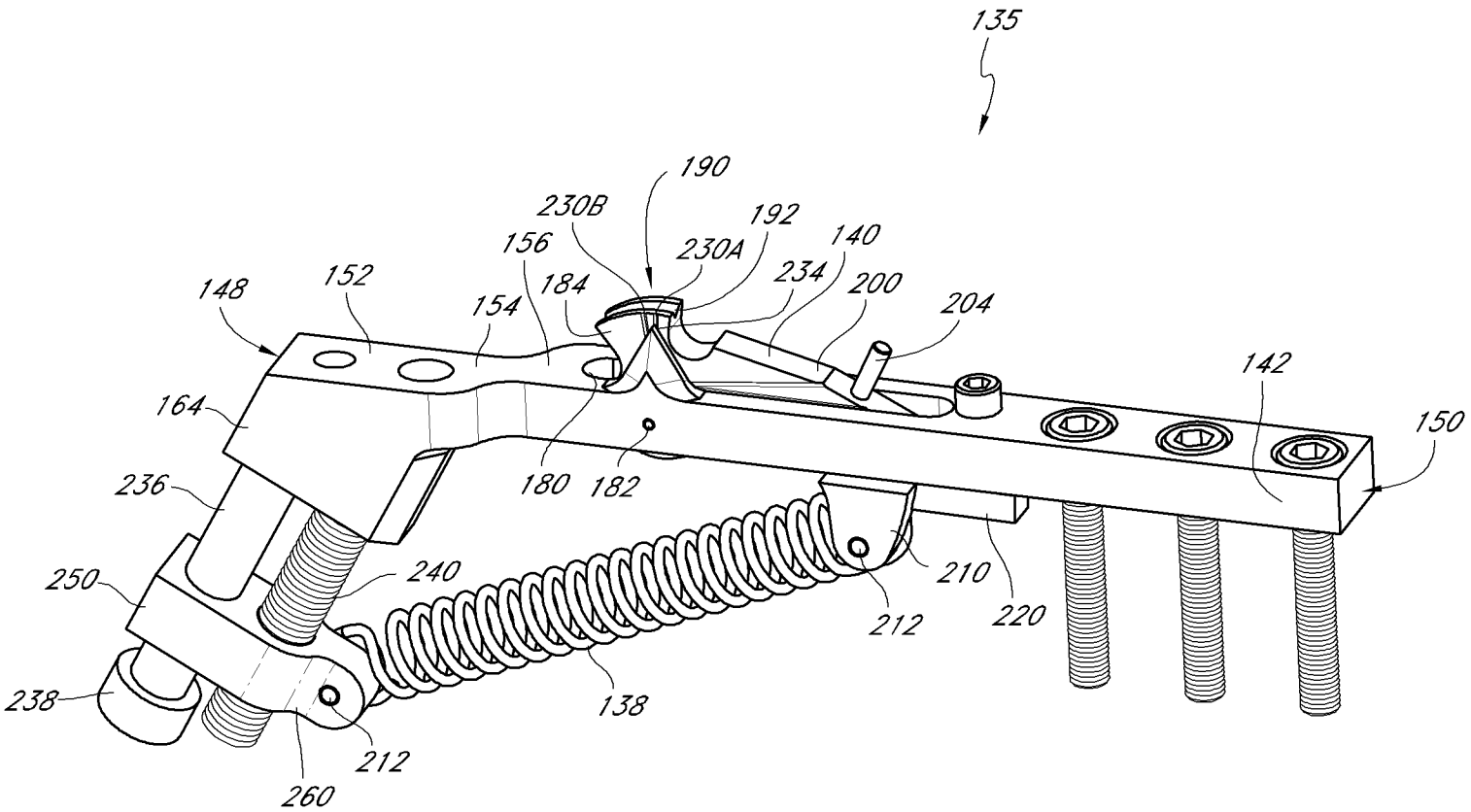
FIG. 8 is another perspective view of the string tensioner of FIG. 6.
Figure 9:
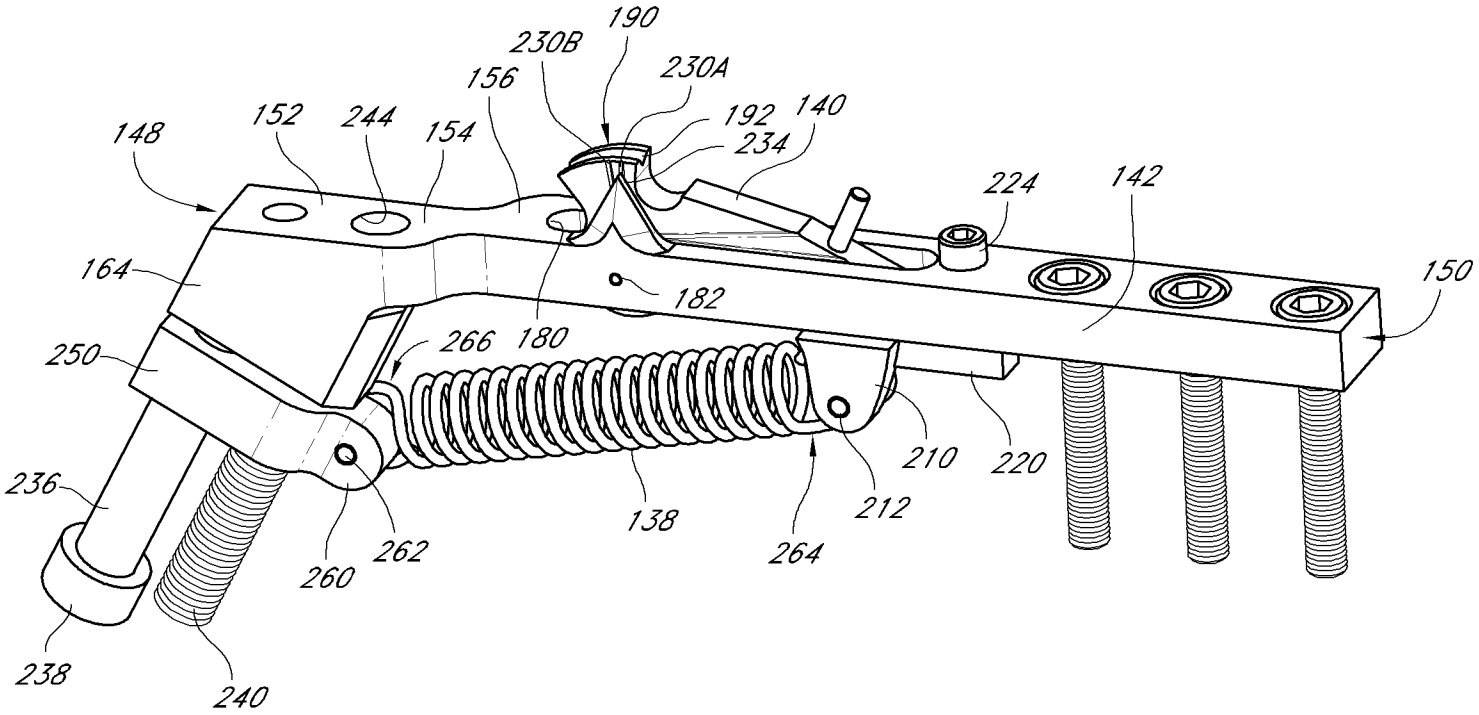
FIG. 9 is a perspective view of the string tensioner of FIG. 6 but showing a shuttle 250 of the string tensioner disposed in a different position.

A shuttle 250 is provided over the elongate guide 236 and adjustment bolt 240. The shuttle 250 preferably comprises a first aperture 252 adapted to fit slidably over the elongate guide 236 and a second, threaded aperture 254 adapted to mate with the threads of the adjustment bolt 240. As such, when the adjustment bolt head 246 is rotated, the shuttle 250 is advanced or retracted along the bolt 240 and guide 236. For instance, FIGS. 6-8 show the shuttle 250 in a first position along the adjustment bolt 240, and FIG. 9 shows the shuttle 250 in a second position along the adjustment bolt 240. Rotation of the bolt effectuates such changes in shuttle position.

With continued reference to FIGS. 6-9, the shuttle 250 preferably additionally comprises a spring mount 260 having pin 262 such as an axle, rod, bolt, screw, or other structure adapted to engage an end of the tension spring 138. The tension spring 138 preferably has first and second opposing ends 264, 266. The first end 264 of the spring 138 is attached to the spring mount 210 on the modulation member arm 200; the second end 266 of the spring 138 is attached to the spring mount 260 of the shuttle 250. As such, a longitudinal axis 270 of the tension spring 138 extends between the pins 212, 262 of the modulating member spring mount 210 and the shuttle spring mount 260. Spring force is directed along this axis 270.

Figure 10:
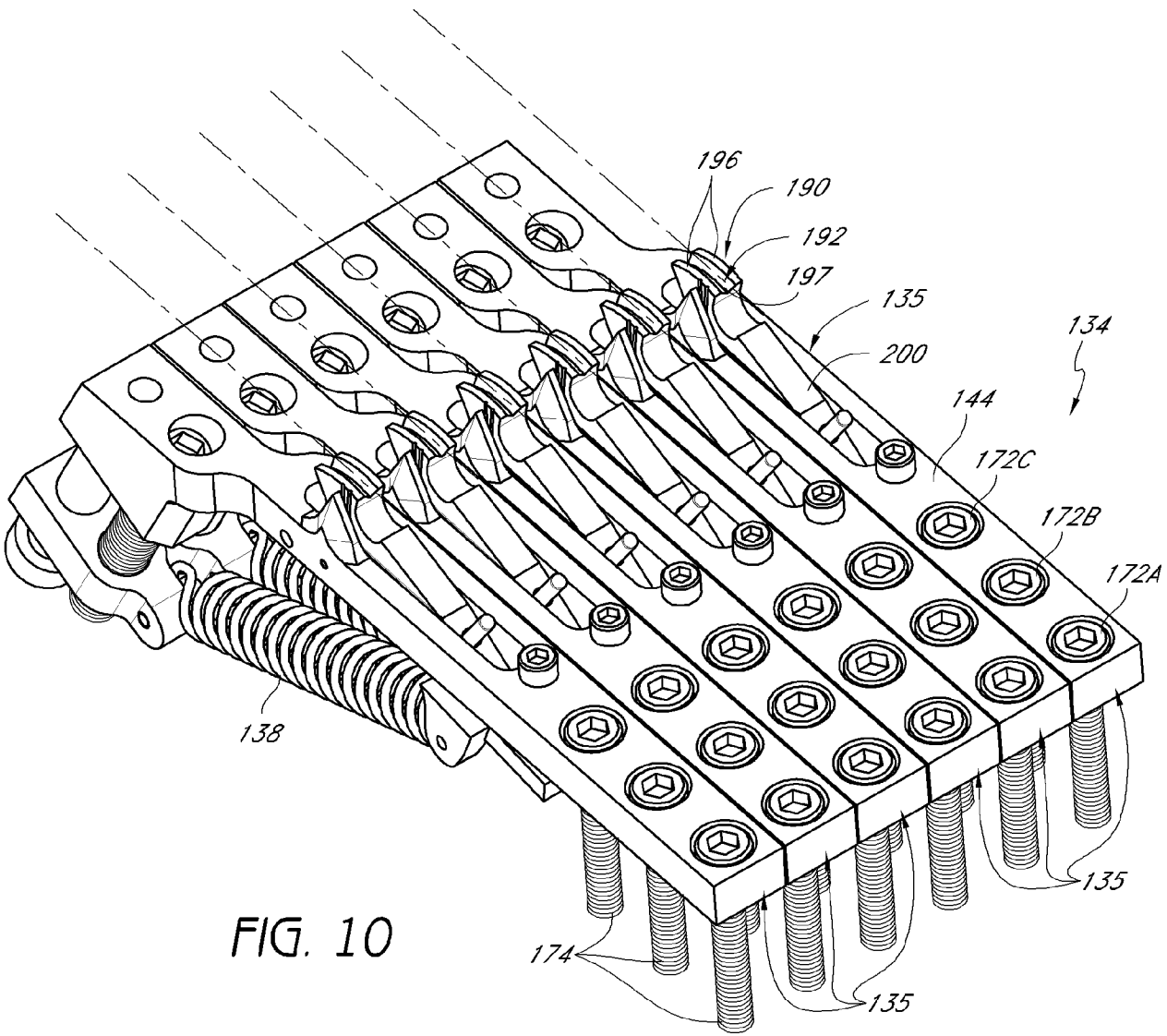
FIG. 10 is a perspective view showing a plurality of string tensioners arranged into the string mounting system of a guitar.
Figure 11:
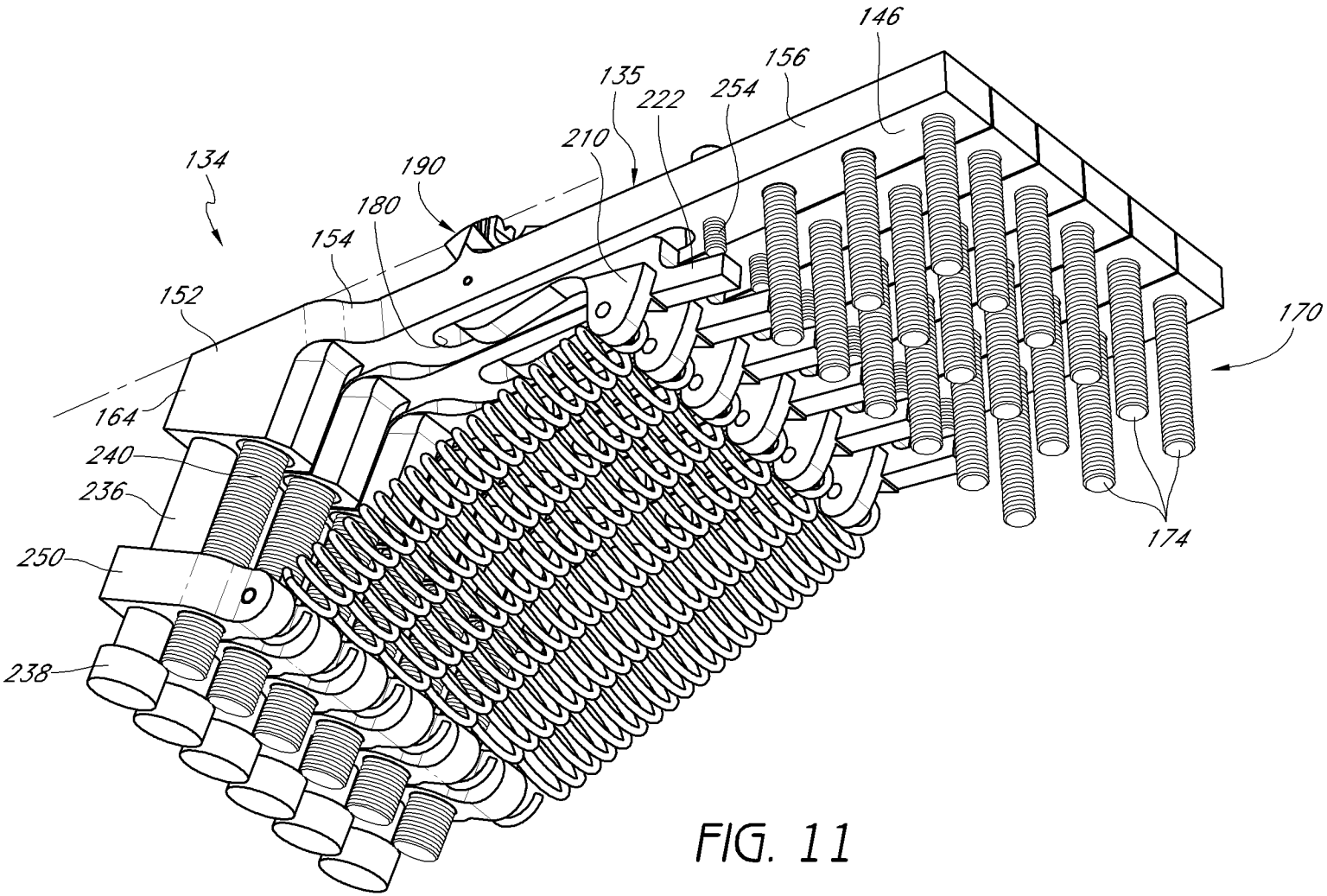
FIG. 11 is a rear perspective view of the string tensioners of FIG. 10.
Figure 12:
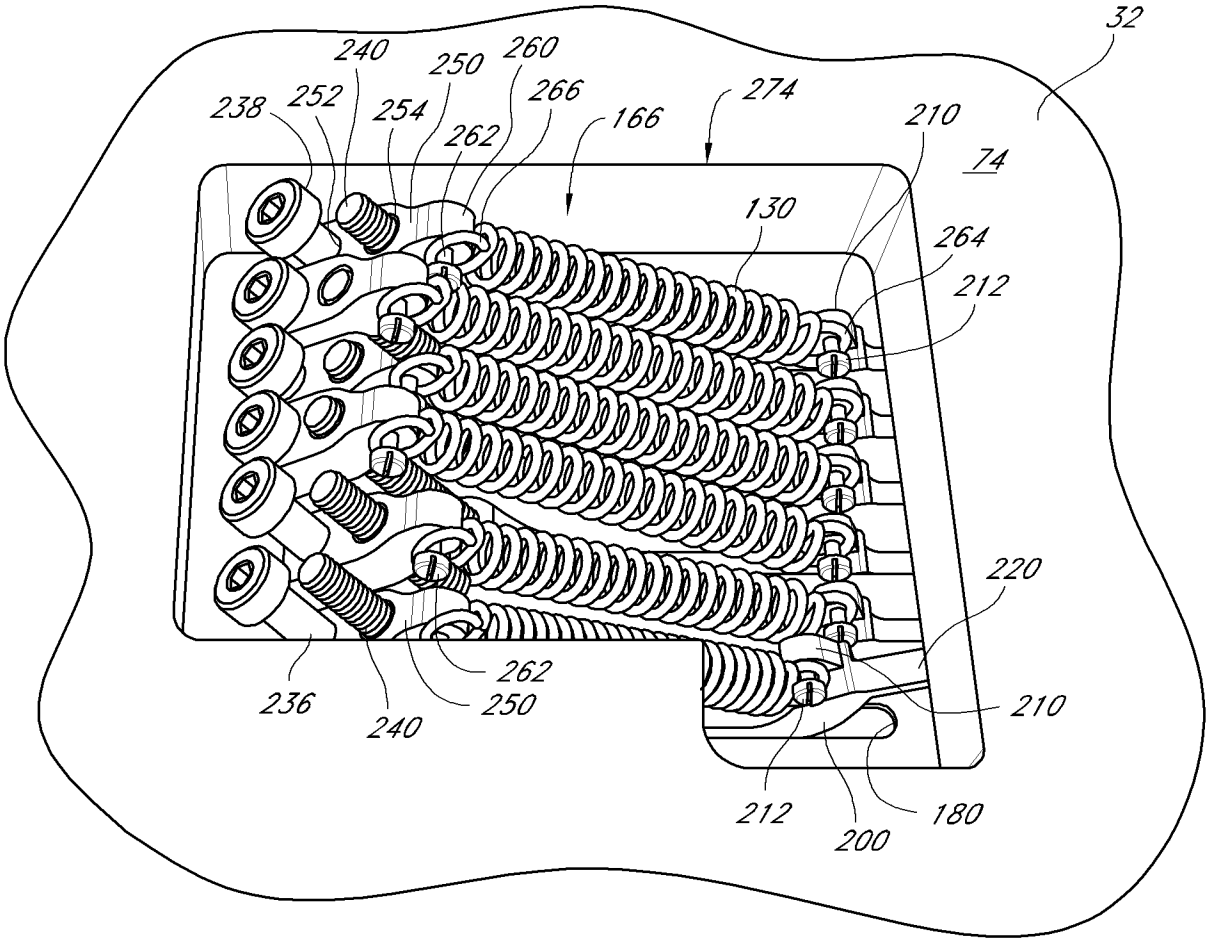
FIG. 12 is a perspective view of a back side of the guitar of FIG. 5 showing a portion of the string tensioner system disposed in a cavity formed in the guitar body.

With reference next to FIGS. 5-12, in a multi-string instrument, such as a guitar 130, preferably a plurality of string tensioners 135 are arranged side-by-side generally abutting one another, as depicted in FIGS. 5 and 10. In the illustrated embodiment, six string tensioners 135 are provided side-by-side to appropriately secure and provide tension to the six musical strings 50 of the guitar 130. As best shown in FIGS. 5 and 12, preferably the string tensioners 135 are attached to a front face 62 of the guitar body 32. Components of the tensioners 135 that depend below the bottom surface 146 of each tensioner body 142 extend into the cavity 166 formed in the body 32 of the guitar 130. The guitar body cavity 166 can extend through the entire guitar body 32, and thus provide an access 274 through the back, as suggested by FIG. 12. In another embodiment, an access door may be provided to selectively close the cavity 166 through the back 74 of the guitar body 32. In still another embodiment, the guitar body cavity does not extend clear through the guitar body.

Figure 13:
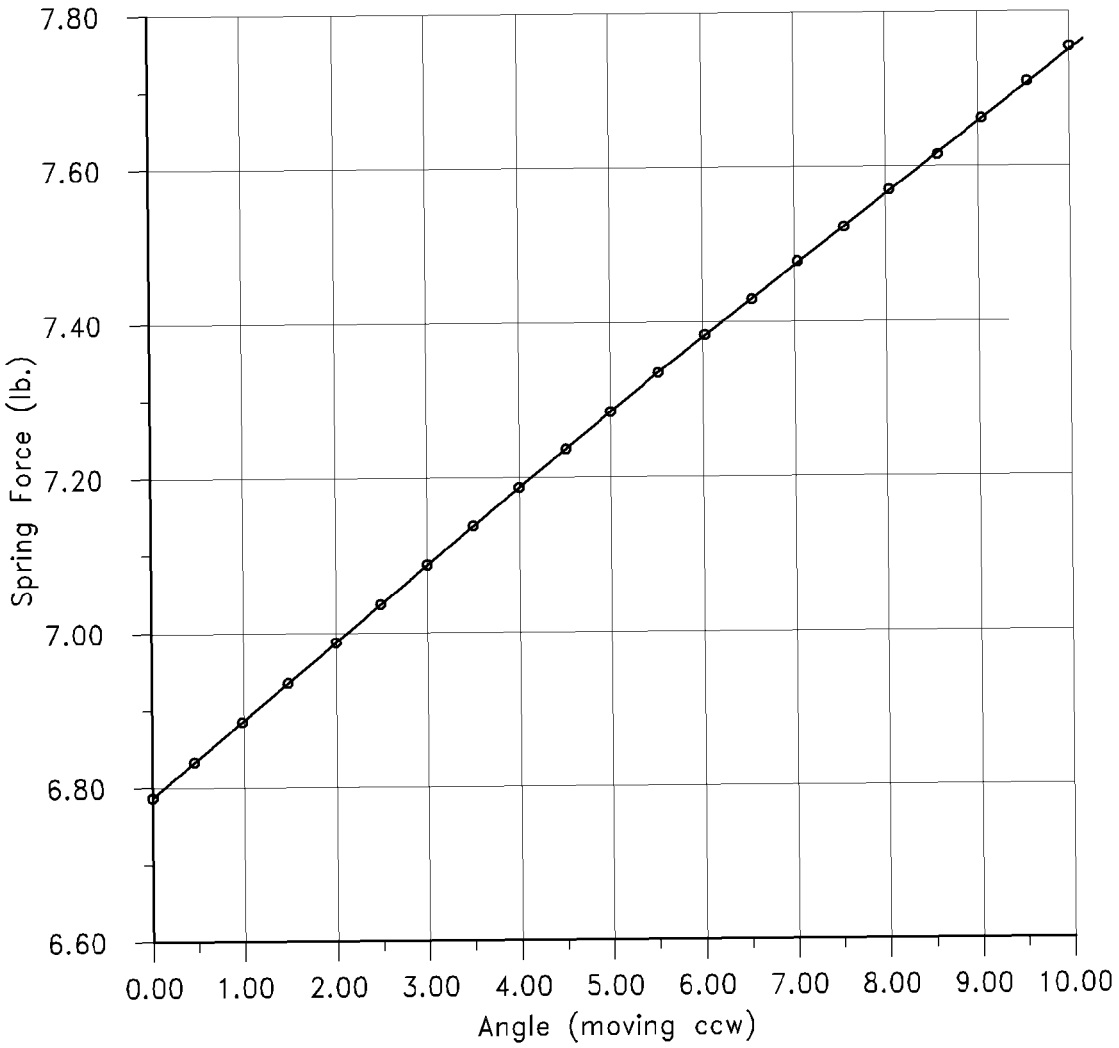
FIG. 13 is a graph depicting the change in spring force as the arm of the spring tensioner of FIG. 6 moves counter clockwise.

With specific reference next to FIG. 6, certain functions and properties of the individual string tensioners 135 are presented. As illustrated in FIG. 6, each spring 138 extends between spring mounts 210, 260 defined on the force modulating arm 200 and the shuttle 250, respectively. As is typical with coil springs, a length 278 of the spring 138 determines the degree to which the spring has elongated, which in turn determines the magnitude of force exerted by the spring. As shown, since the adjustment bolt 240 is angled relative to the spring's line of action, or longitudinal axis 270, movement of the shuttle 250 has the effect of increasing or decreasing the length 278 of the spring 138 for a given position of the modulating member arm 200. However, when the shuttle 250 is held fixed in a position, and thus the shuttle spring mount 260 is fixed, rotation of the force modulating member 140 about the pivot 182 correspondingly results in linear movement of the modulating arm spring mount 200, which linear movement increases or decreases the length 278 of the spring 138. Specifically, when the modulating member 140 is rotated counter-clockwise, the length 278 of the spring 138 increases, thus resulting in an increase of the force exerted by the spring. With additional reference to FIG. 13, a plot is presented of a sample embodiment having structure similar to the illustrated tensioners 135. In the illustrated embodiment, as the modulating member 140 is rotated counter-clockwise, the force exerted by the spring in response to spring elongation increases generally linearly over the illustrated limited range of rotation (here 10°).

With continued reference to FIG. 6, the spring 138 has a line of action generally along its longitudinal axis 270. The longitudinal axis 270 is spaced a lever arm distance 280 from the pivot point 182. The lever arm distance 280 determines the mechanical advantage (or, in some embodiments, mechanical disadvantage) the spring 138 has relative to its load, the string 50, which has a radius 198 spacing from the pivot point 182. When the shuttle 250 is held in a fixed position, rotation of the force modulating arm 200 results in a change in the lever arm distance 280.

Figure 6A:
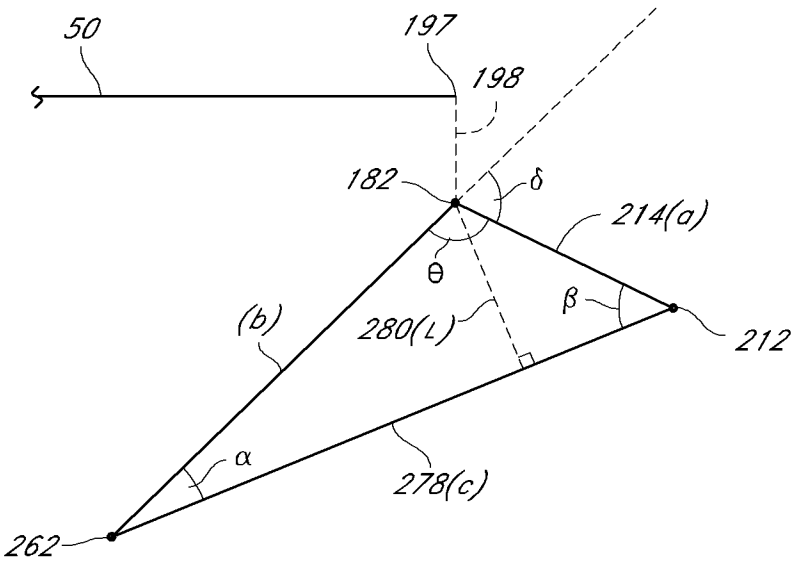
FIG. 6A is a diagram schematically representing certain relationships of the embodiment illustrated in FIG. 6.

With additional reference to FIG. 6A, a schematic diagram represents certain relationships of the embodiment illustrated in FIG. 6. For example, the pivot point 182, string saddle base 197, pin 212, and pin 262 are represented, as well as lines 198, 214, 278 and (b) representing the distances between these points.

Figure 14:
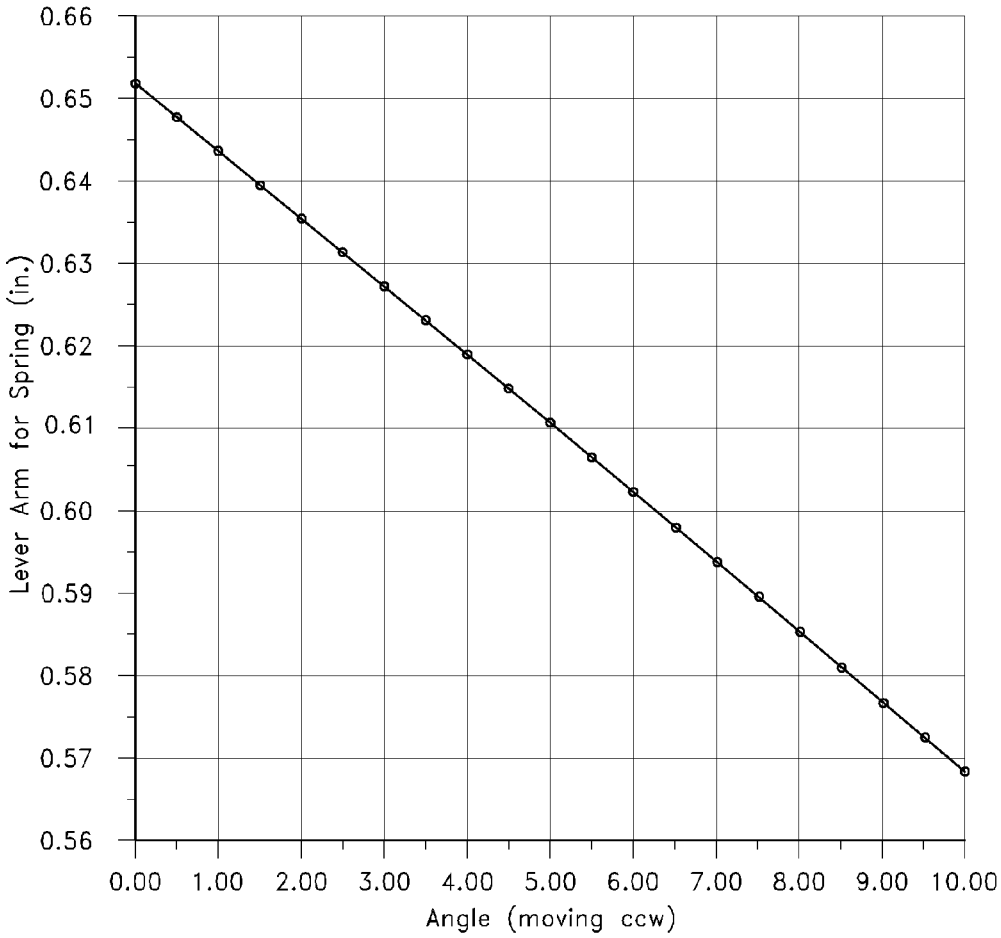
FIG. 14 is a graph depicting the change in effective lever arm of the spring as the arm of the spring tensioner of FIG. 6 moves counter clockwise.

With additional reference to FIG. 14, a plot is presented showing the change in lever arm distance 280 for the spring 138 as the modulating member 140 is rotated counter-clockwise through a limited range of modulating member rotation (here 10°). As shown, the lever arm 280 distance decreases generally linearly as the modulating member 140 is rotated counter-clockwise.

As just discussed, as the force modulating member 140 is rotated counter-clockwise, such as when the string 50 is being tightened on the guitar, the spring 138 elongates, and spring tension thus linearly increases. However, at the same time, the lever arm distance 280 upon which the spring 138 is acting linearly decreases. These effects act in opposition to one another, thus creating a special advantageous effect on string tension during such angle changes. For example, with additional reference to FIG. 15, a plot of string tension actually delivered to the string 50 from the spring 138 via the force modulating member 140 is illustrated. This plot shows the combined effect of the changing spring force and lever arm distance as the modulating member rotates.

Figure 15:
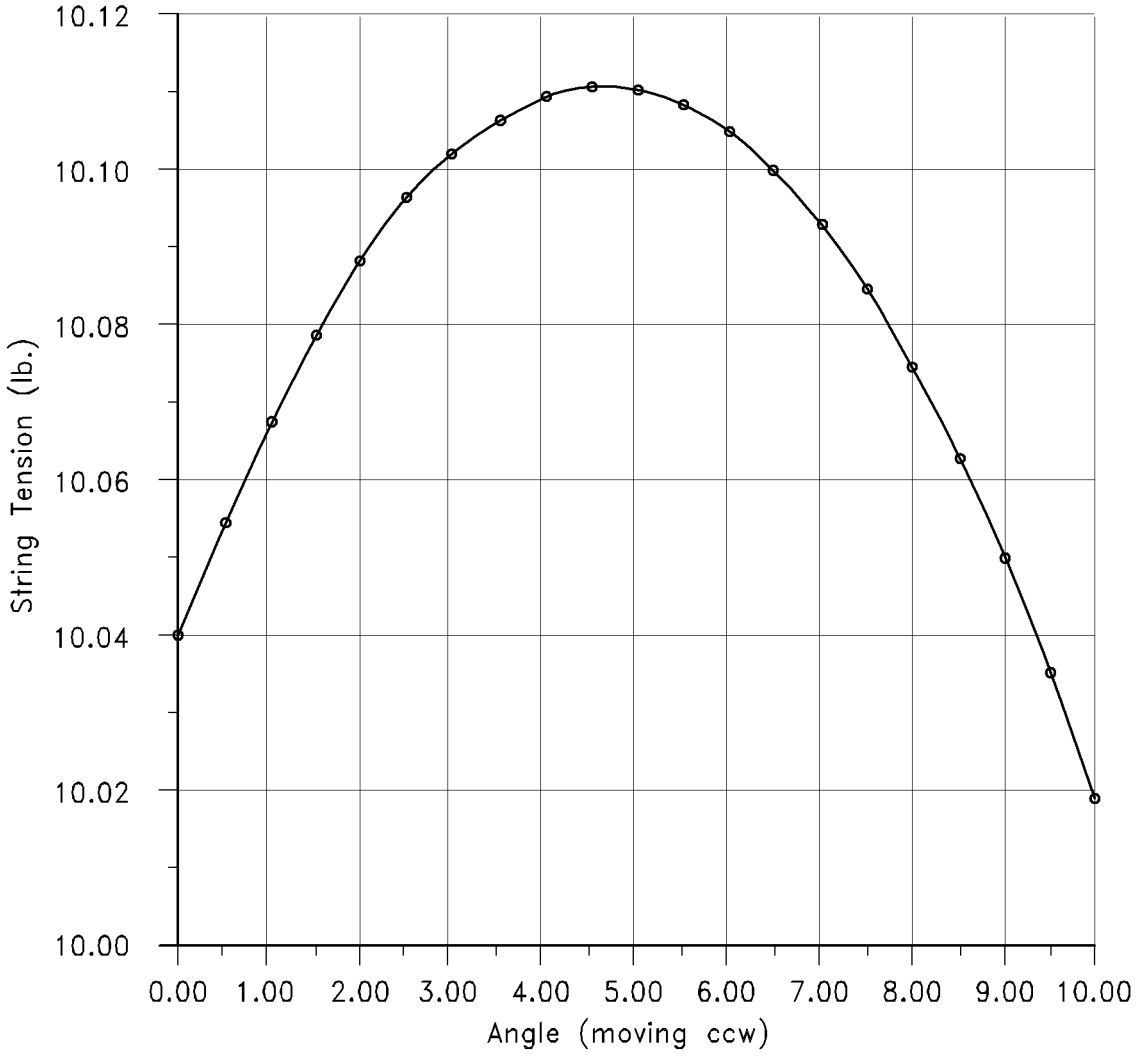
FIG. 15 is a graph depicting the change in effective string tension resulting from the effects shown in FIGS. 13 and 14 as the arm of the spring tensioner moves counter clockwise.

It should be appreciated that the scale of FIG. 15 is highly amplified, exaggerating the curvature. In fact, this is a relatively flat curve over the small anticipated angle of operation of the modulating member 140. For instance, for a preferred embodiment, the modulating member 140 operates in a range between about two degrees to seven degrees of angle. In the illustrated embodiment, over this five-degree range of rotation, the string tension changes within a range of only about 0.02 pounds. It should be appreciated that 0.02 pounds of tension corresponds roughly to one cent of pitch, which corresponds to such a small change in the pitch of the tone emitted by the corresponding string that the change of pitch is not detectable by the human ear. As such, even if during play or other use the string elongates up to about five degrees of rotation of the modulating member 140, the change in tune will not be aurally detectable.

For a stringed instrument such as a guitar, the most typical reason the instrument goes out of tune is that over time the strings stretch or otherwise relax, and thus the tone emitted by that string goes flat as the tension is lost. Stretching of the string and/or other factors such as friction at the guitar nut or bridge, and string interference when wound about the tuning pegs, or environmental factors such as humidity and heat, among other possible factors, can cause a string to elongate, and thus slacken.

In an instrument employing a mounting system 134 as discussed herein, as the string 50 elongates, the spring 138 maintains tension on the string 50, and thus counteracts slackening. More specifically, the force modulating member 140 rotates clockwise. Although such clockwise rotation may result in a decrease of the force exerted by the spring 138, the corresponding increase in lever arm 280 for spring operation assures that tension will remain at or near perfect-tune levels, as portrayed in the example plots of FIGS. 13-15. Since musical strings typically elongate only very short distances, a string tensioner 135 having a relatively small operating range, such as 10 degrees, 7 degrees, 5 degrees, or less, provides plenty of range for taking up the slack in the musical string as it elongates.

Notably, certain factors can cause the string to attempt to contract, and thus tighten. Such tightening may cause the string to go out of tune. The illustrated mounting system 134 also maintains an appropriate tension on the string 50 as the string contracts, thus counteracting tightening.

In a typical guitar, as a string elongates or attempts to contract, the string ends remain fixed, thus, a string that elongates becomes slack, and a string that attempts to contract tightens. In the illustrated embodiment, the second end 54 of the string is attached to the modulating member 140, which enables the second end 54 of the string to move. By allowing the second end 54 to move as the string elongates or contracts, but still applying an appropriate tension, the illustrated embodiment counteracts slackening and tightening.

Applicants have tested embodiments of structures for modulating spring forces. Such an analysis, though performed with an embodiment having features resembling that of FIG. 6, employs principles that can be used in embodiments having other structures. With reference again to FIG. 6A, distances and mathematical relationships of portions of the string tensioner 135 are represented schematically. This schematic representation will be used to discuss a specific example embodiment. For purposes of the discussion, the length 214 of the mount arm will be referred to as "a", the distance between the pivot point 198 and pin 262 will be referred to as "b", the length 278 of the spring will be referred to as "c", and the lever arm 280 of the spring will be referred to as "L". The angle between a and b will be referred to as θ; and the angle δ is a complementary angle to θ.

In one example:

a=0.95 in.;

b=1.45 in.;

$c_0$=spring free length=1.545 in.;

c=stretched length of spring (this parameter changes as the arm 200 rotates;

k=9.492 lb./in.; and spring pre-load=1.344 lb.

The tension T in the spring is calculated by: $T=k(c-c_o)+1.344$ lb. Also, per the law of cosines, $c^2=a^2+b^2-2ab\cos(\theta)$. Since $\theta=180-\delta$, $\cos(180-\delta)=-\cos(\delta)$. Thus: $c^2=a^2+b^2+2ab\cos(\delta)$, and $c=(a^2+b^2+2ab\cos(\delta))^{1/2}$.

Per properties of trigonometry, $L=b\sin(\alpha)$. Per the law of sines, $\sin(\alpha)/a=\sin(\theta)/c$, Thus, $\sin(\alpha)=(a/c)\sin(\theta)$. By trigonometric identities, $\sin(\theta)=\sin(180-\delta)=\sin(\delta)$. Thus, $\sin(\alpha)=(a/c)\sin(\delta)$. Solving for L: $L=(ab/c)\sin(\delta)$.

Using the mathematical relationships discussed above, Table A was prepared to show force characteristics of the sample embodiment relative to angle δ:

TABLE A

| δ (deg) | Spring Length c | c-c0 | Tension in Spring T | Lever length L | Torque (TL) at pivot 182 |
|---|---|---|---|---|---|
| 0 | 2.40000 | 0.855 | 9.45966 | 0.00000 | 0 |
| 2 | 2.39965 | 0.85465 | 9.456341 | 0.02003 | 0.18945 |
| 4 | 2.39860 | 0.85360 | 9.446385 | 0.04006 | 0.37843 |
| 6 | 2.39685 | 0.85185 | 9.429796 | 0.06007 | 0.56648 |
| 8 | 2.39441 | 0.84941 | 9.406579 | 0.08007 | 0.75315 |
| 10 | 2.39126 | 0.84626 | 9.376742 | 0.10003 | 0.93796 |
| 15 | 2.38036 | 0.83536 | 9.273261 | 0.14978 | 1.38892 |
| 20 | 2.36513 | 0.82013 | 9.128701 | 0.19920 | 1.81843 |
| 25 | 2.34561 | 0.80061 | 8.943374 | 0.24819 | 2.21965 |
| 30 | 2.32183 | 0.77683 | 8.717683 | 0.29664 | 2.58602 |
| 35 | 2.29385 | 0.74885 | 8.452119 | 0.34444 | 2.91127 |
| 40 | 2.26174 | 0.71674 | 8.147266 | 0.39149 | 3.18954 |
| 45 | 2.22555 | 0.68055 | 7.803797 | 0.43766 | 3.41542 |
| 50 | 2.18538 | 0.64038 | 7.422478 | 0.48286 | 3.58400 |
| 55 | 2.14131 | 0.59631 | 7.004167 | 0.52696 | 3.69091 |
| 60 | 2.09344 | 0.54844 | 6.549818 | 0.56985 | 3.73242 |
| 65 | 2.04189 | 0.49689 | 6.060482 | 0.61141 | 3.70546 |
| 70 | 1.98677 | 0.44177 | 5.537312 | 0.65152 | 3.60768 |
| 75 | 1.92822 | 0.38322 | 4.981566 | 0.69005 | 3.43751 |
| 80 | 1.86639 | 0.32139 | 4.394614 | 0.72684 | 3.19420 |
| 85 | 1.80142 | 0.25642 | 3.777948 | 0.76176 | 2.87791 |
| 90 | 1.73349 | 0.18849 | 3.133191 | 0.79464 | 2.48975 |

As shown in the data for the specific example presented above, the range of δ at which the torque applied by the spring to the pivot point 182 changes the slowest is between about 55-65°. Thus, preferably the above embodiment operates so that the string 50 is at a perfect-tune tension when the angle δ is between about 55-65°. Even more preferably, the embodiment is adapted to operate within a smaller range of angular change, such as less than about 5°. Further, this example shows that operating parameters, specifically the lengths a, b, and $c_0$, and any preloading of the spring, determine the range of degrees through which there is relatively small change in torque applied by the spring to the pivot point.

It is to be understood that a "sweet spot", or point at which the rate of change of the torque applied to the pivot point reaches zero, can be determined. Such a point can be calculated by finding the point at which T*L transitions from an increasing to a decreasing calculated value. Most preferably, the string mounting system is configured so that anticipated string elongation is confined to a range of arm rotation (less than 10° or, more preferably, less than 5°) about this sweet spot in order to minimize the magnitude of the change in tension applied by the spring to the string upon elongation of the string. Such an operational range can be defined simply as an expected range of angular operation or can be mechanically determined by the device itself. For example, in the string tensioner 135 of FIG. 6, the stop engagement portion 220 engages the stop bolt 224 to prevent counterclockwise rotation beyond a particular angular position. In another embodiment, a forward stop engagement portion (not shown) extends from the modulating member and is adapted to engage the tensioner body 142 at a location forwardly of the elongate aperture 180 so as to prevent clockwise rotation beyond a desired angular position.

Additionally, it is to be understood that a diagram such as is depicted in FIG. 6A can be generated for many types and designs of lever-arm-type structures that may look different than the illustrated embodiment. For example, in the illustrated embodiment, pin 262 is the point of action of the spring that pulls on the end 212 of the mount arm 200, and, the spring is mounted between pins 212 and 262. In other embodiments, the spring is not necessarily directly attached to pins 262 and/or 212, but acts on the arm mount 212 through the point labeled 262 via cables, pulleys, other members, special geometry, and the like.

The above example illustrates a design having a preferred operating range based on optimizing factors related to the distances a, b from mounts to the pivot point. It is to be understood that, in another embodiment, the radius 198 can also be varied over the preferred operating range so as to vary the effective moment of the cam portion 184 of the modulation member 140, thus counteracting the small changes in torque at the pivot 182. For example, in one embodiment that may be used in conjunction with properties such as disclosed above in connection with Table A, the radius 198 is lesser when $\delta$ is 60° than when $\delta$ is 55° or 65°. As such, the changing radius 198 compensates for the slightly increased torque (T*L) at 60° so that the tension applied to the musical string 50 is even closer to a constant magnitude.

In still another embodiment, instead of or in addition to a lever-arm-type spring structure as described above, the cam 184 may be replaced by a spiral-tracked conical cam structure, similar to a fusee, that can compensate for a changing applied force by providing a corresponding change in effective moment arm for applying the force to the musical string.

Applicants have had marked success in employing the structure just described above in connection with FIGS. 5-15. Specifically, the mechanical structure 140 interposed between the spring and the string modulates the relationship between the force exerted by the spring and the tension actually applied to the string so that they are not linearly related. Further, the mechanical structure provides a relatively simple and easily constructed structure that will fit within the compact confines of a typical musical instrument such as an electric or acoustic guitar. However, it is to be understood that Applicants contemplate that other types or forms of mechanical structures interposed between a spring and a corresponding musical string can also modulate the effect of forces exerted by the spring on the corresponding string. More specifically, Applicants contemplate that other mechanical interface structures can effectively flatten a string tension curve relative to its corresponding spring's tension curve by using various mechanical structures, such as cams, lever arms, pulleys, gears, or the like in various configurations.

In order to tune an embodiment as depicted in FIG. 6, preferably the shuttle 250 of the string tensioner 135 is first positioned at an ideal position for the tension of the corresponding musical string 50. As such, when the string 50 is connected to the force modulating member arm 200, strung over the string receiver 190 and into the tuning knobs 48 of a guitar, and then tightened, it will achieve ideal tune when at a position very similar to that depicted in FIG. 6, which shows the tensioner reference tip 234 aligned with a preferred tune reference mark 230A on the string cam 184 of the modulating member 140. However, in order to fine tune the positioning of the shuttle 250 for a particular string tension, the user may use an iterative process in which the shuttle 250 is moved and tuning knobs 48 are correspondingly moved so that perfect tune is achieved at a point when the tensioner body indicator tip 234 is aligned with the preferred reference line 230A of the cam portion 184. Although the shuttle 250 position is adjustable, it preferably remains in a fixed position during play and after initial tuning.

Another preferred method of tuning can be performed without first adjusting the shuttle 250. In this embodiment, the string is first tuned in a manner as with a conventional guitar. During this process, the forward or rear stop engagement portion 220 usually engages, preventing rotation of the modulating member 140 and removing the spring from consideration in string tuning. Once the string is appropriately tuned, the shuttle is adjusted until the stop engagement portions are no longer engaged.

As such, a visual indicator of perfect tune is provided. As discussed above, during play, as the string 50 elongates and the string tensioner 135 compensates for such elongation without substantially changing the actual string tension, the fact that string elongation has occurred will be visually and mechanically reflected since the tip 234 will no longer be aligned with the preferred line 230A, thus indicating a change in angular position of the modulating member 140. Thus, a musician will be able to tell when the string 50 has stretched by observing the visual indicator, even though the string pitch or tune likely will not have changed to a magnitude that is audibly detectable by the human ear. By periodically checking his instrument, the musician can detect when a string 50 has moved from the perfect tune position, and will be able to use the tuning knobs 48 to incrementally tighten the string 50 to return the string 50 to the perfect tune position indicated by the aligned tip 234 and reference line 230A.

One popular guitar playing method is for the guitarist to "bend" notes during play. This is accomplished when the musician pushes a string 50 against the fretboard 42, and then further deflects the string relatively radically, thus changing the tension of the string 50 and correspondingly changing the note emitted by the string. In a preferred embodiment, after the instrument has been tuned, the user tightens the stop bolt 224 to a point where an end of the stop bolt 224 is near but either slightly spaced from or barely engaging the corresponding stop engagement arm 220. As such, when a guitarist bends notes by radically deflecting the strings 50, rather than rotating the modulating member 140 counter-clockwise, and thus cancelling or muting the bend effect, the engagement arm 220 will engage the stop bolt 224, preventing such counter-clockwise rotation. Thus, the spring 138 is removed from consideration and prevented from softening the bend effect, and a guitarist can obtain a substantial note bending effect through normal play.

In yet another embodiment, an arrangement may be provided to aid in setting the position of the stop bolt 224. In this embodiment, the stop bolt is electrically energized. An electrical contact is disposed on the stop engagement arm 220 and aligned with the bolt so that when the bolt touches the contact an electrical circuit is completed. Completion of the electrical circuit generates a signal. Such a system may be especially helpful when setting the position of the stop bolt. For example, an electric guitar may have a bend stop setting in which detection of the signal indicating completion of the electric circuit results in some effect, such as cutting off the signal to the amplifier, actuation of a lighting or aural effect, or the like so that the user will know that the arm 220 and bolt 224 are engaged. The user then backs the bolt 224 just until the signal stops, indicating that the arm 220 and bolt 224 are not engaged, but are positioned very close to one another. In this position, engagement of the arm 220 and bolt 224 is nearly instantaneous when the guitarist deflects strings to get the bending effect. After setting the arm 220 and bolt 224 position, the guitar setting preferably is changed so that, during play, the signal does not interfere with play.

In another embodiment, the arm 220 and bolt 224 may be intentionally set relatively far from each other so that the bend effect is, generally, avoided. Such a setting may be particularly preferred by beginner guitarists who, due to inaccurate finger positioning, may unintentionally bend notes, resulting in a too-sharp emitted note.

In still another embodiment, an electrical circuit that is selectively completed when the bolt 224 and arm 220 are engaged may be employed to intentionally trigger certain effects during a performance. For example, in one embodiment, completion of the circuit may trigger an aural effect, such as automatically triggering the distortion effect of the electric guitar and/or amplifier. In another embodiment, lights such as LEDs may be attached to the guitar, and completion of the circuit may trigger a visual effect such as temporarily turning on some or all of the LEDs.

In still another embodiment, the guitar may be electronically connected, via wire or wireless connection, to a computer system, and completion of the circuit may be detected by the computer system, which may control other effects. For example, in a stage show, certain lighting, pyrotechnic, or other effects may be computer-controlled. Upon detection of a signal from the guitar indicating string bending, the computer system thus can generate a lighting or other effect to enhance the aural effect already being generated by the guitar.

In yet another embodiment, a contact on the arm 220 includes a pressure sensitive transducer so that the signal generated upon completion of the circuit can also include an indication of the intensity of the bending effect. Each of the above-discussed embodiments may accordingly be enhanced and modified depending on the sensed intensity of the bending effect.

It is to be understood that various electrical circuit configurations may be employed to both electrically indicate engagement of the bending effect and the intensity of the effect. It is also to be understood that the guitar, amplifier, or other equipment preferably is set up to allow a user to change the setting between a setup configuration, no-effect configuration, and/or special-effect configuration, or other desired configurations.

Figure 16:
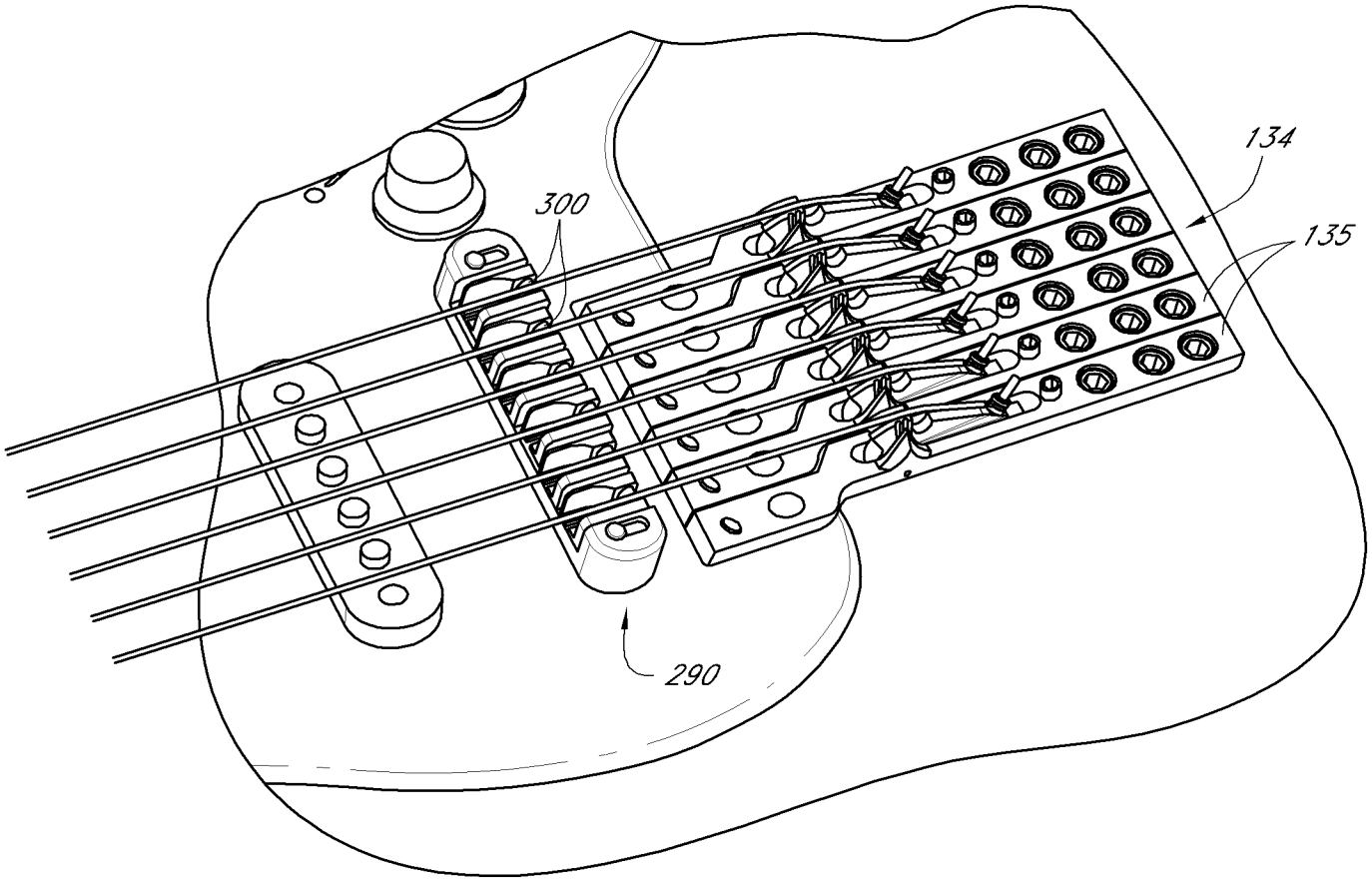
FIG. 16 is a perspective view of another embodiment of a guitar employing an embodiment of a string tensioning system having aspects of the present invention.
Figure 17:
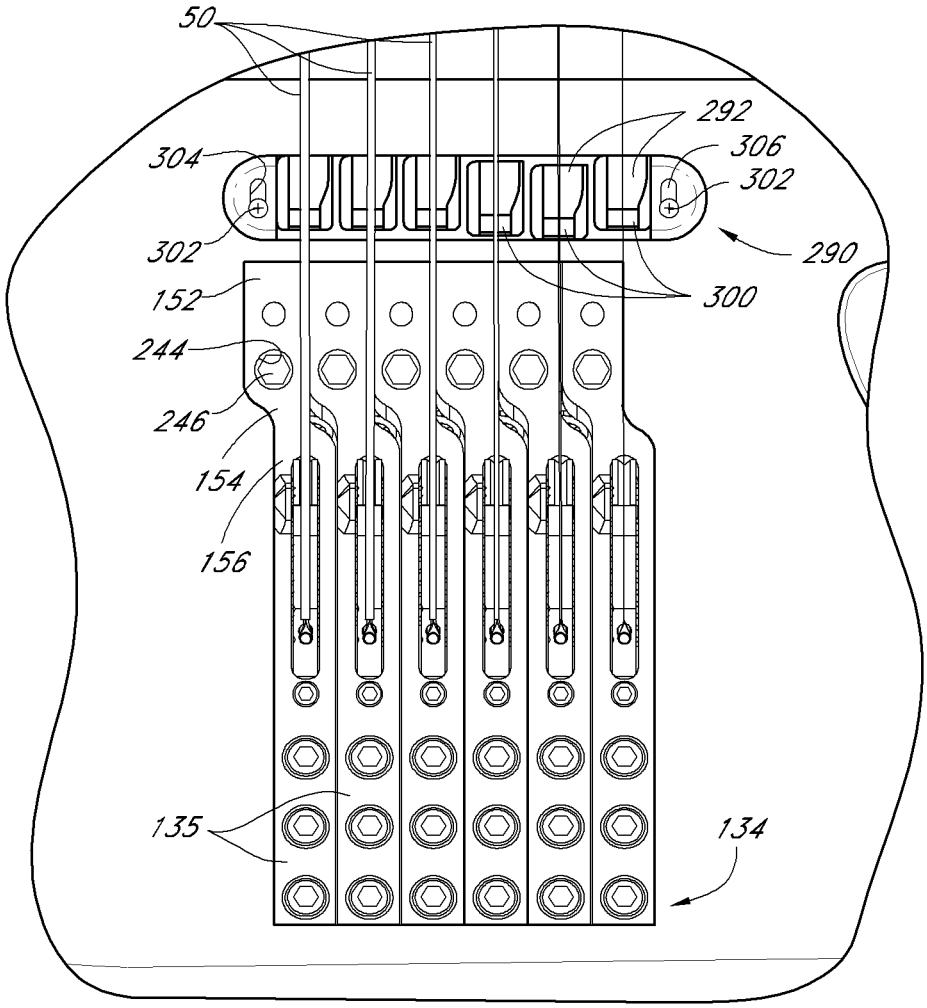
FIG. 17 is a top view of the guitar of FIG. 16.

In the embodiment depicted in FIGS. 5-12, the guitar 130 is provided without a separately formed bridge. In this embodiment, the string receiver 190, specifically the saddle 192, functions as a bridge. With reference next to FIGS. 16 and 17, a separate bridge 290 may be interposed between the string tensioners 135 and a playing portion 63 of the tightened strings 50. In the illustrated embodiment, the bridge 290 comprises a plurality of bridge members 292, each having a roller 300 adapted to function as a bridge for a corresponding string. In one embodiment, each bridge member 292 and corresponding roller 300 is adjustable over a short range so that the position of the roller 300 relative to the string 50 and other rollers can be adjusted if desired. Additionally, the illustrated bridge 290 is attached to the guitar body 32 by fasteners 302 that extend through first and second apertures 304, 306. The first and second apertures 304, 306 are elongate so that, upon loosening of the fasteners 302, the entire bridge 290 may be moved longitudinally and then retightened in a desired position. It is to be understood that guitar bridges having various structures, including non-adjustable structures that use structures other than rolling bridge members, may also be used in accordance with preferred embodiments.

Figure 18:
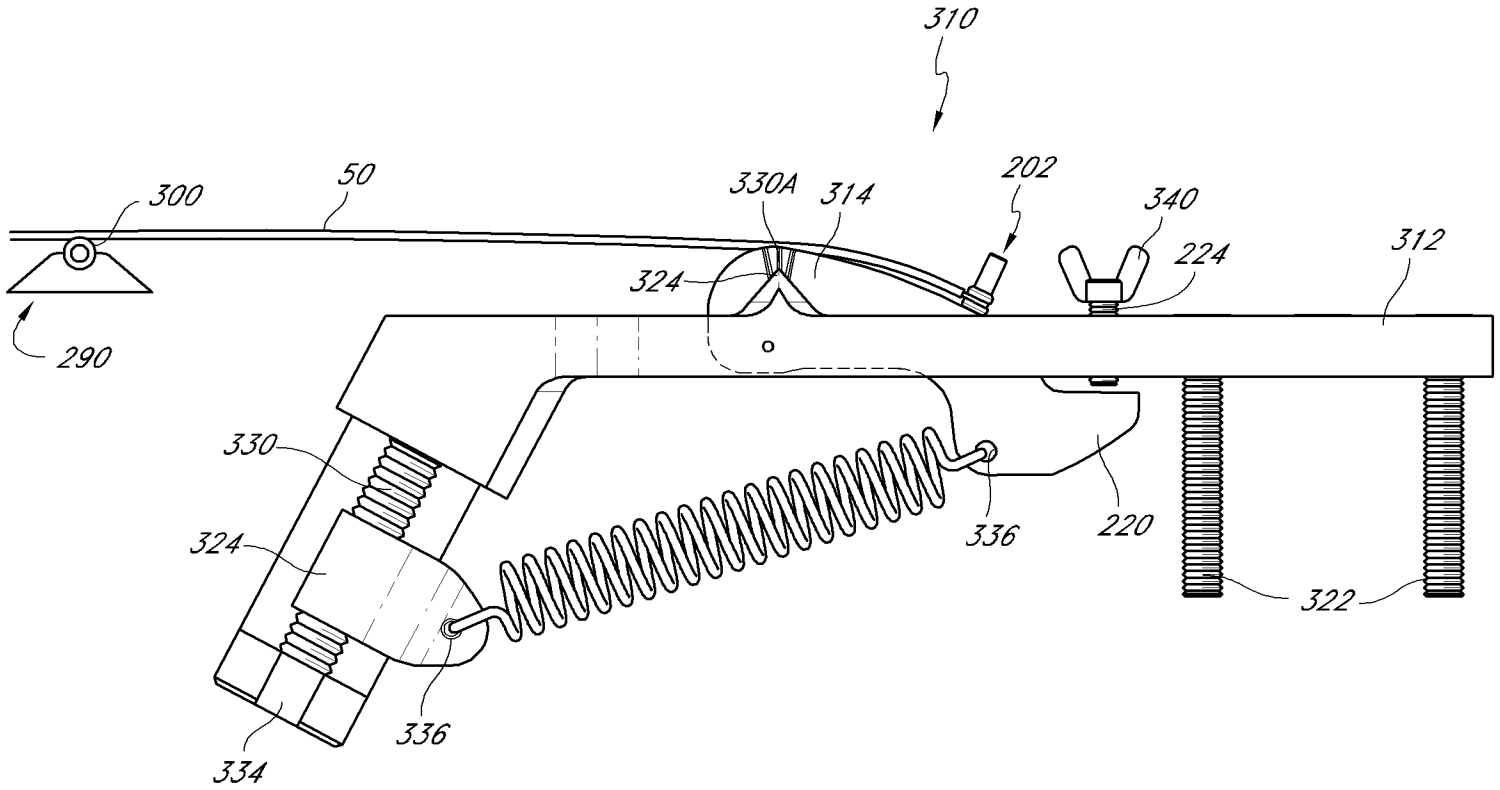
FIG. 18 is a side view of yet another embodiment of a string tensioner having aspects in accordance with the present invention.
Figure 19:
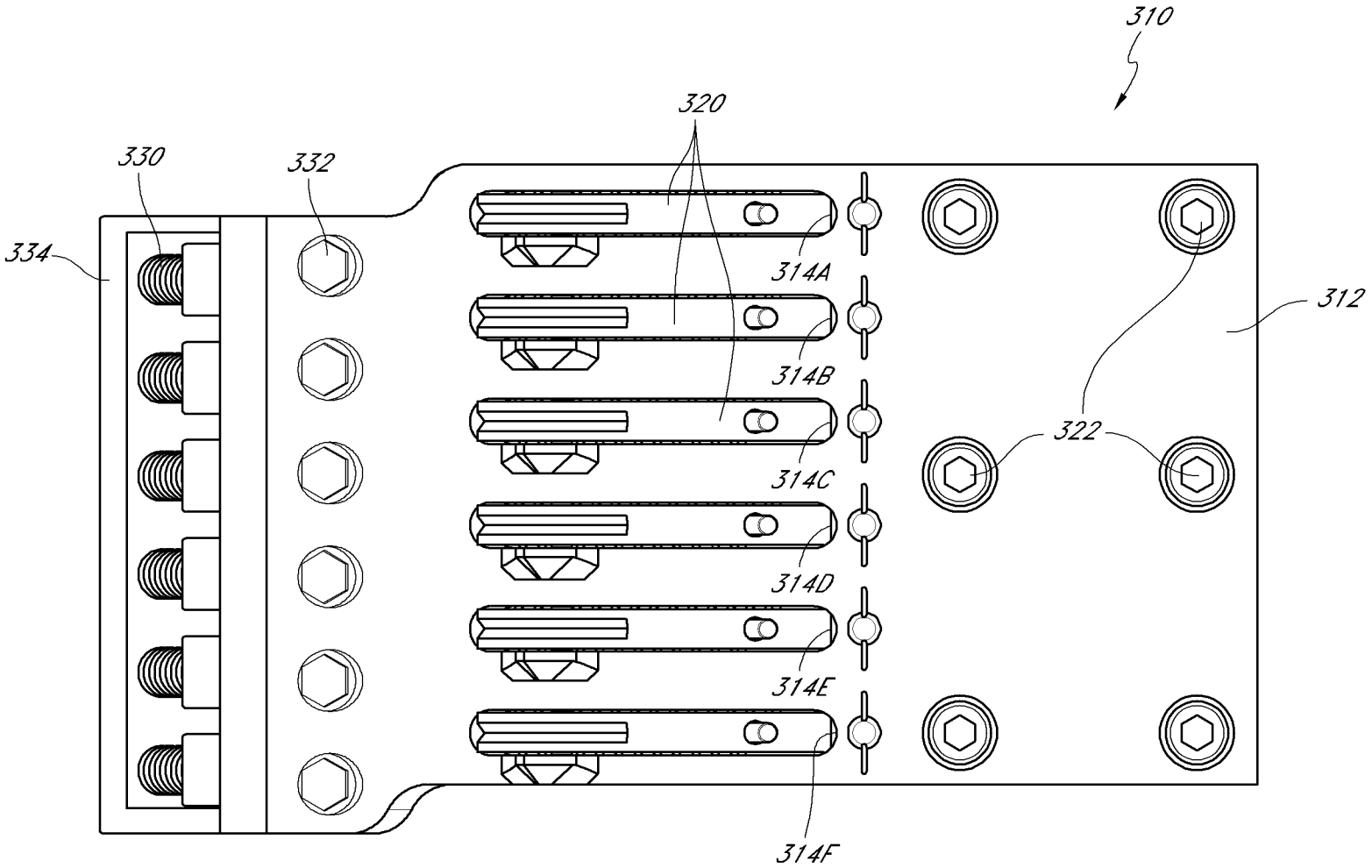
FIG. 19 is a top view of another embodiment of a string mounting system employing tensioners as in FIG. 18.

With reference next to FIGS. 18 and 19, another embodiment of a string tensioner 310 is provided. This embodiment is also adapted for use with a guitar. In this embodiment, the string tensioner 310 comprises a single frame 312 adapted to be used to tighten six adjacent musical strings. The single frame 312 employs six elongate apertures 314. A force modulating member 320 is pivotally mounted in each elongate aperture 314. Mounting fasteners 322 are provided to attach the frame 312 to a guitar body.

The illustrated string tensioner 310 operates on principles similar to those employed in the embodiment discussed above, but may have different structure. For instance, the illustrated embodiment includes a shuttle 324 riding over an adjustment bolt 330 and not having a separate guide member. Preferably, the adjustment bolt 330 is rotatably secured adjacent the bolt head 322 and adjacent a distal end 334 of the bolt 330. The shuttle 324 moves linearly as the bolt 330 is rotated. Additionally, rather than employing a pin for mounting of the spring ends, the shuttle 324 and the force modulating member arm 320, both comprise an aperture 336 through which ends of a coiled tension spring 138 can be inserted.

Further, embodiments described above showed the stop bolt 224 as having a hex bolt construction requiring a tool for adjustment. In the illustrated embodiment, the stop bolt comprises a winged head 340 that can be easily hand-adjusted without using of tools. This or other constructions can be used for other structures. For example, in another embodiment the adjustment bolt 330 may be adapted to be adjustable without the use of separate tools and/or may be accessible for adjustment through the back of the guitar. In still another embodiment, the guitar may be modified to have a tool receiver portion or cavity sized and adapted to store an adjustment tool for adjusting the adjustment bolt and/or other components so that the tool is always with the instrument.

In accordance with yet another embodiment, a roller bridge 340 may be provided having a roller structure 342 dedicated to each string 50. Preferably, the roller structures 342 are adapted to generate very little friction during use. As such, an embodiment is contemplated in which each roller structure 342 comprises a roller 344 adapted to rotate about an axle 346 that is rotatably mounted in an axle support member 348. In one embodiment illustrated in FIG. 18, the axle 346 has a small diameter, such as about 0.030 in., and the roller 344 has a relatively large diameter, such as about ¾ in. As such, a ratio of the roller diameter to the axle diameter is about 25. An embodiment having such a ratio can be expected to have relatively small friction losses during relatively small rotations such as when checking and modifying tune of a musical instrument employing string tensioners 135, 310 as discussed herein. Preferably, a low-friction roller bridge is provided having a roller diameter to axle diameter ratio greater than about 10; more preferably greater than about 15; and still more preferably greater than about 20.

In the embodiment illustrated above in connection with FIGS. 5-12, the line of action 270 of the spring 138 operates about a lever arm distance 280 that is greater than a lever arm distance 198 of the string cam member 184. As such, the spring 138 has a mechanical advantage, and thus is capable of exerting a tension on the string 50 that is greater than the force generated by the spring 138. This structure enables a smaller, lighter and less expensive spring to be employed than if there were an end-to-end connection between the string and the spring. This also facilitates a structure in which the line of action 270 of the spring 138 is in a direction generally transverse to the corresponding string 50. It is to be understood that several different structural designs may employ the inventive principles taught by this embodiment, but may look quite different than the illustrated embodiment.

In still another embodiment, a single spring can apply tension to two or more strings simultaneously. In embodiments in which the corresponding musical strings are designed to operate at different string tensions, a different lever arm distance preferably is provided in the corresponding force modulating member 140 so that the same spring can apply differing actual tensions to the corresponding strings. Preferably, the rate of change in operating lever arm of the spring as the modulating member rotates is identical for both strings so that the magnitude of force actually applied to the strings changes uniformly for each of the attached strings.

The illustrated embodiments have employed coil-type springs to apply tension to the strings. It is to be understood, however, that various other types and configurations of springs may be employed. Further, the term "spring" should be understood to be a broad term including embodiments as discussed above, and, generally, structures that can store and mechanically impart energy, or force, upon a string directly or through a mechanical interface, and may include a single spring member or a plurality of members that work together in some way.

For example, gas springs can be employed to provide appropriate tension while maintaining compact size. Several gas spring options are available, and such gas springs can be obtained from McMaster-Carr and other manufacturers. Another capable example is a flexible bar or the like that may function as a spring. Such a bar could even have a unique geometry resulting in specially-tailored spring action directions that inherently create a moment arm relative to a connection point, thus including spring and force modulation in a single member.

Figure 20:
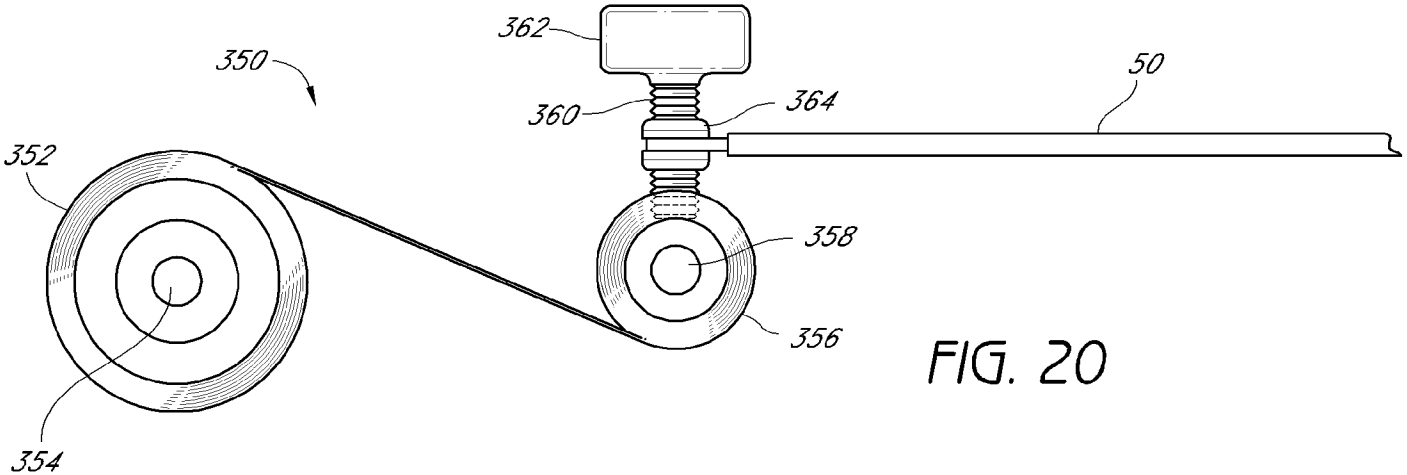
FIG. 20 is a schematic view of another embodiment of a string mounting system having aspects in accordance with the present invention.

With reference next to FIG. 20, another embodiment is provided in which a constant torque spring, such as the NEG'ATOR Constant Torque Spring Motor, which is available from Stock Drive Products/Sterling Instrument, can be mechanically connected to a musical string and configured to apply a substantially constant tension to the string. In the illustrated embodiment, the constant torque spring motor 350 comprises a first coil 352 mounted to the musical instrument at a first mount 354, and a second coil 356 that is mounted to a rotatable bar 358. A threaded lever arm 360 extends from the bar 358 and has a knob 362 adapted so that the arm 360 can be rotated. A shuttle 364 is disposed over the threaded arm 360, and a musical string 50 is attached to the shuttle 364. As such, the constant force spring 350 applies a substantially constant torque to the bar 358, which in turn exerts a constant tension on the string 50 by way of the lever arm 360. Since the lever 360 is adjustable, a user may vary the effective moment arm of this arrangement, and thus custom-tune the tension actually applied to the string by the constant force spring motor 350.

Figure 21:
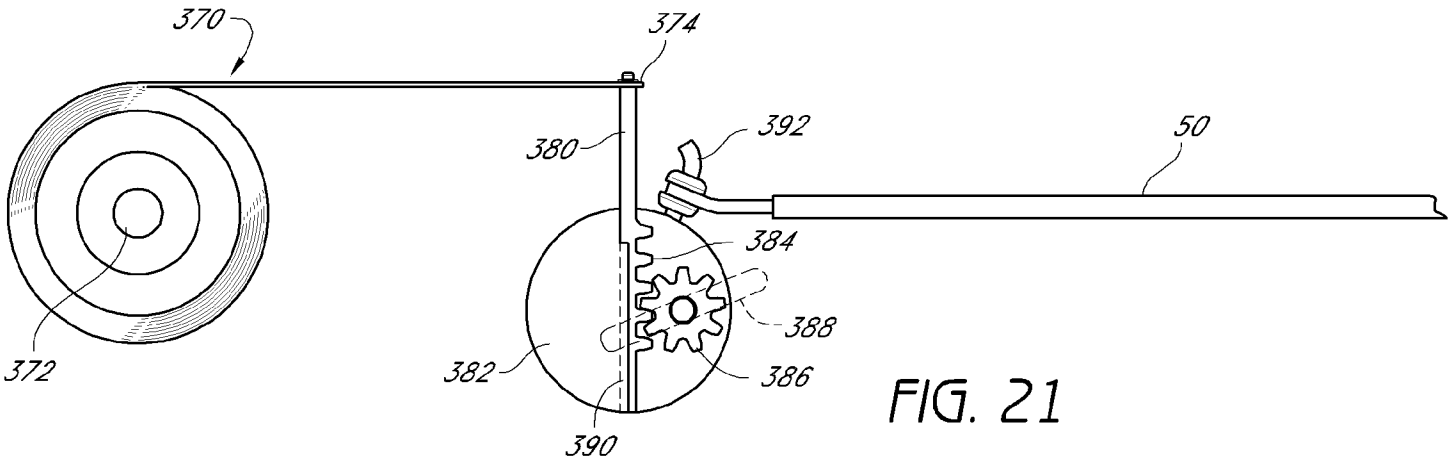
FIG. 21 is a schematic view of yet another embodiment of a string mounting system having aspects in accordance with the present invention.

With next reference to FIG. 21, a constant force spring 370, such as is available from Vulcan Spring & Mfg. Co. of Telford, Pa., comprises a single roll of pre-stressed spring steel having a mount 372 attached to the body of the musical instrument. An attachment end 374 of the spring is attached to a lever arm 380, which is slidably mounted onto a rotatable bar 382. In the illustrated embodiment, a portion of the lever arm 380 has a plurality of gear teeth 384. A rotatable gear 386 is mounted onto the bar 382, and is actuable by a user via a knob 388. When the knob 388 is twisted, the gear teeth engage, sliding the arm 380 and changing the effective moment arm length of the lever 380. In the illustrated embodiment, a track portion 390 of the bar 382 contains the lever arm 380 in place.

With continued reference to FIG. 21, a second lever 392 is also provided on the bar 382, and the musical string 50 is attached to the second lever 392. As such, the constant force spring 370 applies a substantially constant force which has a mechanical advantage or, in other embodiments, disadvantage relative to the string 50. Also, by adjusting the effective moment arm length of the lever 380, the user can fine tune the tension that is applied to the string 50 in order to attain and maintain a desired tune.

Due to the rolled structure of the constant force spring 370, the applied force of the spring varies very little from its rated level, such as less than about 1% over 20%, 40%, 60%, 80% or more of its length of operation. As such, a constant force spring can provide a consistent application of force so as to provide a consistent, near constant tension to the musical string 50, thus enabling the string to keep substantially the same tension, and thus tune, even when the string elongates or contracts.

Although the above embodiments employ moment arms, it is to be understood that a constant force spring having a specific desired output force may be attached end-to-end with a corresponding musical string in order to apply a desired tension force to the string. The constant force spring preferably is chosen to apply the desired tension without force modulation between the spring and the string.

Although the illustrated embodiments have employed adjustable levers, it is to be understood that other structures, such as a variable radius pulley, can also be used to provide an adjustable moment arm so as to fine tune the precise tension exerted by the spring on the associated musical string.

Figure 22:
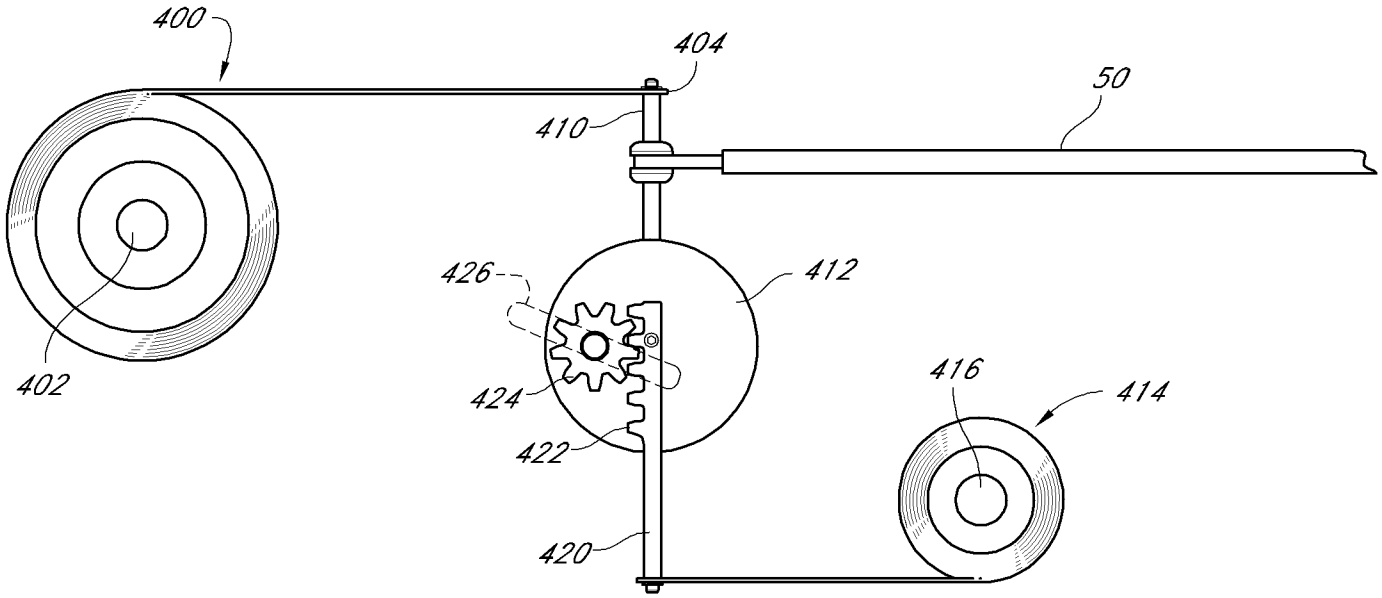
FIG. 22 is a schematic view of still another embodiment of a string mounting system having aspects in accordance with the present invention.

With reference next to FIG. 22, yet another embodiment is provided in which two springs 400, 414 operate on a single musical string 50. In the illustrated embodiment, a first constant force spring 400 is attached at a first mount 402 to the instrument body and has an attachment end 404 attached to a first lever 410. The string 50 is also attached to the first lever 410, which is adapted to rotate with a rotatable rod 412. A second spring 414 is attached to the musical instrument body at a second mount 416 and is also attached to a second lever 420 having an adjustable moment arm length by, for example, providing teeth 422 on a portion of the lever arm 420 and having a gear 424 with a user-operable knob 426 for adjusting the effective moment-arm length of the lever arm 420.

In the embodiment illustrated in FIG. 22, the first spring 400 is adapted to provide the majority of the tension to the associated string 50. For example, if the nominal desired tension of the string is about 21 pounds, the first constant torque spring 400 may be adapted to provide, through the lever arm 410, 20 pounds of tension, while the second spring 414 is adapted to provide, via the lever arm 420, about 2 pounds of tension. As such, the two springs working in concert provide the desired tension of the associated string 50. However, since the second spring 414 is smaller, it can be provided with more precise loading and adjustment characteristics so as to aid in easily adjusting and tuning the tension actually exerted on the string.

In another embodiment, the second spring may be a different type of spring, such as a coil-type spring. Also, the second spring may be attached to the string 50 in a manner similar to the illustrated embodiment, or through some other type of force modulating member. Since the second spring is relied upon for only a relatively small magnitude of tension, a coil spring having a relatively small spring constant may be chosen. Such a spring would have a lesser change in magnitude over a particular range of string elongation or contraction. As such, the concept of using multiple springs working together increases the options available to string mounting system designers.

Figure 23A:
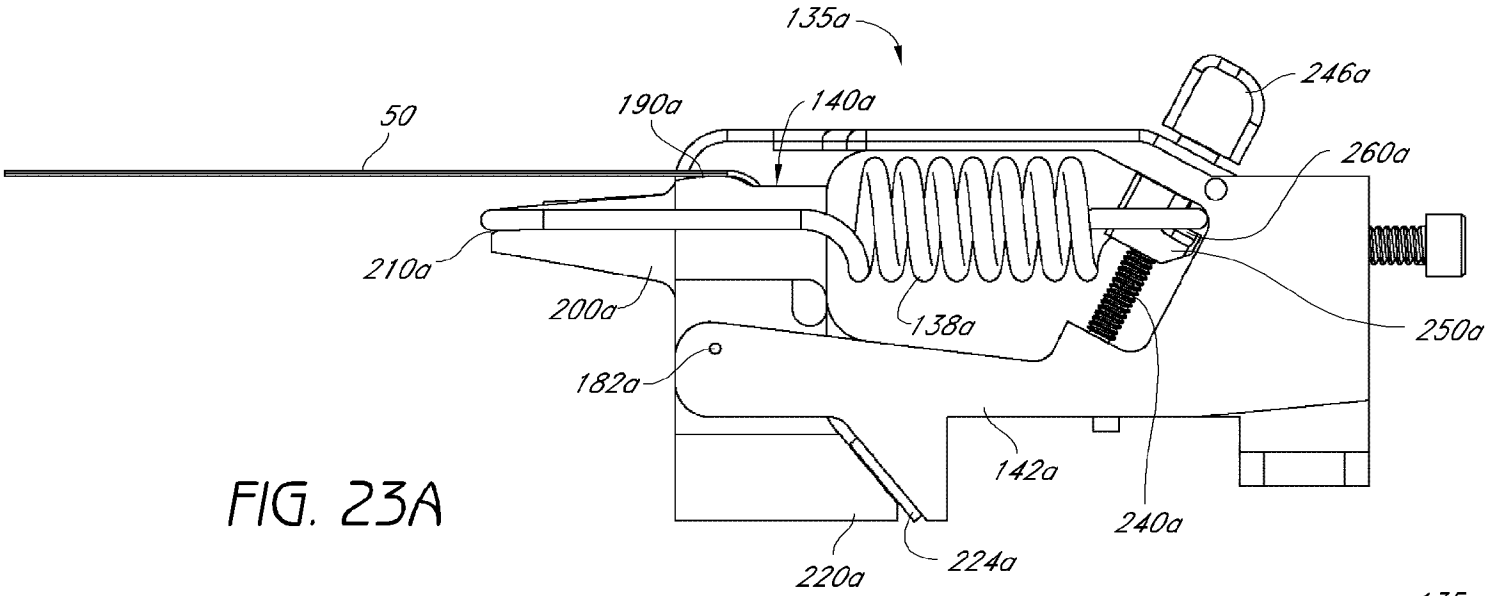
FIG. 23A is a side view of yet another embodiment of a string tensioner having aspects in accordance with the present invention
Figure 23B:
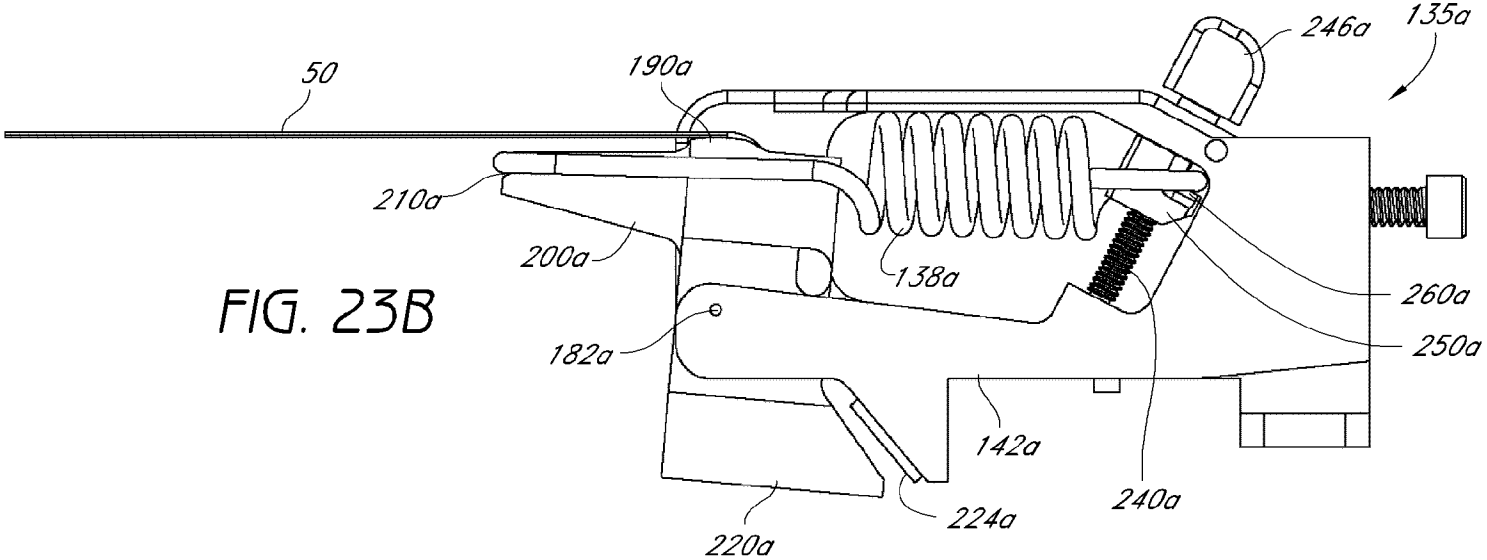
FIG. 23B is a side view of the string tensioner of FIG. 23A showing the spring force modulating member portion in a different rotational position.

With reference next to FIGS. 23A and 23B, yet another embodiment of a string tensioner 135*a* is provided. In this embodiment, the string tensioner comprises a body 142*a* that supports a spring force modulating member 140*a* that is adapted to rotate in a limited range about a pivot 182*a*. The modulating member 140*a* comprises an arm 200*a* having a string receiver 190*a* is adapted to receive and support a musical string 50. The arm 200*a* also includes a spring mount 210*a* adapted to engage a first end of a spring 138*a*.

The body portion 142*a* supports a threaded adjustment bolt 240*a* upon which a shuttle 250*a* is arranged. The longitudinal position of the shuttle 250*a* along the bolt 240*a* can be adjusted by rotating the bolt using the knob 246*a*. The shuttle 250*a* includes a spring mount 260*a* adapted to receive a second end of the spring 138*a*.

In this embodiment, the force modulating member 140*a* rotates about the pivot 182*a*, and force from the spring 138*a* is modulated and provides tension to the string 50 in a manner functionally similar to the embodiment discussed in connection with FIGS. 5-12. A stop engagement portion 220*a* of the modulating member 140*a* is adapted to engage a stop surface 224*a* formed on the body 142*a* so as to limit the range of rotation of the modulating member 140*a*. FIG. 23A shows the tensioner with the stop 220*a* engaged, and FIG. 23B shows the tensioner 135*a* rotated away from the stop 220*a*.

In embodiments discussed above in connection with FIGS. 2-4, the springs 71 generally directly exert their spring force to the corresponding strings 50 without a force modulating member disposed between the spring and string. In the embodiments discussed above in connection with FIGS. 5-12, the springs 138 exert their spring force to the corresponding strings 50 through a force modulating member. As discussed above, force modulating members of various shapes, sizes and configurations are contemplated. Applicants contemplate that aspects of the present inventions can be advantageously employed both through embodiments having direct spring-to-string force application and through embodiments in which spring force is modulated while being communicated to the string. In a particularly preferred embodiment, the spring force application is such that as the string elongates, the springs maintain tension so that the string remains within an acceptable range of tone relative to perfect-tune. In another preferred embodiment, as the string elongates, the spring continues to apply tension so that string tune changes relatively slowly as compared to a traditional instrument. Such slowing of the process of going out of tune is valuable, even though preserving near-perfect tune is preferred.

The discussion below establishes certain mathematical relationships that may be considered when developing embodiments employing springs to supply a tension to a corresponding musical string, which tension preferably is relatively slow-changing upon stretching of the string over time and more preferably is generally constant notwithstanding stretching of the string over a range.

Certain mathematical equations include:

1) frequency of vibrating string: $f=(\frac{1}{2} L)(T/d)^{1/2}$.

where

L is the length of the string;

T is the string tension; and d is the string diameter

2) Young's modulus of elasticity: $\Delta=FI/(Ax)$ where

Δ is the modulus of elasticity;

F is the force along some axis Z of the material;

I is the natural length along the same axis Z of the material;

A is the cross sectional area of the material along axis Z; and x is the linear displacement (the stretch).

3) $F=-Kx$.

where

K is the spring constant, or spring rate, of the spring.

Rearranging equation 2 we get $F=(\Delta A/I)x$, which is equation 3 where $\Delta A/I=K$. For steel, Δ is about 30,000,000 lbs./in.^2; for nylon, Δ is about 1,500,000 lbs./in.^2. As such, steel is about 20 times stiffer then nylon. However, nylon strings will have a wider cross sectional area compared with steel strings because, as equation 1 shows, density is a variable in the emitted frequency. The density of steel is about 0.28 lbs./in.^3 the density of nylon is about 0.04 lbs./in.^3. Thus, the cross sectional area of a nylon string is about 7 times that of a steel string (0.28/0.04) if we are to keep the mass per unit length density (as used in equation 1) of the steel and nylon strings substantially the same. If the density of the strings is held constant, the same length string under the same tension will emit the same frequency.

Since K is proportional to the cross sectional area, the "stretchiness" of a nylon string with the same mass per unit length of a steel string will be 20/7 (~3 times) that of a steel string. Put another way, $K_{nylon}$ (7/20)$K_{steel}$.

In a typical guitar, the nominal string diameter of the steel high E string (the stretchiest string) is about 0.009" in diameter, and the maximum natural length of this string is about 40". From these parameters, we can calculate that the spring constant for this string is about 30,000,000*(0.009/2)^2*PI/40=47.71 lb./in. for steel, and about 47.71/(20/7)=16.7 lb./in. for nylon. The ultimate strength of steel is about 213,000 lbs./in.^2; thus a steel high E string will likely fail if stretched more than about 213,000*PI*(0.009/2)^2=13.5 lbs. Maximum deflection of the E string at this maximum tension is 13.5 lbs./(47.71 lbs./in.)=0.28 inches which is, for a typical 40" guitar string, about 0.7% elongation.

Similarly, based on these assumptions and calculations, the stretchiest string (E) of the stretchiest material (nylon) of a conventional guitar will stretch about 0.28*(20/7)=0.81 inches or about ¾" which is, for a typical 40" guitar string, about 1.9% elongation.

An additional embodiment has a structure generally similar to those disclosed above in connection with FIGS. 2-4, but may have varying relative dimensions. One such embodiment has a spring constant of about 1 lb./in. For a steel E string that deflects 0.28 inches at 13.5 lbs. of tension, the change in tension pursuant to equation 3 is 0.28 lb. Thus, the changed tension applied by the spring will be 13.22 lbs. Since, when other factors are held constant, the frequency of a string changes with the square root of the tension, the frequency can be expected to change about 1%, remaining about 99% of the original frequency. By the same reasoning, using a spring having a rate of about 2 lb./in. yields a frequency about 98% of the original frequency. Similar calculations determine the following additional relationships: a spring rate of 0.5 lb./in. yields a frequency about 99.5% of the original frequency; a spring rate of 0.25 lb./in. yields a frequency about 99.7% of the original frequency; and a spring rate of 0.1 yields a frequency about 99.9% of the original frequency. Further, although this discussion contemplates a directly connected embodiment such as in FIGS. 2-4, using a force modulating member can further soften spring rates to even further lessen the frequency differences with a change in string elongation.

In the 12-tone musical scale, moving down a full step (note) is achieved at a frequency that is $2^{(-2/12)}$=0.89 times the original note. Thus, a pitch emitted within about 90% of the original frequency of a tuned string is within about 1 full step of the original pitch.

Further to the above discussion, spring arrangements can be chosen so that even larger string elongations, such as elongation by one or two inches (of a 40 in. guitar string), results in a frequency that is still 90% or more of the original, perfect-tune frequency.

In yet another embodiment, a constant torque spring motor, such as the NEG'ATOR product discussed above, or a constant force-type spring, is coupled with a string so as to apply a near-constant force even during elongation of the spring by several inches. As such, even if the spring operates on a lever arm, the change in spring tension is very small even if the string were to elongate 1, 2 or more inches, and substantially negligible for the relatively small stretch anticipated during use.

In a still further embodiment, musical string is constructed of wire manufactured according to very tight tolerances. For example, preferably a string that is adapted to be the high E string of a guitar has a nominal diameter of about 0.009 inches, and a diameter tolerance of less than 0.5%, more preferably less than 0.25%, and most preferably below 0.1%. As such, consistency of actual natural frequency of the string at a specified tension and effective length is achieved. For example, the guitar high E string nominally vibrates at 330 Hz. Applicant has determined that a string diameter that varies from the nominal diameter by +−0.25% will vibrate at between 329.175 and 330.825 Hz, which corresponds to about 1.65 beats per second. Adherence to 0.1% diameter tolerances will result in under 0.66 beats per second, which is an inaudible difference in tune. Preferably, manufacturing tolerances are such that the variation from nominal frequency generates a beat frequency of less than about 2 beats per second, more preferably less than about 1.65 beats per second, still more preferably less than about 1 beat per second, and most preferably about 0.66 beats per second or less.

In connection with a tight-tolerance string, an embodiment may employ a spring having similarly tight-tolerances joined end-to-end with the string. As such, substantially no adjustments will be necessary. In such an embodiment, indicia may be provided adjacent the spring/string connection to indicate the actual tension of the string. Thus, when mounting the string on the instrument, the user tightens the tuning knob until the spring/string connection aligns with the appropriate indicia mark. Also, if the string is to change in length due to relaxation or the like, the user may adjust the tuning knob to realign the connection with the appropriate indicia mark.

It is also to be understood that embodiments described herein can be adapted to be used with strings of various sizes, tones, lengths and the like. For instance, different guitar strings typically have an ideal (perfect tune) tension between about 10-20 lb., and sometimes between about 10-30 lb. Certain relatively large piano strings are configured so that their perfect tune tension approaches 200 lb. and, if multiple strings are combined and powered by a single spring, such tension requirement may approach 1,000 lb. It is contemplated that certain musical strings may find a perfect tune tension at or even below 5 lb. Applicants contemplate arranging embodiments to accommodate such ranges of string tensions.

FIGS. 24-28B illustrate additional embodiments of a tensioner 535 for a stringed musical instrument that employs principles substantially similar in some aspects to those represented in FIGS. 1-23B. For example, embodiments of the tensioner described herein can include the perfect-tuning, adjustability, pivotability, and stop mechanisms represented in FIGS. 6-9.

The tensioners 535 described herein with reference to FIGS. 24-28B can employ two or more spring modulation members 540A, 540B pivotably attached to both an elongated body 542 and a spring modulation support 500, with one or more resilient members (e.g., springs 138A-138C) interposed between the elongated body and the spring modulation support. Preferably the string receiver 190, which includes the saddle 192, is mounted on the support 500.

Any of a number of points on the spring modulation support 500 will produce a similar torque balancing equation with respect to the elongated body 542, for example, when 540A and 540B are similar size. This can allow one or more resilient members 138 to be connected at any of a number of different locations on tensioner 535 suitable to provide a resilient force between the elongated body 542 and the support 500. The torque that each resilient member 138 applies to the modulation members 540 can vary based upon the angle of the resilient member 138 with respect to other components in the tensioner 535, such as the modulation members 540A and 5408, the modulation support 500, and/or the elongated body 542. The same holds true for the string as one or more strings can be attached to any of a number of different locations on support 500, and the torque the strings apply to the modulation members 540 can vary based upon the angle of the strings with respect to the modulation members 540A and 540B and the force at which they pull or provide tension. The torque the string applies on the modulation member 540 generally opposes the torque that each resilient member applies to the modulation members 540. Put mathematically, the equation, torque=force of pull×sin (angle of pull to member 540), will be the same and balanced for one or more strings and resilient members pulling between body 542 and support 500.

In some embodiments, the tensioner can include one or more springs in which the spring force therein can be increased (e.g. tensioned) and decreased (e.g., relaxed) with respect to the elongated body and spring modulation support, to facilitate tuning adjustments to a string supported by the tensioner. The spring force can be adjusted by changing the number of springs employed, through use of different spring types or materials, and/or by adjusting the spring length. Such adjustment can provide fine-tuning adjustments for the string, and/or coarse or discrete-tuning adjustments. In some embodiments, which will be described in more detail below, tuning adjustments can be provided through movement of an end of a spring relative to other portions of the tensioner, to increase and decrease the spring force. In further embodiments, which will also be described in more detail below, the discrete-tuning adjustment can be pre-selected to correspond to a discrete interval (e.g., pitch) on that string. For example, in some embodiments the tensioners described herein can move a spring between a first position and a second position corresponding to two different tensions applied to the string. Such discrete changes in tension on the string in turn causes the pitch emitted by the string (when played) to change, for example, from an "E" tuning to a "dropped D" tuning, or any other interval as desired. In some embodiments, one or more springs can be removably attached to another portion of the tensioner, such that the aforementioned coarse tuning adjustability is provided by decoupling and recoupling one or more springs from one or more portions of the tensioner, such as the elongated body and/or spring modulation support. In some embodiments, two or more tensioners can be employed to provide a tensioning device for a stringed musical instrument that provides the aforementioned features.

Figure 24:
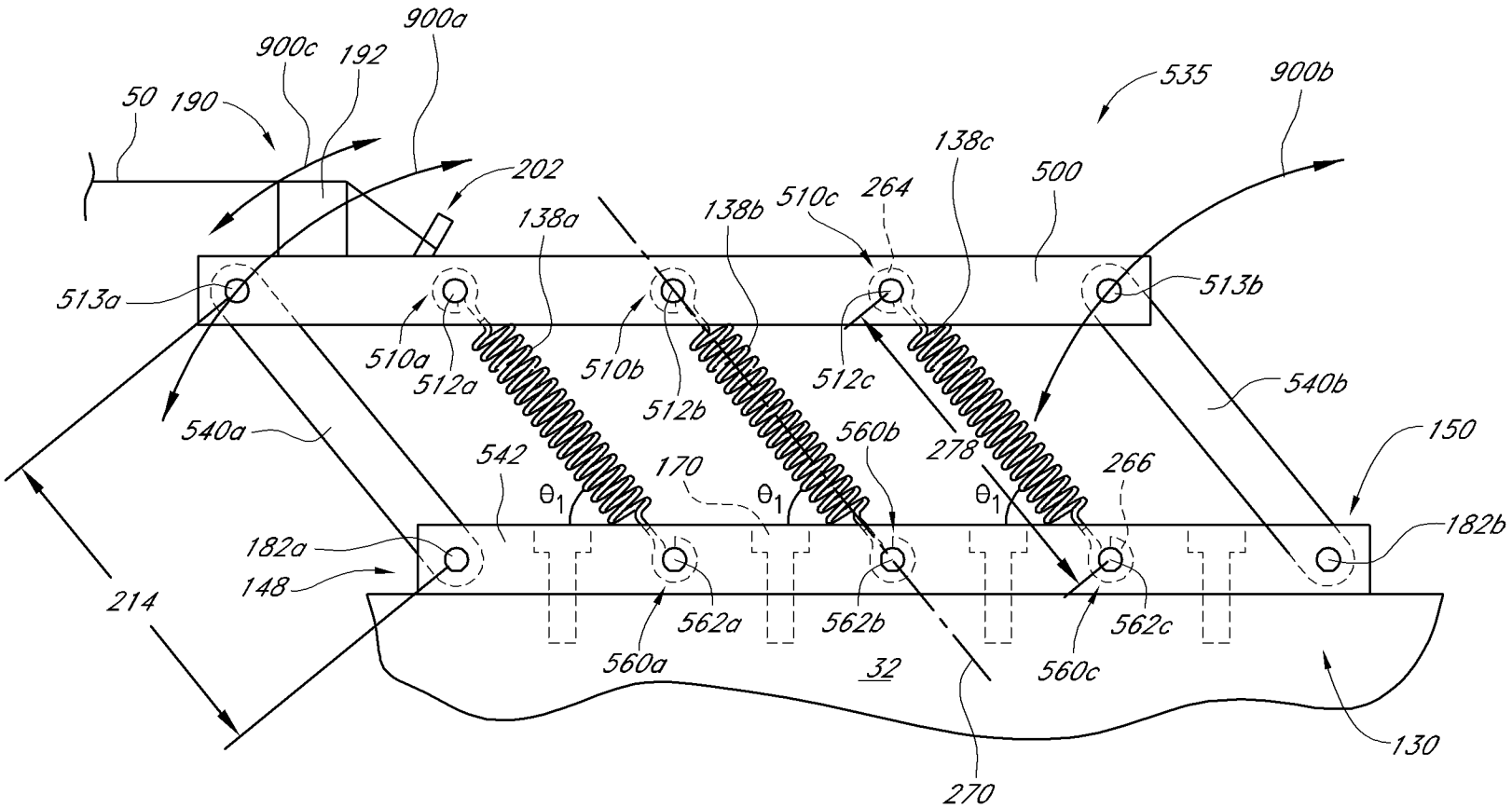
FIG. 24 is a schematic side view of another embodiment of a string tensioner.
Figure 25:
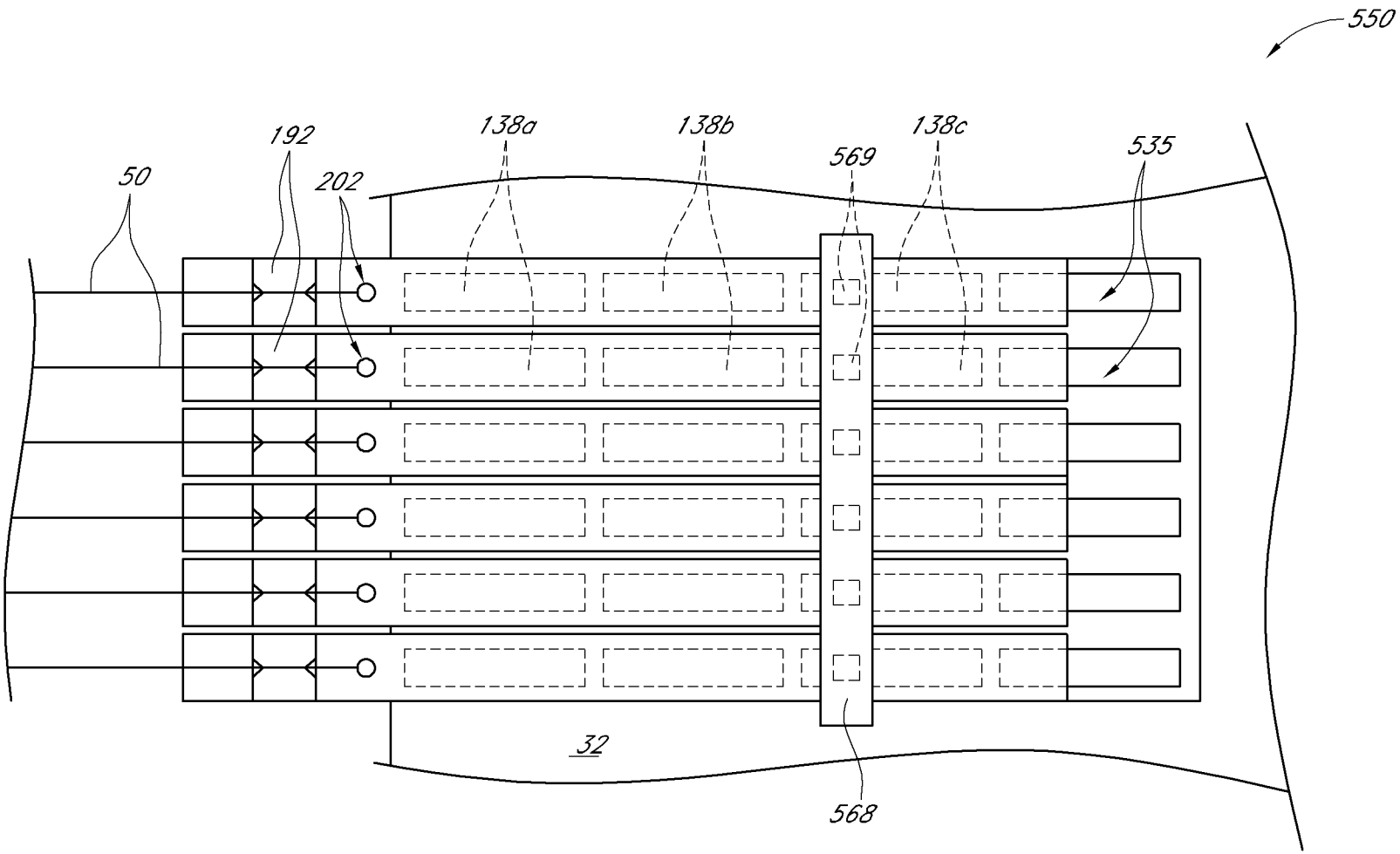
FIG. 25 is a schematic top view of an embodiment of string tensioning device employing a plurality of the string tensioners of FIG. 24.

The illustrated tensioner 535 can allow action adjustment (e.g., moving the string receiver 190 vertically with respect to the view shown in FIG. 24) and intonation adjustment (e.g., moving the string receiver 190 horizontally in the view shown in FIG. 24) on the support 500 while still supplying substantially the same tensioning characteristics. "Substantially" is used here, as it will be understood that there are negligible effects to the tensioning of the strings and the positioning of the components within tensioner 535 that may result from a minor change in angle of the strings with respect to portions of tensioner 535 resulting from action and intonation adjustments. Some embodiments can provide a compact design and conventional look, as the movable components provided to do action adjustment and intonation adjustment can all be attached to, housed, and or integrally formed with the support 500. Such embodiments allow said adjustment and intonation through movement of the movable adjustment and intonation components with respect to support 500 instead of moving the whole tensioner 535. And in such embodiments the tensioning characteristics remain substantially the same regardless of where the string receiver 190 is on the support 500 (i.e., whether the receiver 190 is at one or the other ends of the support, or anywhere in between). Thus, such embodiments can allow the string attachment, saddle, and/or other action and intonation components, or other components mounted on support 500, to move in the same X-Y plane relative to the body 542, and along the same paths of motions described further herein, as the support 500.

Embodiments of tensioner 535 can allow its components to have any of a number of different shapes, and be positioned at various locations relative to each other and relative to other portions of an instrument on which tensioner 535 is mounted, while still providing the advantages described herein relative to the movement in the X-Y plane, and related paths of motions. For example, in another embodiment a cam or the like may be rigidly attached to the support, and the string receiver 190 may be on the cam, but the tensioning characteristics will remain substantially the same as if the string receiver 190 were attached to the support. In a still further embodiment, the body 542 and modulation members 540A, 540B can be mounted near a back end of a guitar body, and the support 500 may extend far forwardly of the modulation members, and the string receiver 190 can be mounted on that forward portion of the support 500, but still enjoy substantially the same tensioning characteristics as if it were mounted on the support at a location between the modulation members 540. Such flexibility in positioning and shapes of the tensioner 535 components can allow tensioner 535 to be implemented with instruments that may have tight dimensional constraints due to other system components, such as guitar pickups and other electronics.

A further advantage of some of the embodiments described herein is that since tensioner 535 can remain in the same place, it can be possible to lock multiple supports 500 together easily such that they become immobile with respect to body 542. This embodiment can allow the features of the invention to be selectively locked out for purposes of bending a string, employing a tremolo arm and/or any other purpose where it is desirable that the string(s) act as they do on conventional stringed instruments without the present invention.

Yet another advantage of the tensioner 535 is that the end of the string that attaches to support 500 through string receiver 190 and/or the end of the resilient member 138 that attaches to support 500 goes through less of an angle change when modulation member 540 rotates than it would if it were attached directly to modulation member 540, such as if implemented within the tensioner 135 described elsewhere herein. For example, when tensioner 535 moves to compensate for a change of pitch in a string, the saddle or other components supporting the string move in a path of motion in an X-Y plane extending through the tensioner, as described elsewhere herein. The path of motion has reduced rotational aspects about an axis extending perpendicular from the surface of the X-Y plane. This reduced rotation, and the paths of motion described herein with respect to tensioner 535, can reduce fatigue that may otherwise be caused from the partial wrapping and unwrapping of a string about a saddle that is being rotated through pitch correction of other tensioners. These features can also reduce hysteresis due to this angle change, and kinking of the string which can affect the strings torque and tension characteristics. Thus, string fatigue between the string and the saddle is reduced, reducing the likelihood of premature failure of the strings.

With reference to FIGS. 24-27, several views are provided of an embodiment of the string tensioner 535. Tensioner 535 can be substantially similar in some aspects to tensioner 135 described herein with reference to, e.g., FIGS. 6-9. For example, string tensioner 535 can include a string receiver 190 (with a saddle 192) and/or a string connector 202, or other suitable structure known or described herein, configured to connect and support a string 50 on a portion of a stringed musical instrument, such as a guitar body 32 of a guitar 130.

The illustrated string tensioner 535 can comprise the elongate body or base 542. Body 542 can have similarities to body 142 described elsewhere herein (e.g., FIG. 6). Body 542 can be adapted to be attached to the guitar body 32, with any of a number of different types of suitable attachment elements, such as mounts 170. The mounts 170 can be directly attached to guitar body 32 (FIG. 24) or attached to an intervening frame or other structure that can be attached to the guitar body (See, for example, FIGS. 29A-32; described further below). The elongate body 542 can be integrally or separately formed with respect to the guitar body 32. The body 542 can include a first end 148 and a second end 150. Preferably, the elongate body 542 is positioned on the guitar body 32 so as to be generally aligned with the corresponding guitar string 50. It will be understood, however, that tensioner 535, and one or more of its components, such as support 500, body 542, and modulation members 540*a*, 540*b* can be any of a number of orientations relative to the string 50. For example, support 500 and body 542 can be at an angle relative to string 50. The first end 148 is generally closer to a neck of the guitar 130 than the second end 150, which is generally closer to a rear of the guitar 130.

Tensioner 535 can include one or more spring force modulation members that share some similarities with member 140 (FIG. 6). Preferably tensioner 535 includes two or more spring force modulation members 540A, 540B, each with a first portion (e.g., end) pivotably attached to a portion of body 542 at pivots 182A, 182B, respectively. A second portion (e.g., opposed end) of each of modulation member 540A, 540B can be pivotably attached to the spring modulation arm or support 500 at pivots 513A, 513B, respectively. In the illustrated embodiment, the spring force modulation members 540A, 540B are of substantially similar length so that the distance 214 between pivots 182A and 513A is substantially similar to the distance between pivots 182B and 513B.

Tensioner 535 can allow one or more portions of spring modulation support 500 to move with respect to body 542 along a predetermined path of motion. For example, support 500 at pivots 513A and 513B moves along paths 900A and 900B, respectively, relative to pivots 182A and 182B, respectively. In the illustrated embodiment every point on support 500 will move along a curve that is substantially parallel to paths 900A or B relative to the body 542. The shape of one or more of the paths 900A and 900B can be selected, for example, to provide a desired shape of motion of a path 900C of string 50, when string 50 is attached to tensioner 535. Thus, referring to FIGS. 6 6A, and 24, tensioner 535 provides a similar configuration as tensioner 135, but provides additional functionality, by pivotably connecting two support features (elongated body 542 and spring modulation support 500) with two modulation members (540A, 540B; FIG. 24) instead of providing a single modulation member (e.g., modulation member 140) configured to pivot about a single point (e.g., 182; FIGS. 6A, 6B).

In some embodiments, body 542, support 500, and modulation members 540*a*, 540*b* are configured to form an approximately rectangular, square, rhombus, or preferably, parallelogram shape. In such embodiments, all points on body 500, or other movable components within the tensioner assembly, have similar, or substantially identical relative motion (e.g., along a path such as paths 900A and 900B). For example, a first arbitrary point on body 500 will move along a similar path or fashion relative to its starting point when compared to the motion of a second other arbitrary point relative to its starting point. These features can provide additional benefits. For example, the spring or resilient elements described herein can be connected at any of many different points on portions of tensioner 535, such as body 500, and still provide the constant perfect tension function describe elsewhere herein. This allows increased freedom in the design and layout of the tensioner, making it easier to fit within the constraints of a musical instrument. It also allows multiple resilient elements to be attached to tensioner 535, as described further herein. Similar logic applies to the string mounting point 192, which in some musical instruments, such as electric guitars, generally can be adjusted for intonation and action (e.g., for both height and distance from the distal end of the string, as described above). These adjustments can be made using intonation and action adjustment systems (e.g., simple threaded connections and assemblies) in a fashion known in the art or described herein. However, because of the relationship between the body 542, support 500, and modulation members 540*a*, 540*b*, and the similar paths of motion to the movable components of tensioner 535, as described above, changing the position of the string mount 192 while making action and/or intonation adjustments has a reduced effect on string tension or the ability of the system to maintain perfect tune.

Such embodiments can further improve the tunability of an instrument employing tensioner 535, by reducing hysteresis on the string, and providing the additional functionality described herein. For example, hysteresis can be caused by kinking of a string 50 attached to tensioner 535, when elongated body 542 and spring modulation support 500 pivot with respect to each other. Alternatively or additionally, hysteresis can be caused by friction at or proximate to the point of attachment between one or more components of tensioner 535, such as the attachment between support 500 and/or body 542 and modulation members 540A, 540B. Friction can occur at the point of attachment between a portion of tensioner 535 and one or more resilient members, as will be described presently.

One or more suitable resilient members, such as a spring, can be adapted to provide spring force between modulation support 500 and elongate body 542. Such spring force can be provided by attaching one or more resilient members to one or more components of tensioner 535, or an intermediate structure. For example, one or more resilient members can be attached to a portion of support 500, members 540A, 540B, and/or body 542, receiver 190, string connector 202, or a suitable intermediate connecting structure. In the embodiment illustrated in FIG. 24, tensioner 535 includes the plurality of springs 138A, 138B and 138C, each with a first portion (e.g., an end 266) attached to body 542, and a second portion (e.g., an end 264) attached to spring modulation support 500. The springs 138A-138C can provide spring force between body 542 and support 500, directed along an axis 270 (for each spring; see, e.g., FIGS. 28A-28B), to provide the various improvements in tuning described herein, when the string 50 is attached to a portion of tensioner 535. It will be understood that the resilient members described herein can be any structure suitable to provide a resilient force between two or more components, and need not be limited to a spring, nor a particular type of spring or spring structure. Thus, embodiments are anticipated that include elastic, coiled or non-coiled structures, and/or other resilient members that provide torsional, compression, extension, and/or other resilient force.

Figure 30:
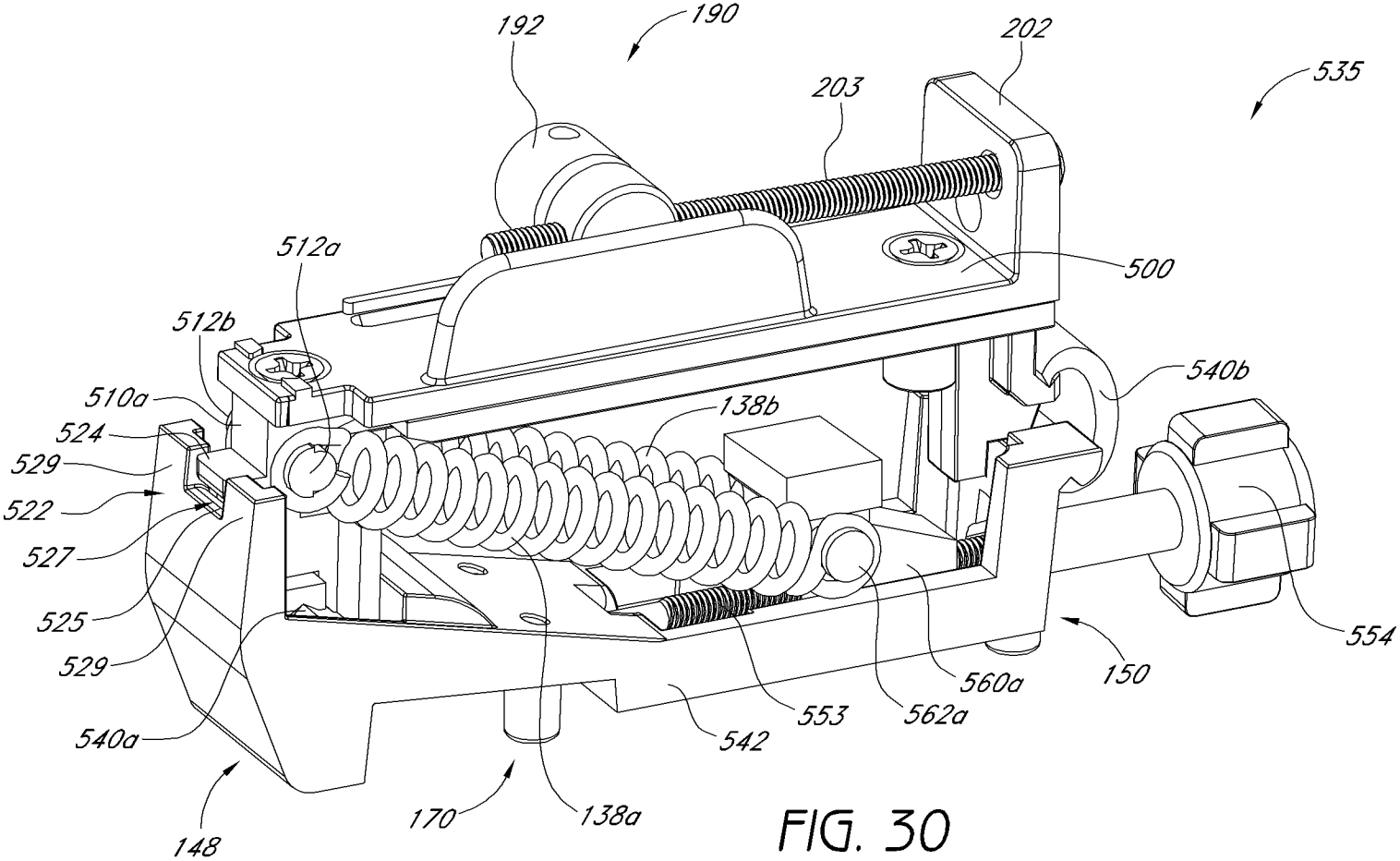
FIG. 30 is a side perspective view of one string tensioner of the string tensioning device illustrated in FIGS. 29A-29B.
Figure 31:
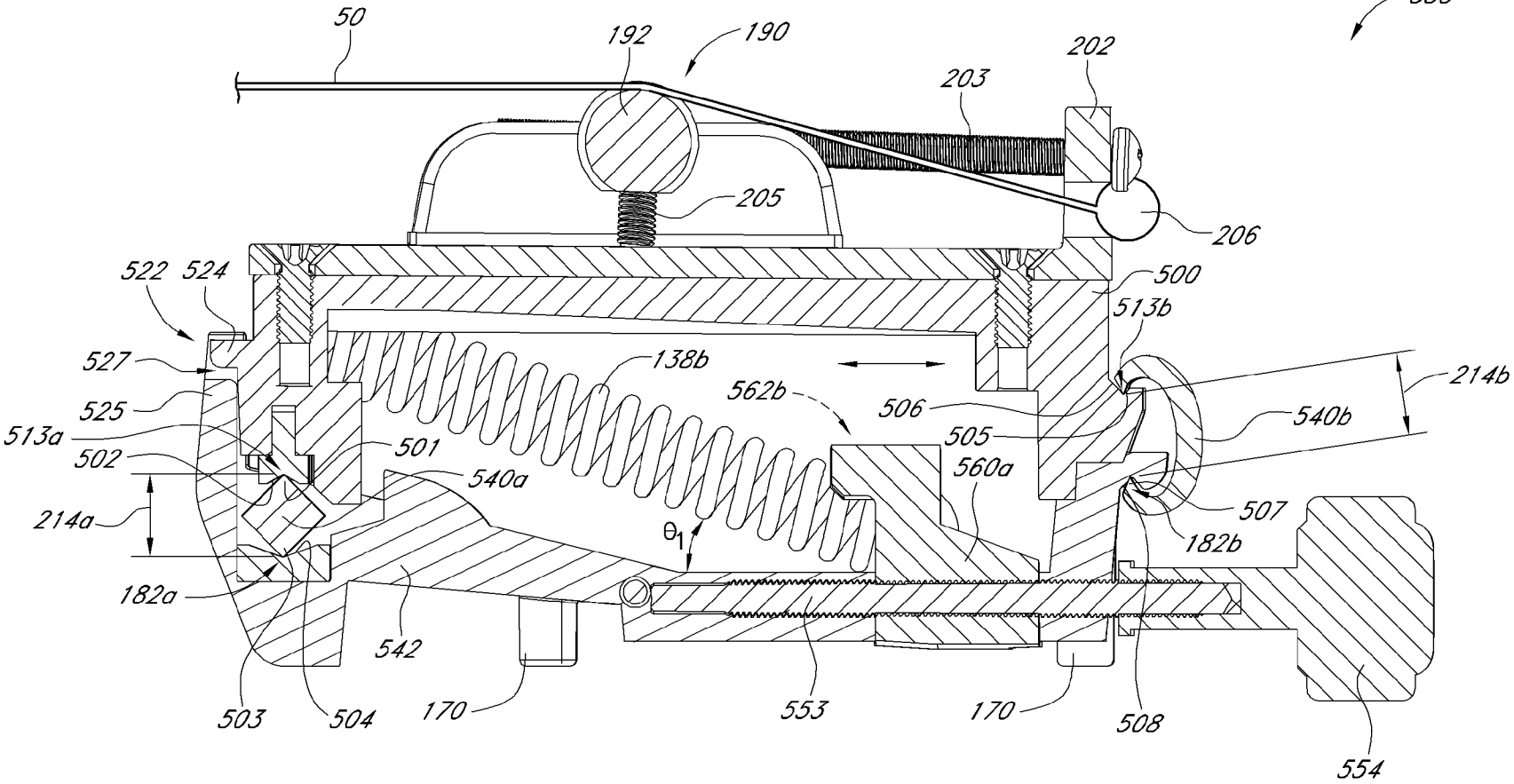
FIG. 31 is a side cross-sectional view of the string tensioner of FIG. 30.
Figure 32:
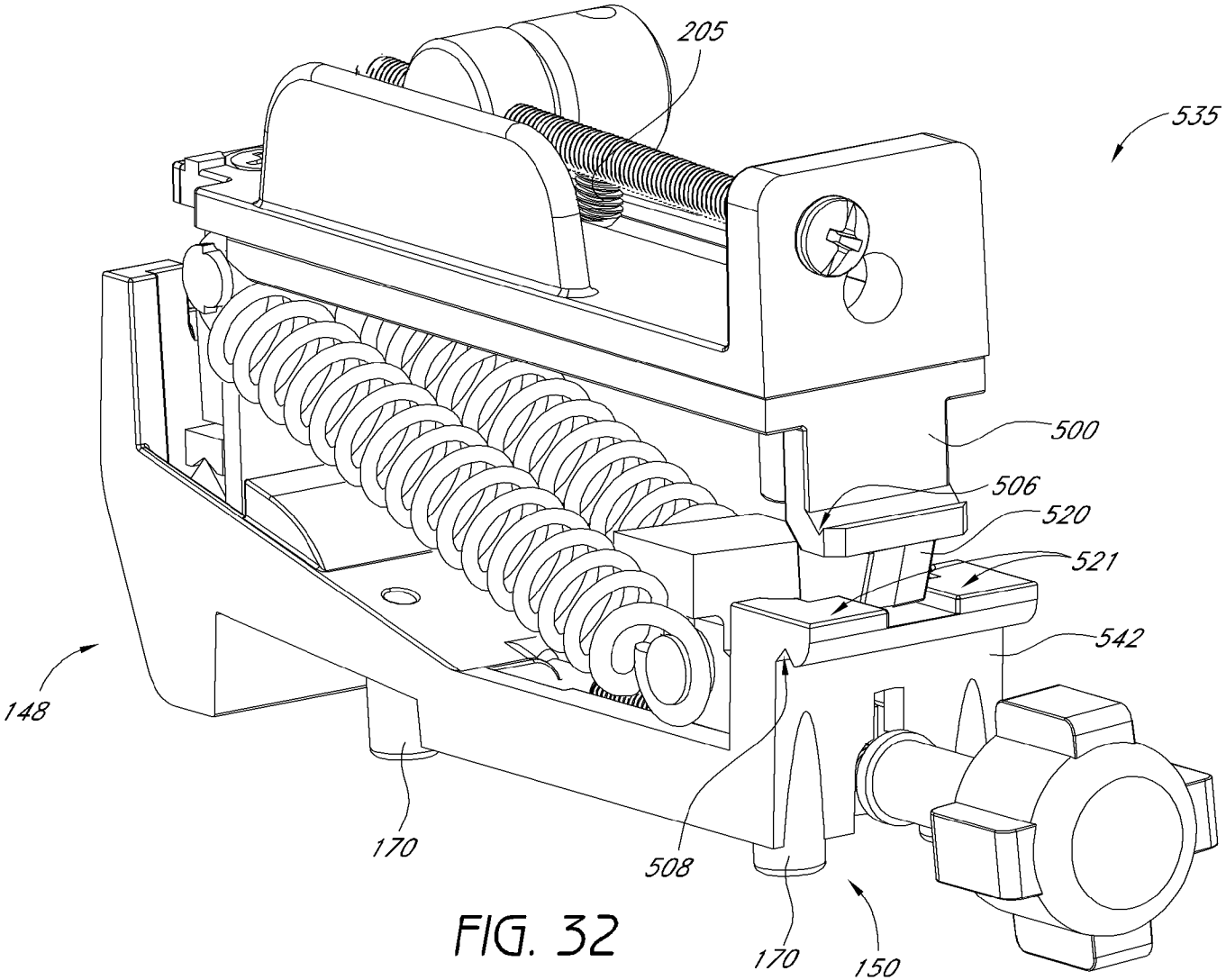
FIG. 32 is a rear perspective view of an embodiment of the string tensioner with a spring modulation member removed.

In the illustrated embodiment, three springs are employed. It will be understood, however, that one, two, three or any of a number of different quantities, shapes, or sizes of springs can be implemented with the embodiments of tensioner 535, and the three spring embodiment described herein is for illustrative purposes, unless stated otherwise. Additionally, in embodiments with two or more springs, the two or more springs can be positioned (e.g., spaced) longitudinally with respect to each other, as shown, or can spaced be positioned (e.g., spaced) laterally with respect to each other, as shown in FIGS. 30-32. Moreover, any of a number of different geometries can be implemented with the other various components of tensioner 535. For example, various geometries may provide various amounts of spring tension communicated to a string 50 when mounted on tensioner 535, and/or to define the shape of path(s) 900A-900C (FIG. 24), any of the following of which are within the scope of the tensioners described herein:

A distance 214 between pivots 182A, 513A and 182B, 513B (e.g., the length of members 540A, 540B) can be substantially similar with respect to each other, as shown in FIG. 24. For example, the difference in the distance between pivots 182A and 513A compared to the distance between pivots 182B and 513B, can be less than or equal to approximately ±15%, or in some embodiments, less than or equal to approximately ±10%, or in some embodiments, less than or equal to approximately ±5%, of the overall total distance 214 between pivots 182A and 513A. These values may also vary depending on the length of support 500 and body 542, as both the distances 214, and the distances between pivots 182A, 182B, and 513A, 513B can affect the paths of motion 900A-C.

Additionally, pivots 182A, 182B, 513A, and/or 513B can be positioned along various portions of support 500 and body 542, and need not be positioned proximate to the ends thereof as shown. Further, additional embodiments may employ more than one pair of modulation members 540. In further embodiments, the pivots may be positioned so that a shape (e.g, perimeter) formed by connecting pivots 182A, 182B, 513B and 513A can be a regular or irregular shape, such as a square, rectangle, trapezoid, rhombus, parallelogram, or other polygon. Spring modulation support 500 and elongate body 542 can be substantially parallel or non-parallel with respect to each other, and/or spring modulation members 540A, 540B can be substantially parallel or non-parallel with respect to each other. Also, in some embodiments, the arcuate path of motion is not the same at all points along the support 500. Additionally, modulation members 540A and 540B can be, but need not be, an elongated, substantially straight linkage with a pinned hinge structure at pivots 182A, 182B, 513B and 513A. Body 542, support 500, and/or members 540A, 540B can comprise any of a variety of shapes suitable to provide the aforementioned pivotable support structure and functionality, including portions that are substantially planar, straight, curvilinear, and/or combinations thereof. Embodiments of body 542, support 500 and members 540A, 540B suitable to provide such functionality are shown and described below with respect to FIGS. 30-32.

String 50 preferably is mounted to a portion of spring modulation support 500 (as shown). In some embodiments, string 50 can be mounted to a portion of member 540A or 540B, and/or a suitable intermediate connecting structure, such as the receiver 190 and/or the string connector 202.

Elongate body 542 need not be mounted parallel to guitar body 32 (e.g., the upper surface of guitar body 32) and/or string 50. For example, body 542 can be mounted at an angle with respect to guitar body 32 surface and/or a longitudinal axis of string 50, to affect the amount of longitudinal or lateral movement of string 50 within path 900C.

Referring to FIGS. 24 and 26-28B, the spring(s) (e.g., 138A-138C) can be mounted to body 542 and support 500 in a variety of ways known or described herein. In the illustrated embodiments, spring mounts 510A-510C and 560A-560C are provided to mount spring ends 264 and 266 of springs 138A-138C along support 500 and body 542, respectively. The spring mounts can include one or more rods, axles, bolts, screws or other suitable structures, such as pins 512A-C and 562A-C, to mount one or more springs to each spring mount. Mounts 510A-510C and 560A-560C, and pins 512A-C and 526A-C can be similar to mounts 210 and 260, and pins 212 and 226 (FIG. 6). In some embodiments, one or both ends of the springs 138 are permanently secured to the body 542 and/or support 500 through, for example, welding, brazing, adhesives or the like. In some embodiments, the position of one or both ends of the springs 138 can be adjustable relative to the body 542 and/or support 500, to provide tuning adjustment of the string 50, as shown and described below with respect to FIGS. 28A-B and 30-32.

Figure 26:
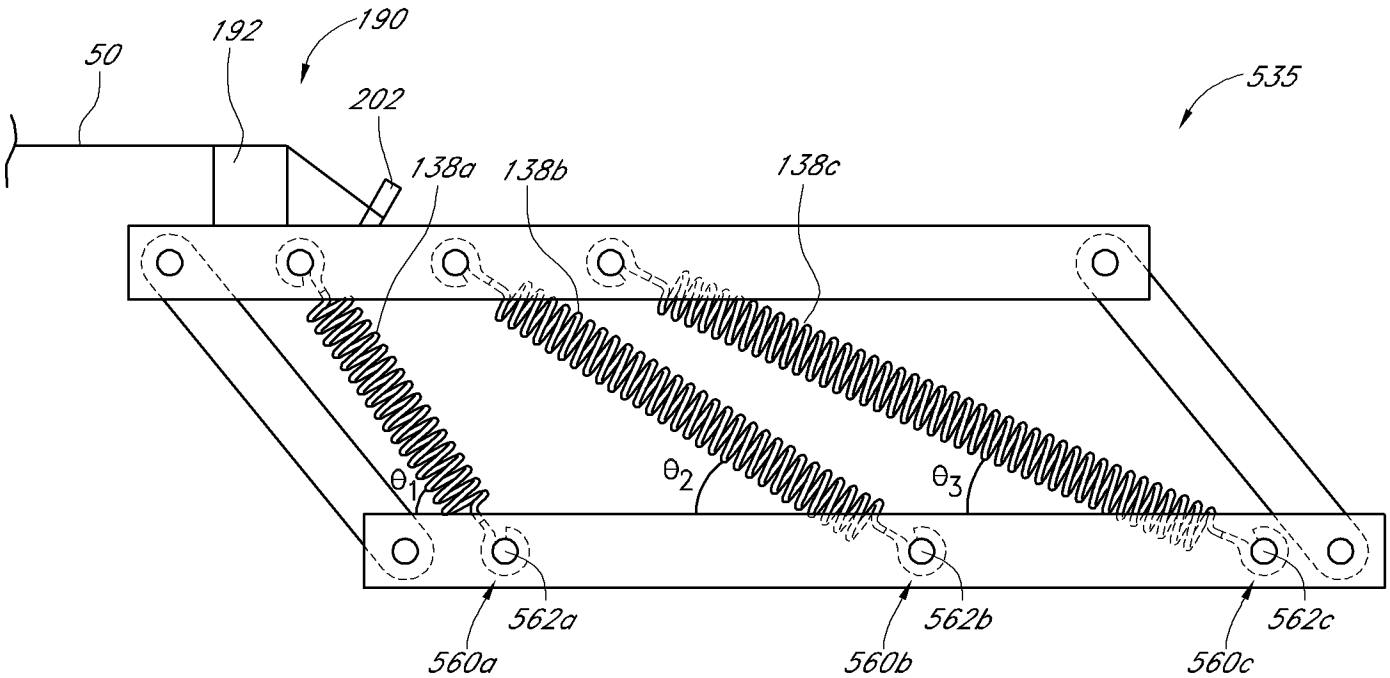
FIG. 26 is a schematic side view of yet another embodiment of a string tensioner.
Figure 27:
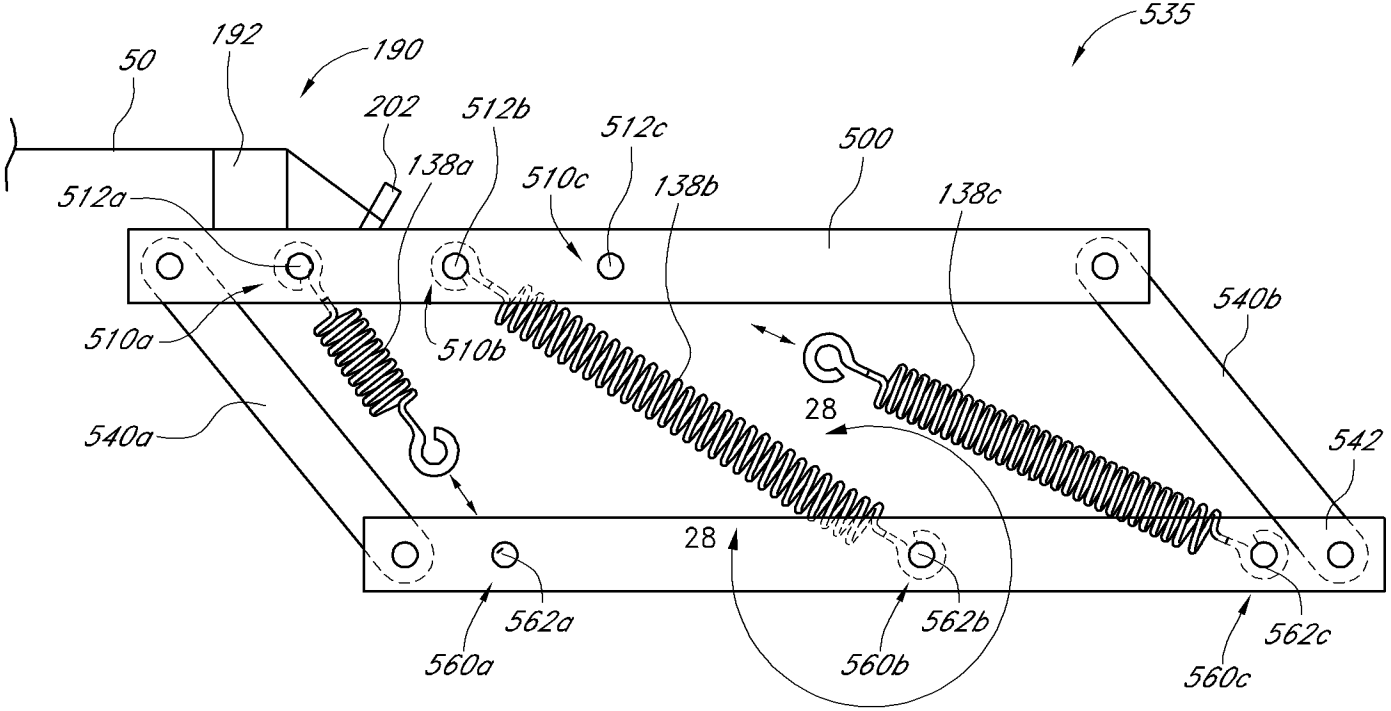
FIG. 27 is a schematic side view of an embodiment of a string tensioner with one or more detachable springs.

In embodiments of tensioner 535 with two or more springs, the mounting of a first and second adjacent spring can be varied with respect to support 500 and/or body 542. For example, any two springs can be longitudinally adjacent with respect to each other, along the length of support 500 and/or body 542 (as shown in FIGS. 24, 26 and 27), and/or laterally adjacent with respect to each other, along the width of support 500 and/or body 542 (as shown in FIGS. 30 and 32 and described further below). Referring to FIG. 24, the longitudinal distance between adjacent mounts 510A, 510B along support 500 can be approximately the same as the distance between adjacent mounts 560A, 560B along body 542, such that springs 523A and 523B are approximately parallel to each other. In other embodiments, and with reference to FIGS. 26 and 27, the distance between adjacent mounts 510A, 510B along support 500 can be substantially different from the distance between adjacent mounts 560A, 560B along body 542, such that springs 523A and 523B are not parallel to each other. Thus, any two or more springs can be mounted to body 542 and support 500 at similar angles with respect to each other (e.g., 01; FIG. 24), or different angles with respect to each other (e.g., θ1, θ2, θ3; FIG. 26). In some embodiments, the angle between the spring and the body 542 and support 500 can be adjustable, through movement of an end of the spring relative to the body 542 or support 500, as shown in FIGS. 30-32 and described further below.

Referring to FIGS. 24-27, in embodiments of tensioner 535 with three or more springs, the spacing or distance between the spring mounts of a first set of adjacent springs can be varied (e.g., evenly or unevenly spaced) with respect to the spacing between the spring mounts of a second set of adjacent springs. For example, referring to FIG. 24, the spacing between adjacent mounts 510A, 510B along support 500 can be approximately the same (e.g., evenly spaced) as the distance between adjacent mounts 510B, 510C along support 500. Additionally or alternatively, the distance between adjacent mounts 560A, 560B along body 542 can be approximately the same (e.g. evenly spaced) as the distance between adjacent mounts 560B, 560C along body 542. In some embodiments, such spacing can be uneven or irregular for any two sets of adjacent mounts, such as in the embodiments shown in FIGS. 26 and 27, wherein the distance between adjacent mounts 560A and 560B is greater than the distance between adjacent mounts 560B and 560C (e.g., unevenly spaced). The aforementioned variations in mounting, spacing, and angular orientation can provide a broad range of adjustable tension options between support 500 and body 542, to provide a broad flexibility in the tuning effects provided by tensioner 535 to a string mounted on tensioner 535. Additionally, the aforementioned variations are for illustrative purposes only with respect to support 500 (and its corresponding mounts 510A-510C) and body 542 (and its corresponding mounts 560A-560C); the described orientations and variations can be reversed.

In some embodiments, tensioner 535 can be configured so that one or more of its springs can be moved from a first discrete or predetermined position, to a second discrete or predetermined position, to increase or decrease the tension within a string mounted to tensioner 535. Moving one or more springs 138A-1380 with respect to support 500 and/or body 542 can increase or decrease the tension in the spring force within springs 138A-138C along a spring force axis 270. Such discrete movement can change the relative tone in the string between the first position and the second position to correspond to a discrete interval in a tonal scale. For example, it may be desirable to change the relative tone a half step, whole step, octave, or any interval therebetween, for example, within a 12-step musical scale or temperament. Such discrete movement can be accomplished in any of a number of different ways. Such structure will enable relatively quick and easy changes to the string pitch, enabling quick retuning of the instrument. For example, a guitar may be configured in a typical "E" tuning when the spring is in the first position, but will be configured in a "dropped D" tuning when the spring is in the second position. A user thus can quickly change from an "E" tuning to a "dropped D" tuning simply by moving a spring from the first position to the second position.

Referring to FIG. 27, a tensioner 535 embodiment is shown in which one or more springs 138A-138C can optionally be removably attached to (e.g., coupled and decoupled from) body 542 and/or support 500. Removable attachment of one or more of the springs can accomplish a discrete change in pitch as just discussed. Such removable attachment can be provided by configuring one or more of ends 264, 266 with a hook, latch, lock, snap, or other suitable removable coupling component that provides such functionality. Attachment and detachment of one or more springs to and from body 542 and/or support 500 will decrease and increase, respectively, the tension in string 50, by a discrete amount, thus changing the pitch in string 50 to a corresponding discrete amount.

The change in pitch described herein to string 50 when mounted on tensioner 535 need not require full disengagement of one or more springs from a portion of tensioner 535, nor does it require full removal of all spring force within the one or more springs. For, example, with reference next to FIGS. 28A and 28B, some embodiments can provide a discrete movement of a spring 138 between a first Position A with a higher tension than a second Position B, without necessarily completely detaching the spring 138 from the body 542 and/or support 500.

Figure 28A:
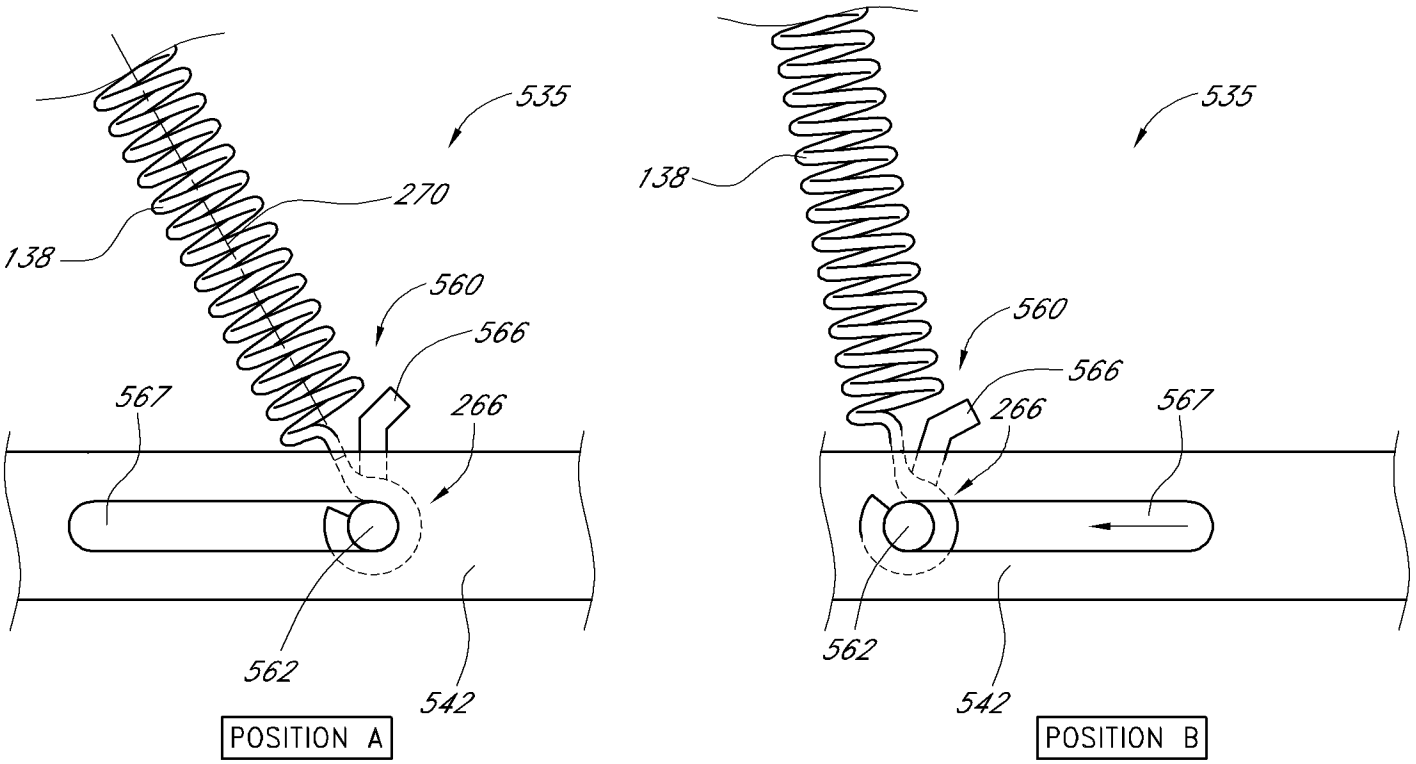
FIG. 28A is a schematic side view of an embodiment of a spring mount of a string tensioner such as that depicted in FIG. 27, taken along line 28-28 of FIG. 27.

Referring to FIG. 28A, spring mount 510 can include a coupler 566 configured to facilitate attachment and detachment of the remainder of mount 510 to and from a portion of elongate body 542. Body 542 can include a slot, groove, track, guide or other suitable guiding feature 567 to facilitate movement (e.g., linear movement) of spring mount 560 (and thus spring end 266) between a first discrete Position A and a second discrete Position B, to provide the aforementioned flexibility in tuning. Such movement can be provided in any of a number of directions that reduce the amount of spring tension along axis 270. Any structure or method, such as a detent, clip, clamp or the like, can be used to hold the mount 560 in its selected position.

Figure 28B:
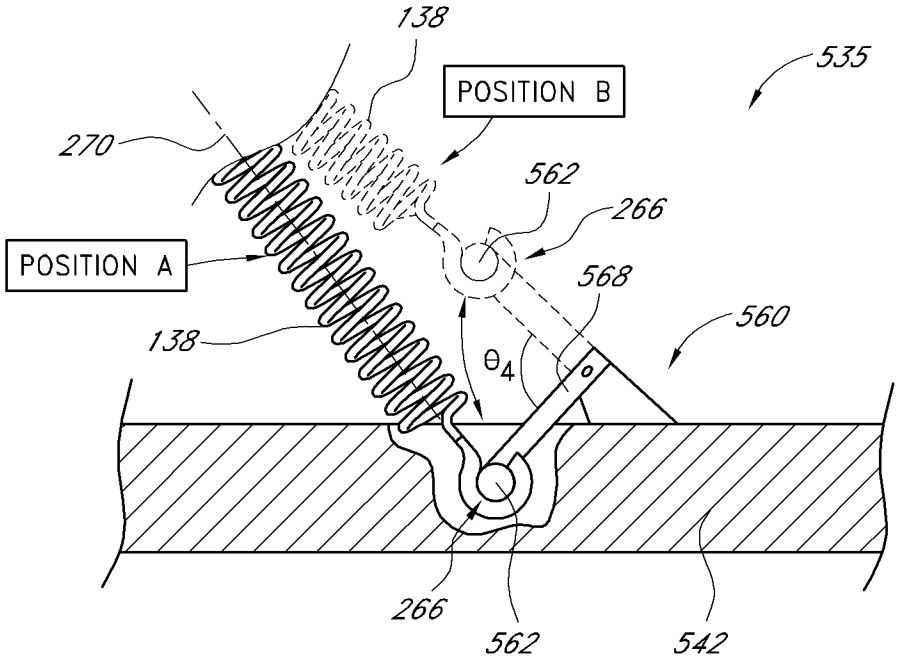
FIG. 28B is a schematic side view of another embodiment of a spring mount of a string tensioner, such as that depicted in FIG. 27, taken along line 28-28 of FIG. 27.

Referring to FIG. 28B, in one exemplary embodiment mount 560 can include a rotational element 568 configured to facilitate movement of mount 560 relative to elongate body 542. Element 568 can include a lever, bearing, cam, guide or other suitable rotatable feature to facilitate movement (e.g., rotational movement of an angle θ4) of spring 138 (e.g., its end 266) between a first discrete Position A and a second discrete Position B, to provide the aforementioned flexibility in tuning. Such movement can be provided in any of a number of directions that reduce the amount of spring tension along axis 270. In some embodiments, a rotational element can be implemented that provides fine-tuning adjustment of spring 138.

Referring to both FIGS. 28A and 28B, it will be understood that while the amount of tension in spring 138 at Position B is less than that at Position A, the actual directions shown to achieve such differences in tension are for illustrative purposes, and will vary depending on the orientation of the components of tensioner 535. Additionally, the actual tension in spring 138 at Position B can be substantially zero, or can be at an amount less than at Position A, but greater than zero. Additionally, similar embodiments can be employed with end 264 and attachment 512 to support 500 in addition or as an alternative to those shown in FIGS. 28A and 28B.

Referring again to FIG. 25, it will be understood that two or more tensioners 535 can be employed to form a tensioning device for a musical instrument with two or more strings, such as a six-string guitar. Preferably a single string is associated with each tensioner 535. Each of the tensioners 535 preferably is individually adjustable to provide the tuning benefits described elsewhere herein for its respective string. In some embodiments, each support 500 corresponds to an independent body 542. In other embodiments, a single body 542 is used in connection with a plurality of supports 500.

In some embodiments, one or more latches, locks, or other suitable locking mechanisms can be provided that can selectively restrict (e.g. lock) movement of one or more tensioners 535 with respect to one or more other components. In some embodiments, one or more locks can restrict movement of one or more tensioners 535 with respect to the instrument body 32. In some embodiments, one or more locks can restrict movement of one or more tensioners 535 with respect to one or more other tensioners 535. In some embodiments, one or more locks can restrict movement of one or more supports 500 relative to body 542. The locking mechanism(s) can be any of a number of shapes, such as a bar 568 configured to span across the two or more tensioners, with a plurality of connectors 569 configured so that the bar 568 will simultaneously engage a plurality of supports 500 and hold the supports 500 so they do not move relative to one another or, in another embodiment, relative to the body 542. As such, when the clamping bar 568 is engaged, the spring modulation members are prevented from moving or otherwise compensating for changes in string length. In some embodiments, a tremolo device configured to move the bridge, one or more strings, and/or move the bar and thus simultaneously move all of the supports 500 so as to achieve a tremolo effect, is provided and in some embodiments, can be operable when the clamp bar or other locking mechanism is engaged. In some embodiments, one or more tensioners 535, or even an entire string tensioning device 550, can be supported by a tremolo plate or frame, which can be movably mounted (e.g., rotatably and/or linearly) to an instrument, to allow such a tremolo effect. The tremolo plate can include an actuator that moves the tremolo plate sufficient to overcome the auto-tuning features of the tensioners 535 so as to create a tremolo effect. Also, the tremolo plate can selectively lock or unlock relative to the instrument, or can include springs that are of sufficient spring force such that the tremolo device does not substantially counteract the springs and auto-tuning features of the tensioners 535 when the plate or frame is actuated so as to create a tremolo effect.

Figure 29A:
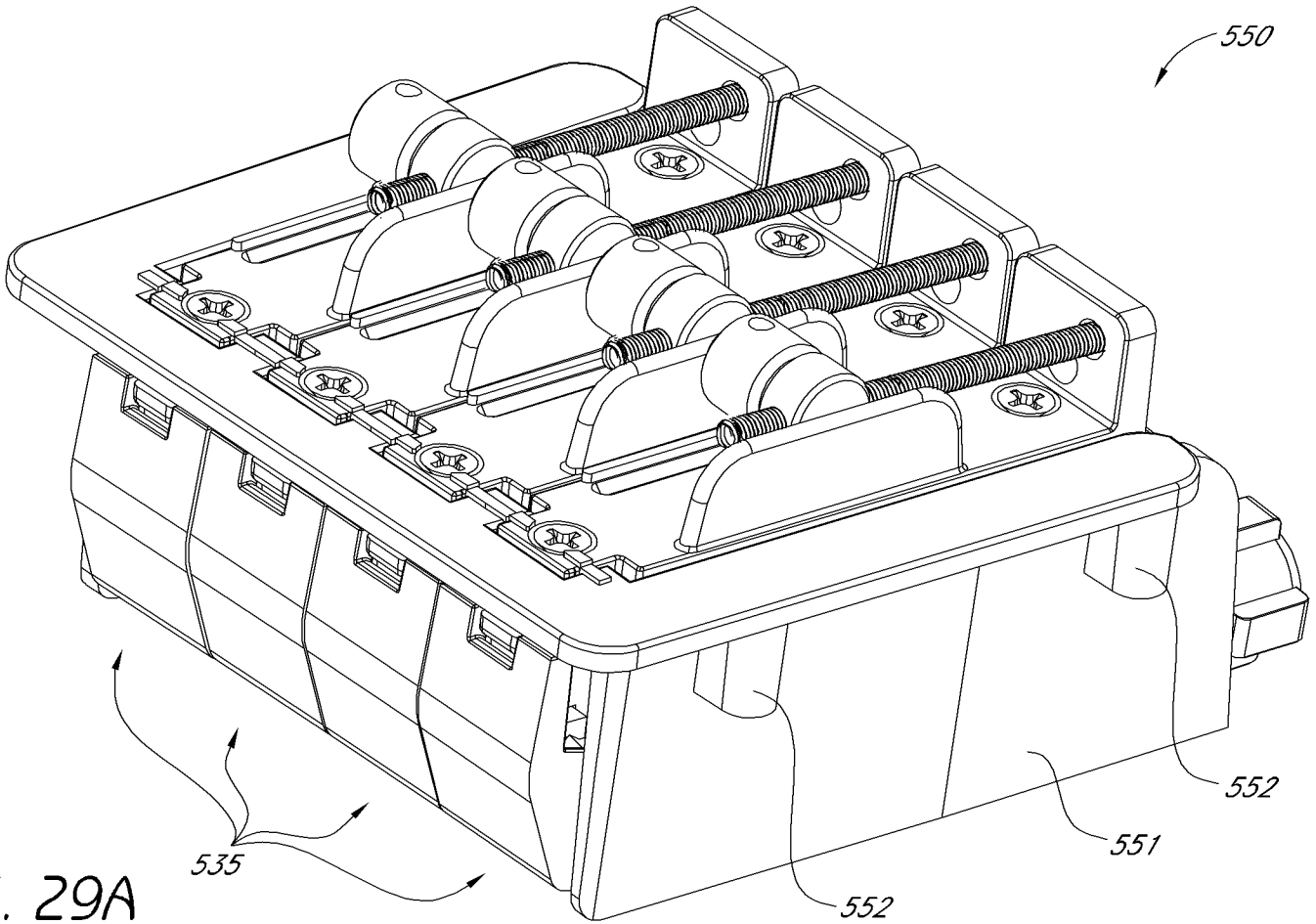
FIG. 29A is a front perspective view of still another embodiment of a string tensioning device employing a plurality of string tensioners.
Figure 29B:
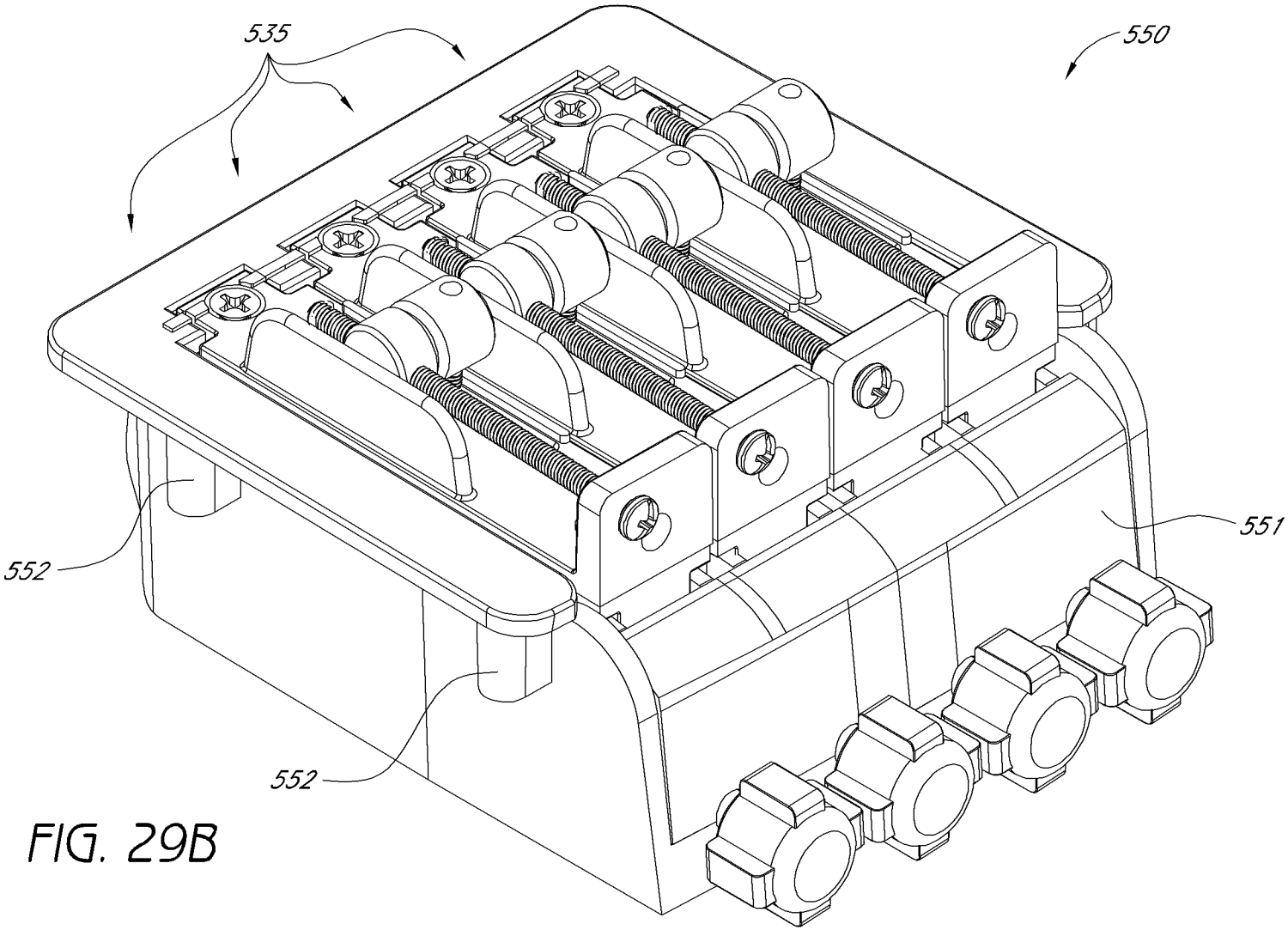
FIG. 29B is a rear perspective view of the string tensioning device of FIG. 29A.

FIGS. 29A and 29B illustrate another embodiment of a string tensioning device 550 that can include one or more of string tensioners 535. In this embodiment, the string tensioning device 550 is configured for use on a four string guitar, and thus includes four string tensioners 535. The device 550 can include a frame 551 configured to support protect, and/or enclose the string tensioners 535. In some embodiments, the string tensioners 535 can be attached to the frame 551, and the tensioners 535 and/or the frame 551 can in turn be attached to a stringed instrument. The frame 551 can comprise any of a number of different suitable shapes that can support, protect and/or enclose the tensioners 535. Frame 551 can include mounts 552 to facilitate attachment to a stringed instrument. It will be understood that frame 551 can be implemented with other string tensioners and string tensioning devices described herein, such as those described above with reference to FIGS. 24-28B.

FIGS. 30-32 illustrates an embodiment of a string tensioner 535 for a stringed musical instrument that employs principles substantially similar in some aspects to those represented in FIGS. 24-28B. Some additional aspects of the embodiment of tensioner 535 shown in FIGS. 30-32 follow:

FIGS. 30-32 present an embodiment in which an intonation adjustment screw 203 can provide adjustable intonation of the string 50, by allowing movement (horizontal movement in the view shown in FIG. 31) of the saddle 192 relative to the string connector 202. An action adjustment screw 205 can provide adjustable action of the string 50, by allowing movement (vertical movement in the view shown in FIG. 21) of the saddle 192 relative to the support 500. It is to be understood that other intonation and action mechanisms can be employed.

In the illustrated embodiment, more than one spring is mounted on a single spring mount. As shown, spring mount 510A can include a pair of opposed pins 512A, 512B, to which the ends of a pair of springs 138A, 138B can attach. Spring mount 560A can also include a pair of opposed pins 562A, 562B, to which the opposed ends of the pair of springs 138A, 138B can attach.

FIGS. 30-32 also present an embodiment in which the spring mount 560A can be movable with respect to the elongated body 542, to provide the aforementioned fine-tuning adjustment for the string 50. Such movement can be provided with an adjustment mechanism, such as a drive screw 553, that extends through a corresponding threaded portion of the spring mount 560A, thus allowing the spring mount 560A to move (e.g., longitudinally) with respect to the body 542, in response to rotation of the drive screw 553. The drive screw 553 can include a knob 554 to facilitate such adjustment. Other suitable adjustment mechanisms can be implemented that provide rotational or linear movement between two components, such as various slides, actuators, tracks, grooves/pins, and the like. Adjustment of the positioning of spring mount 560A relative to body 542 adjusts the angle θ1 between one or more springs attached to the spring mount 560A and the body 542. In further embodiments, structure is provided to enable the spring mount or the drive screw upon which it is mounted to be quickly moved to a discrete distance so as to quickly change the spring tension as described above in connection with FIGS. 28A and 28B. It will be understood that alternative or additional adjustment to the springs can be achieved through a similar adjustment mechanism that can move the spring mount 510A and the opposed ends of springs 138A, 138B relative to support 500.

As best shown perhaps in FIG. 31, spring modulation member 540A can provide the aforementioned pivotability between member 540A and support 500 (at pivot 513A), and between member 540A and body 542 (at pivot 182A). The illustrated spring modulation member 540A comprises a cross-sectional shape (such as the illustrated square cross-sectional shape) that includes one or more tips or corners 501, 503 (such as the upper and lower corners of the square). The tips or corners 501, 503 of the spring modulation member 540A can be configured to contact and thus pivot with respect to corresponding inwardly-facing portions of support 500 and elongated body 542, respectively. For example, in some embodiments, the support 500 and elongated body 542 can include recesses or concavities 502, 504, respectively configured to pivotably receive and engage with the tips 501, 503 of spring modulation member 540A.

In the illustrated embodiment, the tips 501, 503 are shown as outwardly facing, whereas the recesses 502, 504 are inwardly facing. Some such embodiments can allow support 500 to move at pivots 513A and 513B along paths 900A and 900B, respectively, relative to pivots 182A and 182B, respectively, as described above and shown in FIG. 24. In some embodiments, modulation member 540A can be supported between support 500 and elongated body 542 through the tensional forces provided by the one or more springs (e.g., springs 138A, 138B). Thus, modulation member 540A can be pivotably attached to support 500 and elongated body 542 without a hinge, rotatable coupling, bearing or other more complex rotational structure, although modulation member 540A can include one or more of these components, in some embodiments. It will be understood that modulation member 540A need not be limited to a square structure or an angular tip; for example, a convex, curvilinear tip, or a modulation member with another polygonal cross-sectional shape with opposed tips can achieve similar functionality. Additionally, the tips 501, 503 and recesses 502, 504 can be extended laterally (into the page of the view shown in FIG. 31), to form angular or curved edges that pivotably engage with a corresponding groove or other laterally-extending recess.

Continuing to refer to FIG. 31, spring modulation member 540B can include similar features as spring modulation member 540A. For example, spring modulation member 540B can also employ a simple structure that can provide the aforementioned pivotability between member 540B and support 500 (at pivot 513B), and between member 540B and body 542 (at pivot 182B). In the illustrated embodiment, spring modulation member 540B includes tips 505, 507 configured to pivotably engage with corresponding recesses or concavities 506, 508, on support 500 and elongated body 542, respectively. The illustrated spring modulation member 540B can comprise a cross-sectional shape that includes one or more inwardly-facing tips 505, 507, such as the illustrated "crescent" or C-like shape. The corresponding recesses 506, 508, on support 500 and elongated body 542, respectively, can be outwardly facing to pivotably engage with tips 505, 507. The C-like shape, or other suitable shapes that provide the inwardly facing tips 505, 507 and outwardly facing recesses 506, 508, can allow a portion of support 500 and body 542 to be positioned between and supported by the spring modulation member 540B, while still allowing the aforementioned pivotability and paths of relative motion between support 500 and body 542. In some embodiments, the spring modulation member 540B can provide an inward bias between support 500 and body 542, to counteract the tension of string 50 on tensioner 535, which would otherwise have a tendency to separate support 500 from body 542 in a counter-clockwise direction, as depicted in the views shown in FIGS. 30 and 32.

Tensioner 535 can include additional features to affect the interplay of relative movement between support 500 and elongated body 542. Referring to FIGS. 30 and 31, in some embodiments, tensioner 535 can include a stop 522. Stop 522 can limit the amount of travel of support 500 in a counter-clockwise direction relative to elongated body 542. Stop 522 can prevent the auto-tune features of tensioner 535 from cancelling a player's bending effect, as described further above with respect to the stop bolt 224 in FIG. 6. Stop 522 can provide such functionality in a number of different ways. For example, support 500 can include a tab 524 configured to engage with a corresponding shoulder 525 on elongated body 542, with a gap 527 extending between shoulder 525 and tab 524. The height of gap 527 can be selected to correspond to a desired amount of travel between support 500 and body 542, to allow for some auto-tuning capability. It will be understood that stop 522 can comprise a variety of different mechanisms suitable to limit the amount of travel of support 500 relative to elongated body 542, such as a flange, lip, hook, groove, slot, etc.

With continued reference to FIG. 31, the C-shaped modulation member 540B in the illustrated embodiment can be biased to exert an inwardly-directed force upon the recesses 506, 508 through its tips 505, 507 so that the modulation member 540B remains securely in place even when the support 500 and body 542 are engaged with each other as shown in FIG. 31. However, when the string 50 is tightened, the associated force may pull the support 500 away from the body 542. In some embodiments, the C-shaped modulation member 540B may have some elasticity, and may expand in length as the support 500 moves relative to the body 542. Accordingly, its effective length 214*b* as a modulation member may increase. At the same time, modulation member 540A is in compression, and due to its shape and configuration its effective length 214*a* is expected to remain constant. Thus, in some embodiments, the support 500 can be expected to move with one component of movement in which the modulation members 540A, 540B cooperate as a linkage, rotating about their respective pivots in a manner as discussed above in connection with FIGS. 24-28. Another component of movement can be the support 500 rotating about the modulation member 540A as C-shaped modulation member 540B expands. In some embodiments, elastic expansion of the C-shaped member 540B, is very small, such as less than 5%, more preferably less than 2%, and most preferably about 1% or less. As such, in some embodiments elastic expansion of the c-shaped modulation member 540B is negligible in comparison to the elastic expansion of the springs 138.

In some embodiments, support 500 can include a pin, protrusion, or other suitable structure configured to interact with a groove, recess, or other suitable structure on elongated body 542, or vice versa, to limit some lateral motion between support 500 and elongated body 542. As best shown in FIG. 30, the end 148 of elongated body 542 can include lateral stabilizers 529 configured on opposing sides of shoulder 525, which can limit or prevent lateral travel of tab 524 when tab 524 is positioned therebetween. Referring to FIG. 32, the end 150 of body 542 can include lateral stabilizers 521 configured to similarly limit or prevent lateral travel of a tab 520 in body 500.

Although the inventions disclosed herein have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while a number of variations have been shown and described in detail, other modifications, which are within the scope of these inventions, will be readily apparent to those of skill in the art based upon this disclosure. It is also contemplated that various combinations or subcombinations of the specific features and aspects of the embodiments may be made and still fall within the scope of the inventions. Accordingly, it should be understood that various features and aspects of the disclosed embodiments can be combined with or substituted for one another in order to form varying modes of the disclosed inventions. For instance, lighting sources discussed in connection with FIGS. 2-4 may also be employed in connection with embodiments shown in FIGS. 5-12 or any embodiments taught or suggested herein, and coil springs as shown in FIGS. 5-12 can be used in embodiments such as that shown in FIG. 22. Thus, it is intended that the scope of the present invention herein disclosed should not be limited by the particular disclosed embodiments described above, but should be determined only by a fair reading of the claims that follow.

What is claimed is:

1. A tensioner for a string on a stringed musical instrument, comprising:

an elongated body configured to be supported by a portion of a stringed musical instrument;

a first and a second spring modulation member, each of the first and second spring modulation members comprising a first portion pivotably attached to a portion of the elongated body;

a spring modulation support configured to support a string, the spring modulation support being pivotably attached to a second portion of each of the first and second spring modulation members; and wherein at least one spring is interposed between the elongated body and the spring modulation support.

2. The tensioner of claim 1, wherein the at least one spring comprises two or more springs, wherein at least one of the two or more springs is removably attached to at least one of the elongated body and the spring modulation support to provide discrete tuning of a string on a stringed musical instrument on which the tensioner is mounted.

3. The tensioner of claim 1, wherein the at least one spring comprises a first and a second spring, the first spring mounted to the elongated body and the spring modulation support at a different angle than the second spring.

4. The tensioner of claim 1, wherein the attachment of the at least one spring is movable with respect to at least one of the elongated body and the spring modulation support to vary the spring tension between the elongated body and the spring modulation support.

5. The tensioner of claim 4, further comprising an adjustable spring mount configured to adjust the position of an end of the spring relative to the elongated body.

6. The tensioner of claim 1, further comprising a spring mount configured to attach a pair of springs to at least one of the elongated body and the spring modulation support.

7. The tensioner of claim 1, wherein the at least one spring comprises at least a pair of laterally adjacent springs.

8. The tensioner of claim 1, further comprising a stop configured to limit the travel of pivotability between the elongated body and the spring modulation support.

9. The tensioner of claim 8, wherein the stop comprises a tab of at least one of the elongated body and the spring modulation support, the tab configured to engage with a shoulder portion of the other of the elongated body and the spring modulation support.

10. The tensioner of claim 1, wherein at least one of the elongated body and the spring modulation support comprises a lateral stabilizer configured to limit lateral movement of the elongated body and the spring modulation support with respect to each other.

11. The tensioner of claim 1, wherein at least one of the first and second spring modulation members comprises a pair of tips configured to pivotably attach the first portion of the respective spring modulation member to the elongated body and the second portion of the respective spring modulation member to the spring modulation support.

12. The tensioner of claim 11, wherein the pair of tips of the first spring modulation member comprises a pair of outwardly facing tips configured to engage a pair of inwardly facing recesses in each of the elongated body and the spring modulation support.

13. The tensioner of claim 12, wherein the first spring modulation member comprises an approximately square cross-sectional shape, the pair of tips comprising opposed corners of the square.

14. The tensioner of claim 11, wherein the pair of tips of the second spring modulation member comprises a pair of inwardly facing tips configured to engage a pair of outwardly facing recesses in each of the elongated body and the spring modulation support.

15. The tensioner of claim 14, wherein the second spring modulation member comprises an approximately C-shape, the pair of tips comprising inwardly-facing tips of the C-like shape.

16. The tensioner of claim 14, wherein the second spring modulation member provides an inward bias between the elongated body and the spring modulation support.

17. The tensioner of claim 16, wherein the second spring modulation member is elastically expandable so that a distance between the inwardly facing tips can expand or contract as the spring modulation support moves relative to the elongated body.

18. A string tensioning device for a stringed musical instrument comprising two or more of the tensioners of claim 1, wherein the two or more tensioners can be locked with respect to each other.

19. A stringed musical instrument comprising the tensioner of claim 1.

20. A tensioner for a string on a stringed musical instrument, comprising:

an elongated body configured to be mounted on a musical instrument;

a spring modulation support configured to support a string of the musical instrument;

a first spring modulation member and a second spring modulation member;

a first pivotable means for pivotably attaching the first spring modulation member to each of the elongated body and the spring modulation support;

a second pivotable means for pivotably attaching the second spring modulation support member to each of the elongated body and the spring modulation support; and means for providing a bias between the elongated body and the spring modulation support.

* * * * *